US012133566B2

(12) United States Patent
Blecher et al.

(10) Patent No.: US 12,133,566 B2
(45) Date of Patent: Nov. 5, 2024

(54) FLUID-BASED EXOSKELETAL BODY ARMOR WITH CLIMATE CONTROL

(71) Applicant: Sports Medicine Sciences, LLC, Los Angeles, CA (US)

(72) Inventors: Andrew Blecher, Los Angeles, CA (US); Leonard Wozniak, Vancouver, WA (US)

(73) Assignee: Sports Medicine Sciences, LLC, Los Angeles, CA (US)

( * ) Notice: Subject to any disclaimer, the term of this patent is extended or adjusted under 35 U.S.C. 154(b) by 236 days.

(21) Appl. No.: 17/672,120

(22) Filed: Feb. 15, 2022

(65) Prior Publication Data

US 2022/0167690 A1 Jun. 2, 2022

Related U.S. Application Data

(63) Continuation-in-part of application No. 15/292,354, filed on Oct. 13, 2016, now Pat. No. 11,247,115.

(60) Provisional application No. 62/240,613, filed on Oct. 13, 2015.

(51) Int. Cl.

| | |
|---|---|
| ***A41D 13/018*** | (2006.01) |
| ***A42B 3/04*** | (2006.01) |
| ***A42B 3/22*** | (2006.01) |

(52) U.S. Cl.

CPC ..... *A41D 13/018* (2013.01); *A42B 3/0433* (2013.01); *A42B 3/0486* (2013.01); *A42B 3/22* (2013.01); *A41D 2600/10* (2013.01)

(58) Field of Classification Search

CPC ..... F41H 1/02; F41H 1/04

USPC ..... 2/456, 463, 464, 467, 411, 413, 468

See application file for complete search history.

(56) References Cited

U.S. PATENT DOCUMENTS 3,774,239 A 11/1973 Kotzar
4,637,074 A * 1/1987 Taheri ..... A41D 13/018 2/456
4,783,853 A 11/1988 Zuber
(Continued)

*Primary Examiner* — Jocelyn Bravo

(74) *Attorney, Agent, or Firm* — Pandiscio & Pandiscio

(57) ABSTRACT

A protective suit comprising: a head portion comprising a fluid-filled head portion chamber; a neck portion releasably secured to the head portion and comprising a neck portion chamber, wherein the fluid-filled head portion chamber is in fluid communication with the neck portion chamber; and a torso portion releasably secured to the neck portion and comprising a fluid-filled torso portion chamber, wherein the fluid-filled torso portion chamber is in fluid communication with the neck portion chamber; and wherein the head portion is configured to be disposed on a head of the wearer, the neck portion is configured to be disposed in an arcuate manner around a neck of the wearer, and the torso portion is configured to be disposed on a torso of the wearer, such that when a force of an impact is received on the head portion, fluid from the fluid-filled head portion chamber is transferred into the neck portion chamber to support the neck of the wearer against translational and rotational forces imparted to the wearer, and when a force of an impact is received on the torso portion, fluid from the fluid-filled torso portion chamber is transferred to the neck portion chamber to support the neck of the wearer against translational and rotational forces imparted to the wearer.

39 Claims, 88 Drawing Sheets

(56) References Cited

U.S. PATENT DOCUMENTS

| | | | | |
|---|---|---|---|---|
| 5,535,446 | A * | 7/1996 | Pusic | A42B 3/0486 2/463 |
| 6,874,170 | B1 * | 4/2005 | Aaron | A63B 71/1291 2/468 |
| 2006/0144557 | A1 * | 7/2006 | Koscheyev | F28F 21/06 165/46 |
| 2007/0085340 | A1 | 4/2007 | Gammons | |
| 2007/0118952 | A1 * | 5/2007 | Lee | A41D 13/018 2/69 |
| 2008/0307569 | A1 | 12/2008 | Roberts | |
| 2010/0251451 | A1 | 10/2010 | Feldman et al. | |
| 2011/0162131 | A1 * | 7/2011 | Harty | A42B 3/0473 2/413 |
| 2012/0214647 | A1 | 8/2012 | Ji et al. | |
| 2013/0283506 | A1 | 10/2013 | Archbold | |
| 2013/0298318 | A1 | 11/2013 | Rogers | |
| 2014/0007326 | A1 | 1/2014 | Nelson | |
| 2015/0230534 | A1 | 8/2015 | McGuckin, Jr. | |
| 2015/0320134 | A1 | 11/2015 | Stolker | |

* cited by examiner

SECTION VIEW

SECTION VIEW

SECTION VIEW

FRONT VIEW

SECTION VIEW

BACK VIEW

BOTTOM VIEW

TOP VIEW

SECTION VIEW

FRONT VIEW

BOTTOM VIEW

TOP VIEW

BACK VIEW

SECTION VIEW

FRONT VIEW

BOTTOM VIEW

SIDE VIEW

11) COMPRESSION & DISPLACEMENT MECHANISM

2) SLIDE & ROTATE MECHANISM

3) REMOVABLE SENSOR MODULE

FLUID-BASED EXOSKELETAL BODY ARMOR WITH CLIMATE CONTROL

REFERENCE TO PENDING PRIOR PATENT APPLICATIONS

This patent application is a continuation-in-part of prior U.S. patent application Ser. No. 15/292,354, filed Oct. 13, 2016 by Sports Medicine Sciences, LLC and Andrew Blecher for FLUID-BASED EXOSKELETAL BODY ARMOR WITH CLIMATE CONTROL, which patent application, in turn claims benefit of prior U.S. Provisional Patent Application Ser. No. 62/240,613, filed Oct. 13, 2015 by Andrew Blecher for CONCUSSION REDUCTION SYSTEM COMPRISING NOVEL HELMET/FACEMASK AND NOVEL FLUID-BASED EXOSKELETON BODY ARMOR WITH CLIMATE CONTROL.

The two (2) above-identified patent applications are hereby incorporated herein by reference.

FIELD OF THE INVENTION

This invention relates generally to methods and apparatus for protecting the body, and more particularly to methods and apparatus for protecting the brain, neck and torso of a person against injury.

BACKGROUND OF THE INVENTION

There is growing awareness that injuries pose a serious health risk for athletes engaged in contact sports, e.g., football players. Of particular concern is the growing awareness of the health risk posed by concussive brain injuries. Among other things:

(1) current helmet/facemask constructions encourage helmet-to-helmet contact, have increased mass which increases head-to-neck mass ratios (which in turn increases the "bobble-head" effect, producing coup-counter-coup injuries to the brain), and have failed to reduce the incidence of concussions;

(2) current equipment does not adequately protect the neck of the athlete; and (3) current equipment does not adequately protect the torso of the athlete.

In addition, current equipment inhibits the body's ability to disperse body heat and leads to increased body core temperatures, which lowers athletic performance and risks heat-related illnesses (e.g., hyperthermia and heatstroke). And, while it has been recognized that in certain contexts it may be desirable to effect cooling of the body (e.g., to address hyperthermia, to minimize traumatic brain injury due to concussion, to minimize trauma to the body due to a heart attack, etc.), current equipment does not provide any way to effect cooling of a player wearing the equipment.

Additionally, in certain contexts it may also be desirable to effect rapid immobilization of the neck to protect the athlete with a suspected spine and/or neck injury.

Similar problems exist in non-athletic situations, e.g., with military personnel, police personnel, etc. who are exposed to injuries such as from bomb blasts.

In addition, current equipment does not provide any way of tracking, in real-time, player status with respect to impacts received or other physiologic data (e.g., temperature, pulse, etc.) during use of the equipment.

Thus there is a need for a new and improved system for protecting the body which (i) provides better protection against concussions, (ii) provides better protection against neck injuries, (iii) provides better protection against torso injuries, (iv) protects against hyperthermia (and heatstroke) and hypothermia by facilitating cooling or warming of the body, (iv) maximizes physical performance through optimization of body temperature, (v) provides rapid cooling and/or neck immobilization after injury (or suspected injury), and (vi) allows for real-time wireless tracking of player condition.

SUMMARY OF THE INVENTION

These and other objects of the invention are addressed by the provision and use of novel fluid-based exoskeletal body armor with climate control. The novel body armor provides better protection against concussions, provides better protection against neck injuries, provides better protection against torso injuries, protects against hyperthermia (and heatstroke) and hypothermia by facilitating rapid cooling or warming of the body, maximizes physical performance through optimization of body temperature, provides rapid cooling and/or neck immobilization after injury (or suspected injury) and allows for real-time wireless tracking of player condition.

In one preferred form of the invention, there is provided a protective system comprising:

a protective suit capable of withstanding the force of an impact without tearing, the protective suit comprising:

- a head portion;
- a neck portion connected to the head portion;
- a torso portion connected to the neck portion;
- a fluid bladder formed in at least two of the head portion, neck portion and torso portion, the fluid bladder containing a fluid; and
- an alert indicator for indicating when the force of an impact on the fluid bladder exceeds a predetermined threshold.

In another preferred form of the invention, there is provided a helmet comprising:

- a head shell formed out of a light-weight composite and devoid of padding, the head shell comprising a crown-to-frontal wedge bossing;
- a built-in soft gel eye socket mask; and
- an adjustable face shield and an adjustable chin protection for selectively covering the face of a wearer, wherein the face shield comprises wedge bossing.

In another preferred form of the invention, there is provided a method for protecting an individual, the method comprising:

- positioning a protective system on the individual, the protective system comprising:
  - a protective suit capable of withstanding the force of an impact without tearing, the protective suit comprising:
    - a head portion;
    - a neck portion connected to the head portion;
    - a torso portion connected to the neck portion;
    - a fluid bladder formed in at least two of the head portion, neck portion and torso portion, the fluid bladder containing a fluid; and
    - an alert indicator for indicating when the force of an impact on the fluid bladder exceeds a predetermined threshold.

In another preferred form of the invention, there is provided a protective system comprising:

- a protective suit configured to be worn by a wearer, the protective suit comprising:

a head portion comprising a fluid-filled head portion chamber;

a neck portion releasably secured to the head portion and comprising a neck portion chamber, wherein the fluid-filled head portion chamber is in fluid communication with the neck portion chamber; and a torso portion releasably secured to the neck portion and comprising a fluid-filled torso portion chamber, wherein the fluid-filled torso portion chamber is in fluid communication with the neck portion chamber; and wherein the head portion is configured to be disposed on a head of the wearer, the neck portion is configured to be disposed in an arcuate manner around a neck of the wearer, and the torso portion is configured to be disposed on a torso of the wearer, such that when a force of an impact is received on the head portion, fluid from the fluid-filled head portion chamber is transferred into the neck portion chamber to support the neck of the wearer against translational and rotational forces imparted to the wearer, and when a force of an impact is received on the torso portion, fluid from the fluid-filled torso portion chamber is transferred to the neck portion chamber to support the neck of the wearer against translational and rotational forces imparted to the wearer.

In another preferred form of the invention, there is provided a method for protecting an individual, the method comprising:

positioning a protective system on the individual, the protective system comprising:

a head portion comprising a fluid-filled head portion chamber;

a neck portion releasably secured to the head portion and comprising a neck portion chamber, wherein the fluid-filled head portion chamber is in fluid communication with the neck portion chamber; and a torso portion releasably secured to the neck portion and comprising a fluid-filled torso portion chamber, wherein the fluid-filled torso portion chamber is in fluid communication with the neck portion chamber; and wherein the head portion is disposed on a head of the individual, the neck portion is disposed in an arcuate manner around a neck of the individual, and the torso portion is disposed on a torso of the individual, such that when a force of an impact is received on the head portion, fluid from the fluid-filled head portion chamber is transferred into the neck portion chamber to support the neck of the individual against translational and rotational forces imparted to the individual, and when a force of an impact is received on the torso portion, fluid from the fluid-filled torso portion chamber is transferred to the neck portion chamber to support the neck of the individual against translational and rotational forces imparted to the individual; and injecting fluid into at least one of the fluid-filled head portion chamber and the fluid-filled torso portion chamber.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like parts, and further wherein.

DETAILED DESCRIPTION OF THE PREFERRED EMBODIMENTS

The present invention comprises the provision and use of novel fluid-based exoskeletal body armor with climate control. The novel body armor provides better protection against concussions, provides better protection against neck injuries, provides better protection against torso injuries, and protects against hyperthermia (and heatstroke) and hypothermia by facilitating cooling or warming of the body, and maximizes physical performance through optimization of body temperature, provides immediate cooling and/or neck and spine immobilization after injury (or suspected injury) and allows for real-time wireless tracking of player condition.

First Construction

Figure 1:
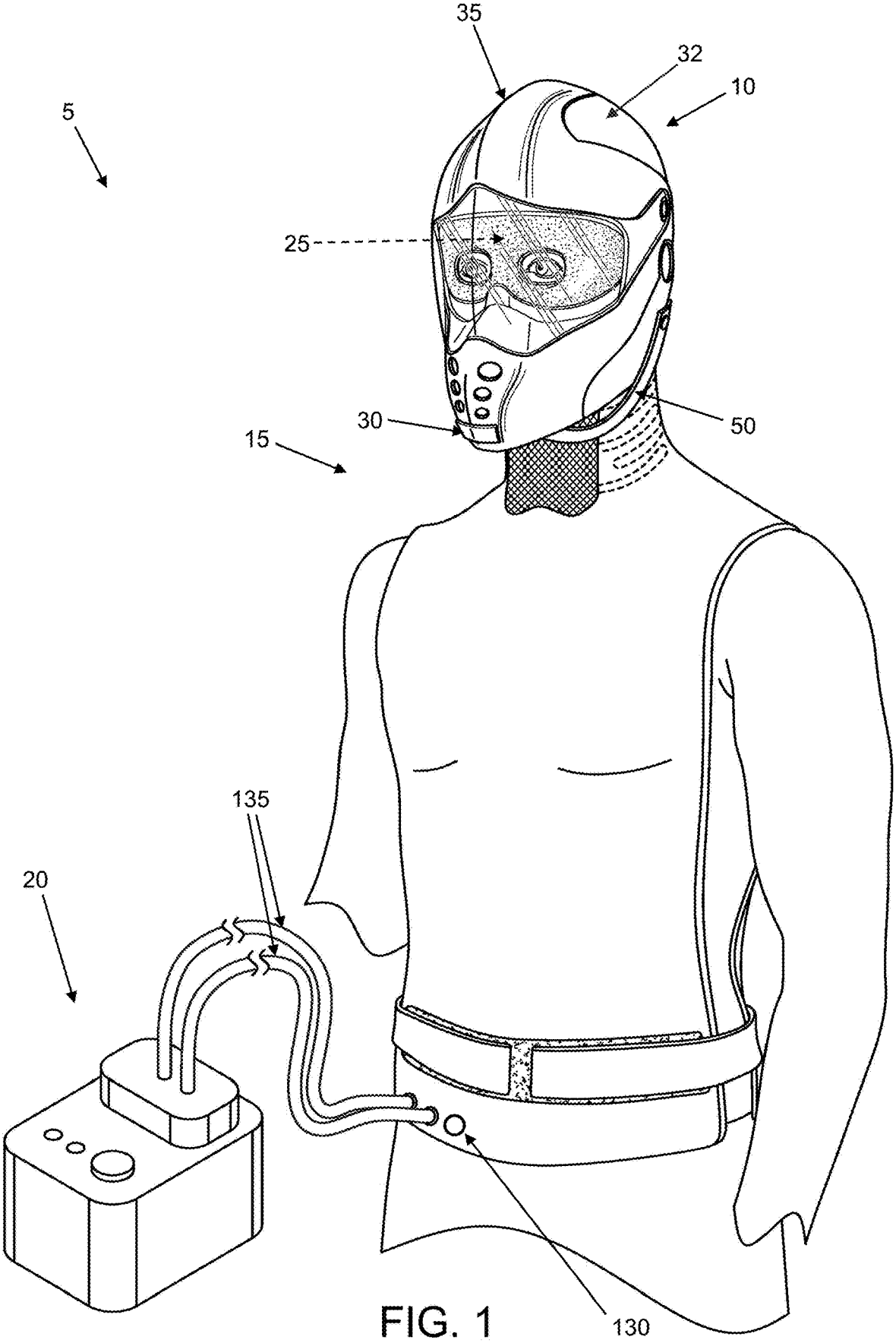
FIG. 1 is a schematic view showing a novel system formed in accordance with the present invention.
Figure 2:
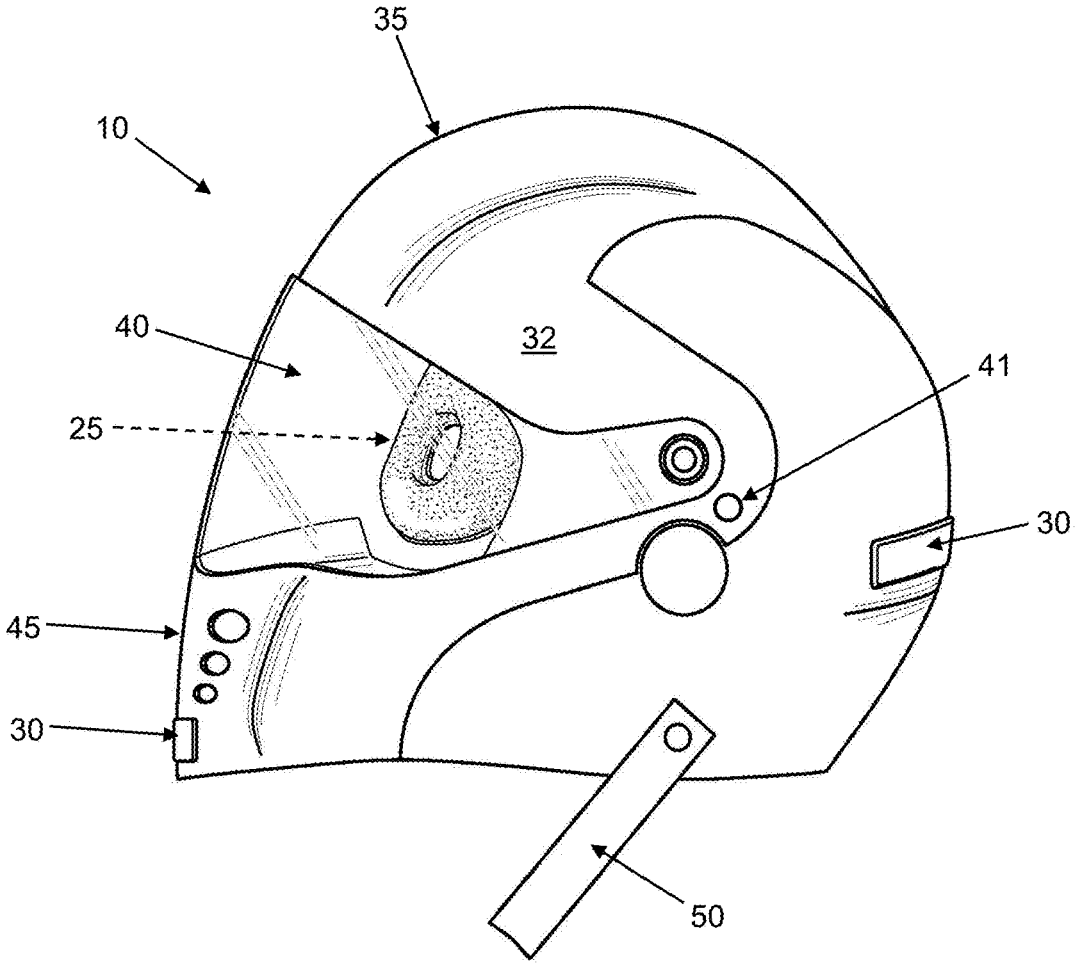
FIGS. 2-6 are schematic views showing a novel helmet formed in accordance with the present invention.
Figure 3:
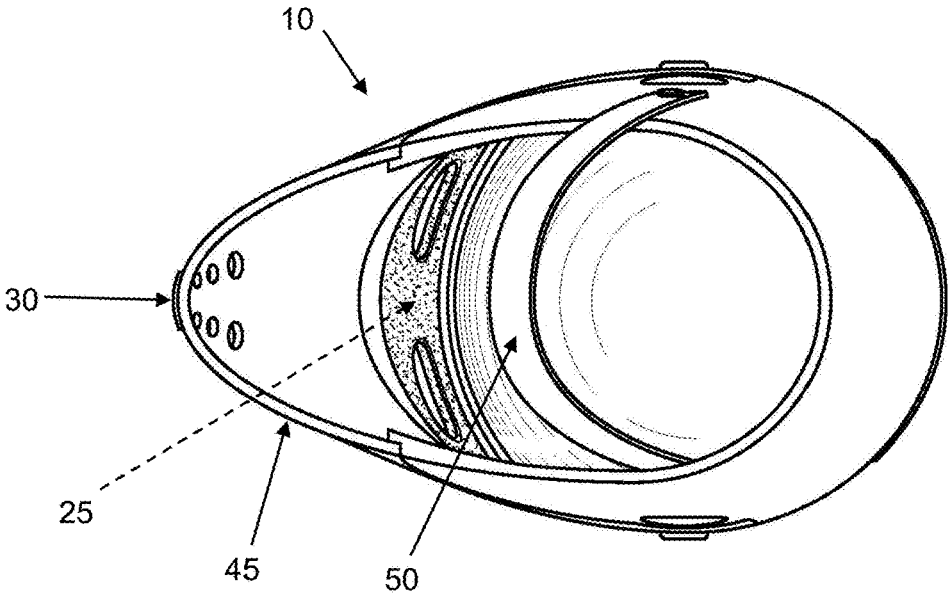
Figure 4:
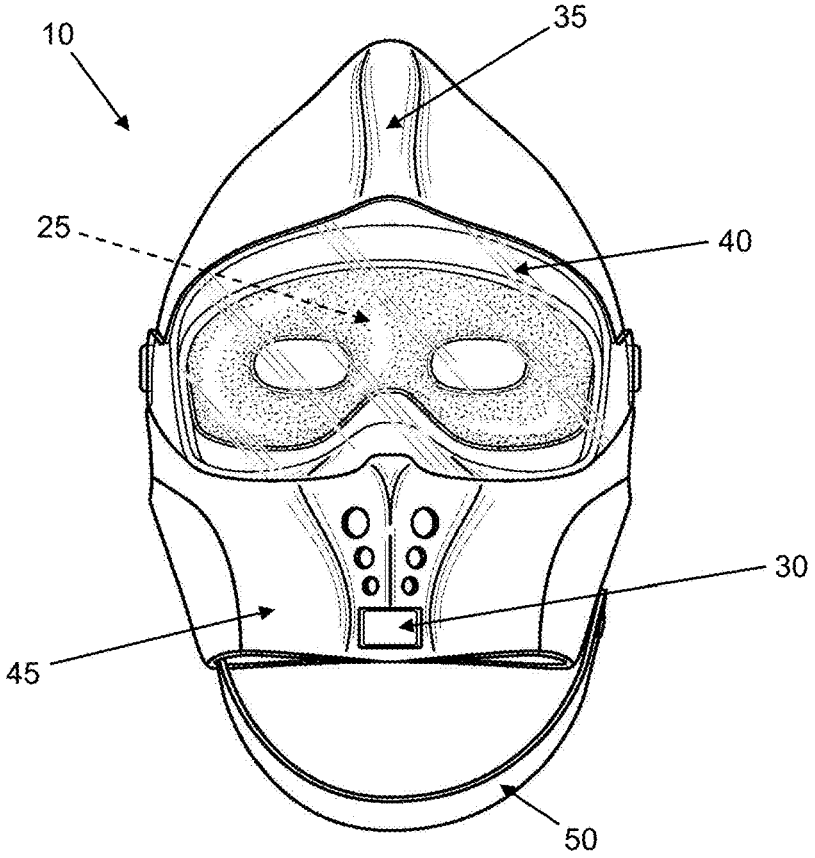
Figure 5:
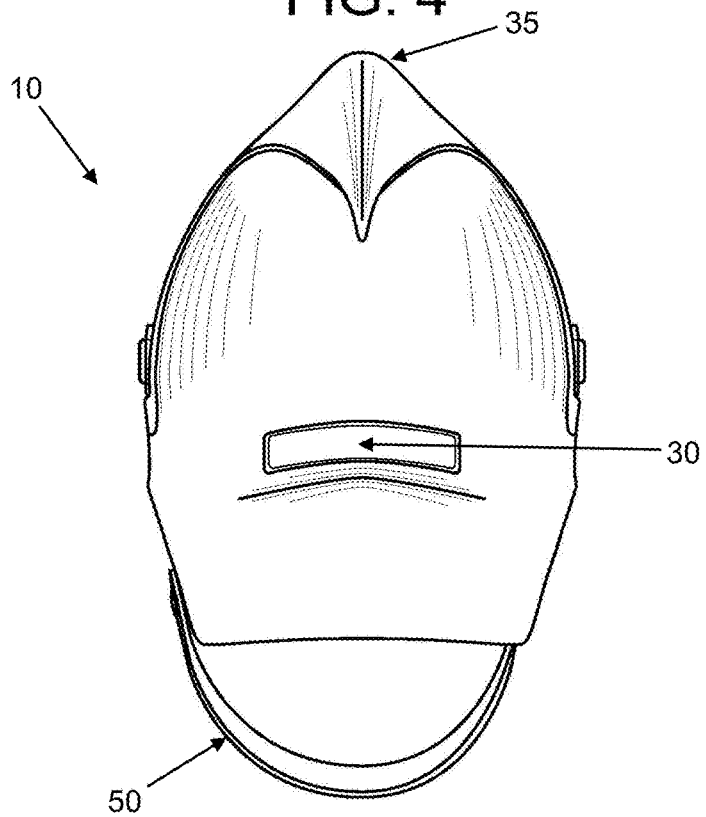
Figure 6:
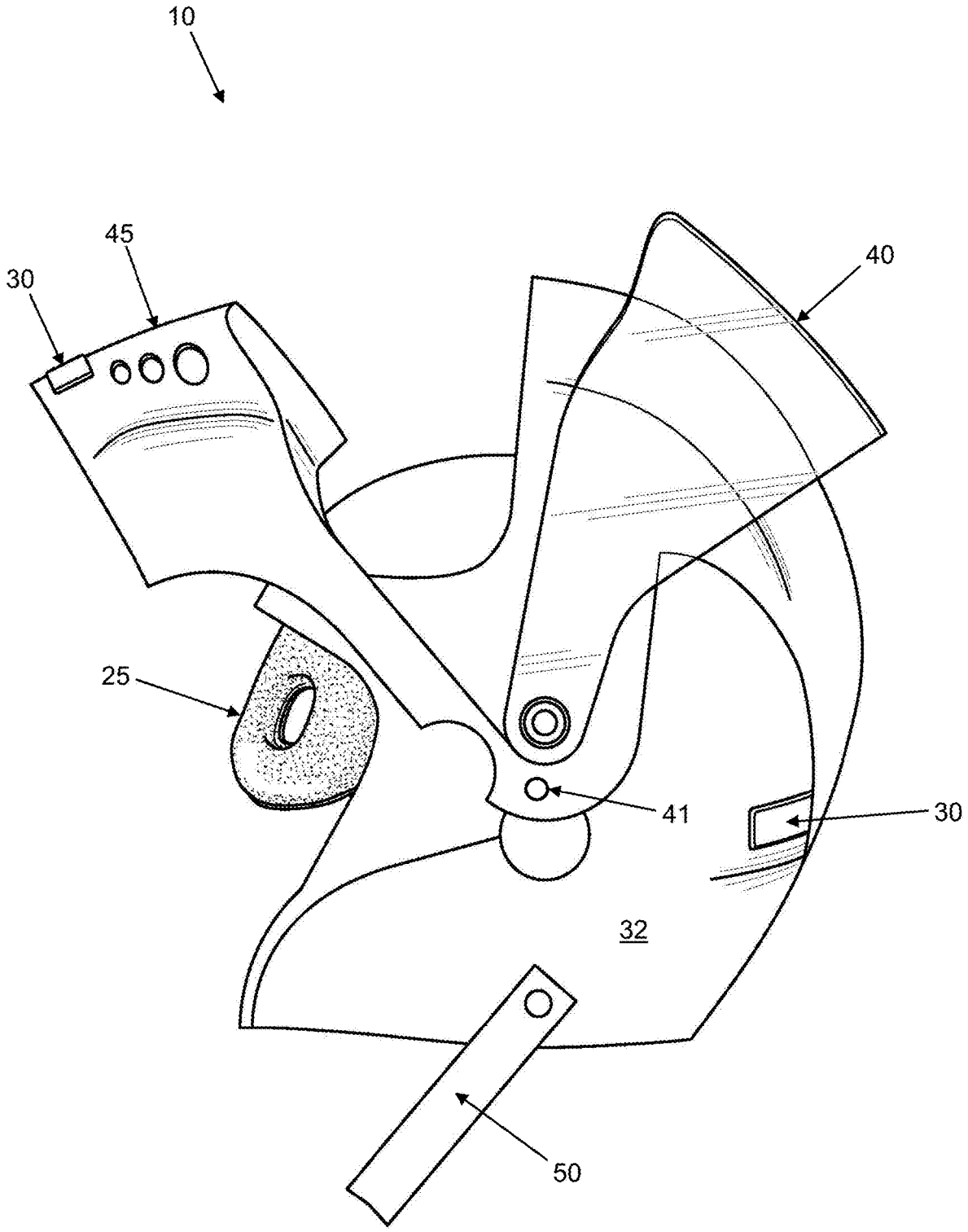
Figure 7:
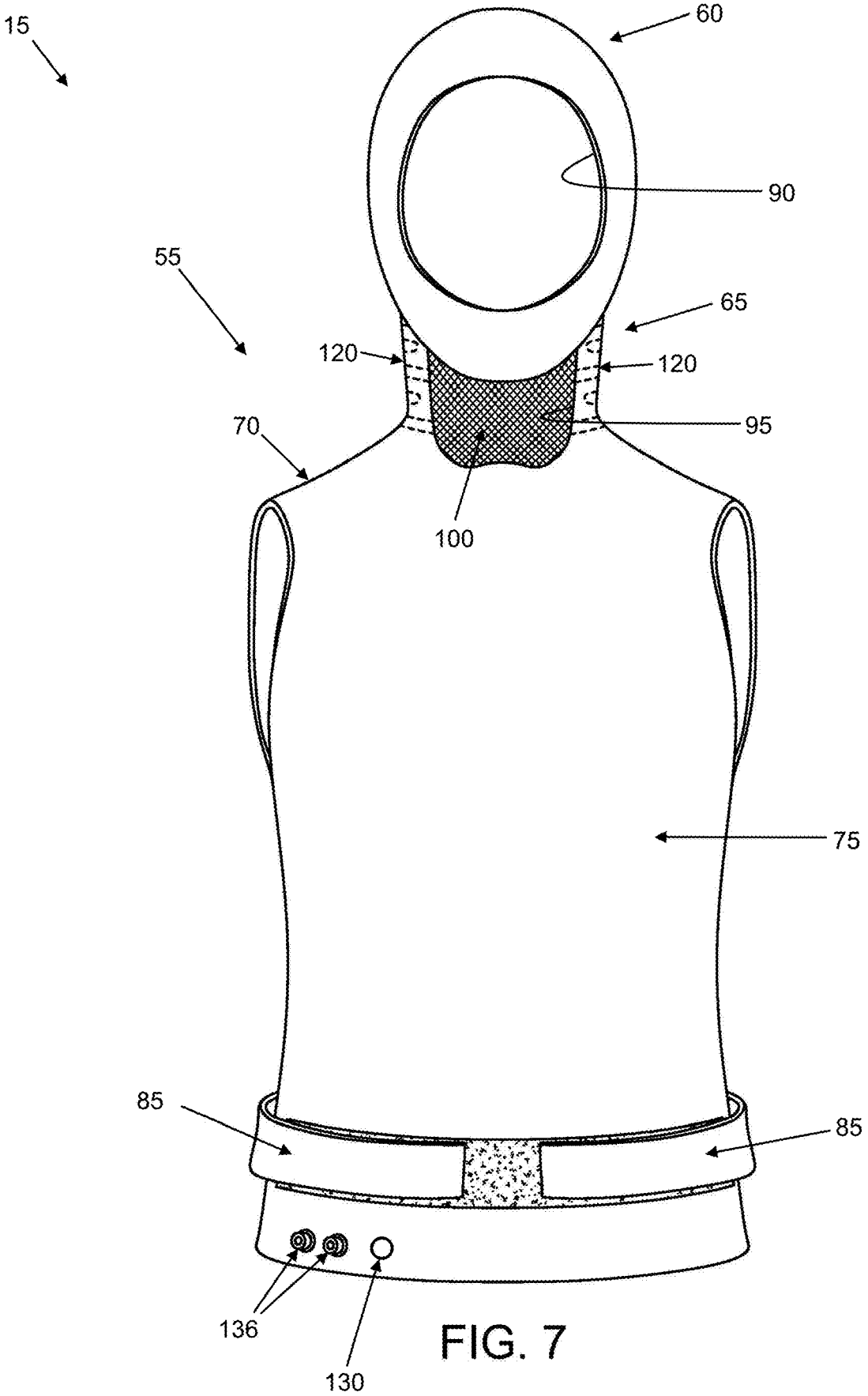
FIGS. 7-10 are schematic views showing a novel protective suit formed in accordance with the present invention.
Figure 8:
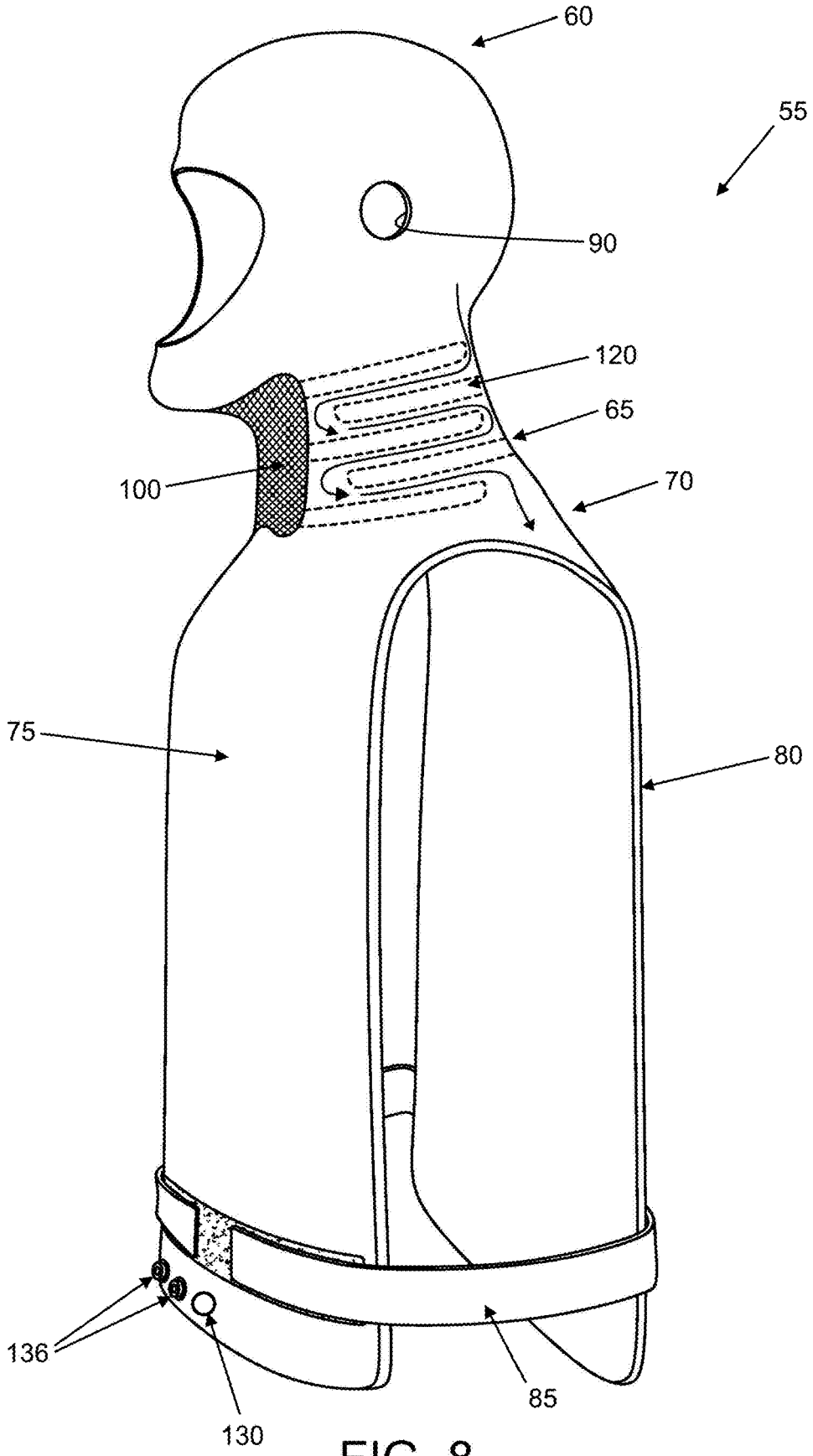
Figure 9:
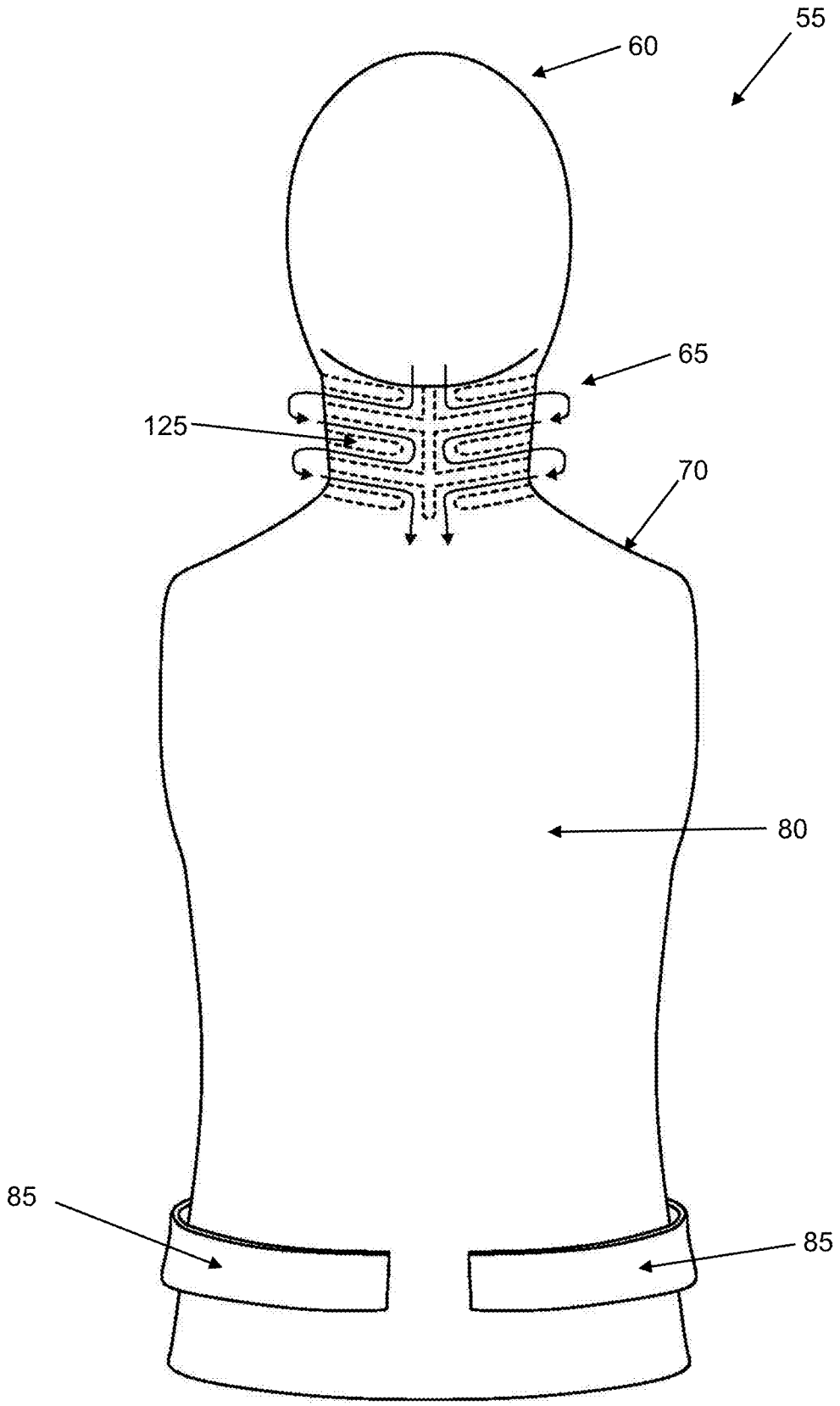

Looking first at FIG. 1, the present invention comprises the provision and use of a novel system 5 which provides fluid-based exoskeletal body armor with climate control. System 5 generally comprises (i) a novel helmet 10, and (ii) a novel protective suit 15. In addition, system 5 preferably comprises a temperature conditioning unit 20 which provides protective suit 15 with climate control so as to maintain physiologic body temperature and thereby maximize physical performance and prevent heat-related illnesses.

1. Novel Helmet 10

The present invention comprises a novel helmet 10 for minimizing head-on, helmet-to-helmet contact. Novel helmet 10 has decreased helmet weight (to reduce injury to others when the novel helmet 10 impacts another person, and to reduce fatigue of the user) and a decreased head-to-neck mass ratio (to reduce the "bobble-head" effect when the novel helmet 10 is impacted). In one preferred form of the invention, novel helmet 10 comprises a built-in, soft gel eye socket mask 25. Novel helmet 10 also includes at least one indicator light 30 to show when an impact force threshold has been exceeded (see below) and the user should be evaluated for concussion or other injury.

In one preferred form of the invention, and looking now at FIGS. 2-6, novel helmet 10 is preferably in the form of a motocross-style shell 32 with a crown-to-frontal wedge bossing 35 to eliminate head-on, helmet-to-helmet contact from the front or crown. Novel helmet 10 comprises the aforementioned built-in soft gel eye socket mask 25. The novel helmet 10 also includes a bossed face shield 40 and composite chin protection 45. A chin strap 50 is provided for keeping novel helmet 10 securely on the head of the user during physical activity. It should be appreciated that bossed face shield 40 and/or composite chin protection 45 are preferably configured so that the user can selectively pivot bossed face shield 40 and/or composite chin protection 45 upward relative to the remainder of novel helmet 10, whereby to selectively expose the user's face (see FIG. 6). To this end, a button 41 may be provided on helmet 10 which unlocks bossed face shield 40 and/or composite chin protection 45 when button 41 is depressed. It should be appreciated that when bossed face shield 40 and composite chin protection 45 are locked (i.e., button 41 has not been depressed), bossed face shield 40 and composite chin protection 45 do not pivot, even when an impact occurs to helmet 10 and/or bossed face shield 40 and/or composite chin protection 45. Being able to selectively pivot bossed face shield 40 and/or composite chin protection 45 upward relative to helmet 10 can be useful when the user is communicating with someone else (e.g., during a "huddle", etc.), or while the user is resting, or while the user is drinking, etc.

In one form of the present invention, novel helmet 10 has no padding on the inside of the helmet—the head portion of protective suit 15 (see below) provides protection for the head of the user, with soft gel eye socket mask 25 protecting the eyes of the user. Note that novel helmet 10 is streamlined so that substantially all blows to the helmet are "glancing blows".

2. Novel Protective Suit 15

Looking next at FIGS. 7-10, novel protective suit 15 is preferably in the form of a head/neck/chest/shoulder/back "suit" 55 with a built-in fluid system. More particularly, protective suit 15 comprises a head portion 60, a neck portion 65, a shoulder portion 70, a chest portion 75 and a back portion 80. Shoulder portion 70, chest portion 75 and back portion 80 are sometimes hereinafter referred to collectively as a "vest", with neck portion 65 and head portion 60 forming an integral extension of the vest (and thereby forming the complete protective suit 15). In one preferred form of the invention, the chest and back portions have a "short sleeve catcher protection shape" with Velcro closures 85 under the arms and on the sides of the torso.

Head portion 60 of protective suit 15 has cutouts 90 for the face and ears of the user. Neck portion 65 of protective suit 15 has a cutout 95 for the anterior neck of the user. The cutout 95 for neck portion 65 of protective suit 15 is preferably covered with an elastic mesh 100 to allow for easy pull-over of head portion 60 and neck portion 65 of protective suit 15 and also to enhance breathability for the user.

Head portion 60, neck portion 65, shoulder portion 70, chest portion 75 and back portion 80 together constitute protective suit 15. Head portion 60, neck portion 65, shoulder portion 70, chest portion 75 and back portion 80 together comprise a large single-cell bladder covering the head, neck, shoulders, chest and back of the user, and which is filled with a fluid (which may be pressurized) which acts as a large shock-absorber which absorbs the impact of a hard contact so as to provide protection to the user.

Figure 10:
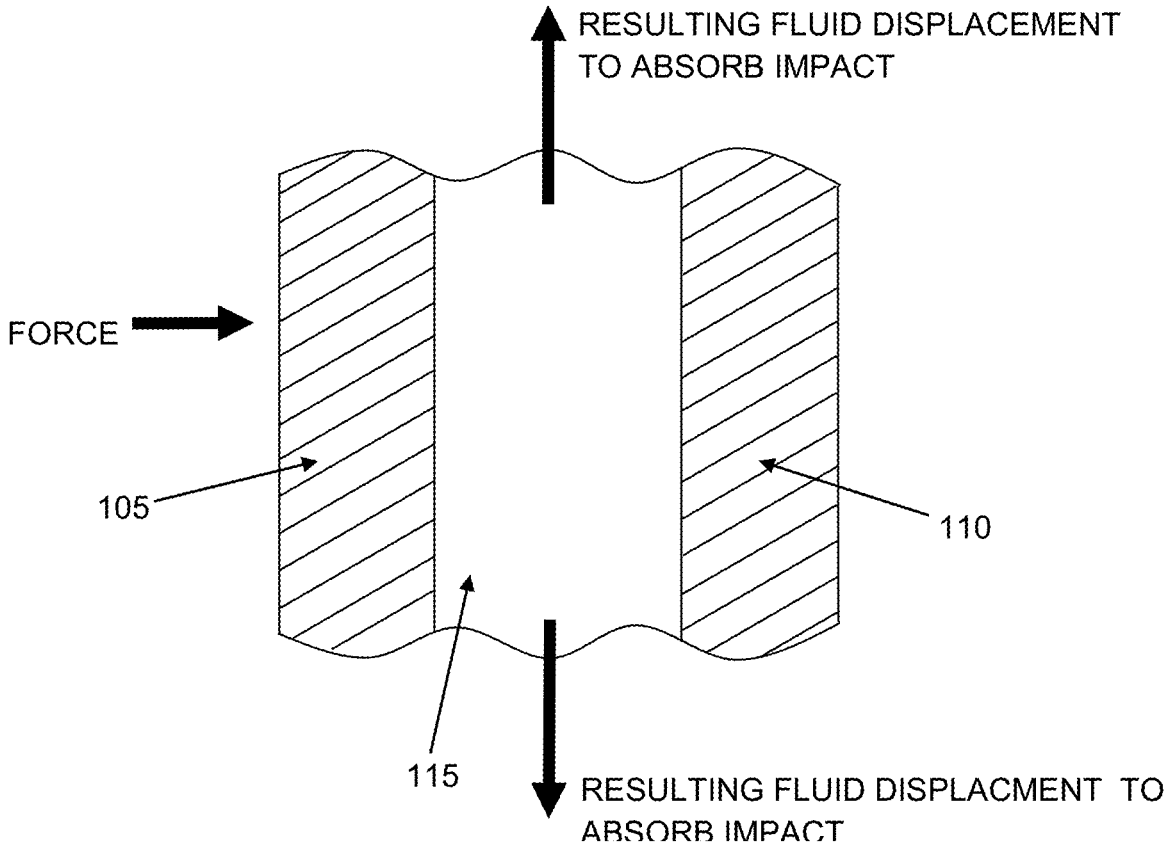

More particularly, in one form of the invention, and looking now at FIG. 10, protective suit 15 comprises an outer wall 105, an inner wall 110 and a fluid reservoir 115 disposed therebetween, with fluid reservoir 115 being filled with a fluid (e.g., a liquid, a combination of liquids, a gas, a combination of gases, a combination of liquids and gases, etc.). In one preferred form of the invention, fluid reservoir 115 is filled with water. Outer wall 105, inner wall 110, fluid reservoir 115 and the fluid therein cooperate with one another to essentially act as a shock-absorber to absorb the impact of a hard contact, whereby to provide protection to the user from a force imposed on outer wall 105 of protective suit 15.

It should be appreciated that outer wall 105 and inner wall 110 are formed out of a material or materials capable of withstanding the force of an impact without tearing and/or rupturing.

By way of example but not limitation, where the user receives an impact to their helmet 10, the fluid in head portion 60 of protective suit 15 is forced downwardly, into neck portion 65, shoulder portion 70, chest portion 75, and back portion 80. As the fluid in head portion 60 is forced downwardly, the force of the impact is absorbed by the transferring fluid and the head of the user is thereby protected. Note that the neck of the user and the torso of the user are also protected as fluid is forced into shoulder portion 70, chest portion 75 and back portion 80, thereby providing support for the anatomy of the user.

By way of further example but not limitation, where the user receives an impact to their torso, the fluid in chest portion 75 and/or back portion 80 is forced upwardly, into shoulder portion 70, neck portion 65 and head portion 60. As the fluid in chest portion 75 and/or back portion 80 is forced upwardly, the force of the impact is absorbed by the transferring fluid and the torso of the user is thereby protected. Note that the head of the user and the neck of the user are also protected as fluid is forced into neck portion 65 and head portion 60, thereby providing support for the anatomy of the user.

As noted above, the front of the neck of protective suit 15 preferably comprises elastic mesh 100 and does not include the aforementioned fluid bladder, so that the neck of protective suit 15 bends easily and so that the front of the neck of protective suit 15 does not tighten when fluid is driven into the neck portion of protective suit 15 (which could restrict the breathing of a user).

In one preferred form of the invention, the sides and rear of neck portion 65 comprise horizontal maze passageways (or channels) 120 and posterior vertical maze passageways (or channels) 125 which communicate with one another, and with the fluid reservoir of head portion 60 and shoulder portion 70, whereby to enable fluid flow between head portion 60 and shoulder portion 70. Horizontal maze passageways 120 and posterior vertical maze passageways 125 have a reduced cross-sectional area which absorbs energy as fluid from head portion 60 or shoulder portion 70 is forced through the reduced cross-sectional areas in neck portion 65. Furthermore, the reduced cross-sectional areas of horizontal maze passageways 120 and posterior vertical maze passageways 125 become stiffer when fluid from head portion 60 or shoulder portion 70 is forced into the reduced cross-sectional areas in neck portion 65. This increased stiffness of horizontal maze passageways 120 and posterior vertical maze passageways 125, combined with the orientation of the passageways, supports the user's neck against translational and rotational forces imparted to the user while still allowing the user's neck to bend. In one preferred form of the invention, horizontal maze passageways 120 and posterior vertical maze passageways 125 are formed by sealing together outer wall 105 and inner wall 110 at selected locations (e.g., by stitching, glueing, melting, etc.), whereby to form the fluid-directing passageways 120 and 125.

Protective suit 15 preferably includes at least one valve 130, with the at least one valve 130 being set so that if the pressure imposed on the valve exceeds a threshold, the valve "pops", indicating that the user needs to be examined for concussion or other injury. More particularly, when outer wall 105 of protective suit 15 receives a force which is greater than a selected magnitude (e.g., from an impact of excessive force), the fluid contained within fluid reservoir 115 exerts a force against the at least one valve 130 which "pops" the valve, thereby indicating that the user needs to be examined for concussion or other injury.

If desired, valve 130 may be set to "pop" at a "standard" trigger point (i.e., the same trigger point for all users), or valve 130 may be configured so it will "pop" at a personalized trigger point for an individual user (e.g., based on the user's height, weight, concussive history, etc.). The ability to set personalized trigger points for individual users can be highly beneficial for a user who has had multiple previous concussive injuries to the head and therefore might want or need valve 130 to "pop" at a lower selected magnitude of force upon an impact to the head. In one preferred form of the invention, when the at least one one-way valve "pops", indicator light 30 on helmet 10 is lit, thereby alerting surrounding individuals that the user needs to be examined for concussion or other injury.

3. Novel Temperature Conditioning Unit 20

Temperature conditioning unit 20 helps regulate the user's body temperature.

In addition, temperature conditioning unit 20 can be used to intentionally cool the user's body, and particularly the user's head, when the user has received an impact of significant force (e.g., a force large enough to "pop" the at least one valve 130 and light up indicator light 30) and serious injury may have occurred (e.g., a concussion may have been received).

More particularly, temperature conditioning unit 20 is connected to the fluid bladder of protective suit 15, e.g., by tubing 135 which attaches to at least fluid connector 136, such that fluid from the fluid bladder can be passed through temperature conditioning unit 20 where the fluid is temperature-regulated. Temperature conditioning unit 20 comprises a motorized fluid pump, and cooling and/or heating apparatus to cool and/or heat the fluid within the fluid bladder of protective suit 15. Temperature conditioning unit 20 also comprises flow and temperature controls. Thus, temperature conditioning unit 20 essentially comprises an external fluid management system which regulates the temperature of the fluid in the bladder of protective suit 15 to the appropriate temperature so as to help temperature-regulate the user's body temperature and/or to provide body cooling in the event that there is fear that a serious injury may have occurred.

By way of example but not limitation, temperature conditioning unit 20 may be configured so as to adjust the temperature of protective suit 15 in an effort to maintain the user at a desired "set" temperature so as to prevent heat illness or cold illness and/or to maximize the athletic performance of a user.

By way of further example but not limitation, temperature conditioning unit 20 can be configured to rapidly chill the user where there is a fear that the user may have undergone a serious injury. Such rapid cooling may help mitigate an injury (e.g., such as is the case of a concussion).

Temperature conditioning unit 20 may also be used to set the initial pressure of the fluid within the fluid bladder. More particularly, in one form of the invention, temperature conditioning unit 20 may be connected to the fluid bladder and fluid either flowed into the fluid bladder (i.e., to increase the pressure in the fluid bladder) or pulled out of the fluid bladder (i.e., to decrease the pressure in the fluid bladder).

And in one preferred form of the invention, temperature conditioning unit 20 is configured to adjust the fluid pressure in the fluid bladder to a particular pressure in order to personalize the protection of a user based on a user's height, weight, concussive history or other parameters.

For applications where the user must walk or run about (e.g., most sports applications, military field deployments, etc.), it is anticipated that one temperature conditioning unit 20 would be provided for every 10-20 protective suits 15, since temperature conditioning unit 20 is generally only used when the user is stationary (e.g., where a player has left the playing field, where a soldier has come in from the field, etc.). However, for other applications where the user does not need to walk about (e.g., motor sports where the user is seated, military applications where the soldier is riding in a vehicle, etc.), one temperature conditioning unit 20 could be provided for each protective suit 15.

It is anticipated that in one preferred form of the invention, temperature conditioning unit 20 will most often be used to lower a user's body temperature (i.e., to cool the user).

4. Solid-State Fluid Conditioning

Figure 11:
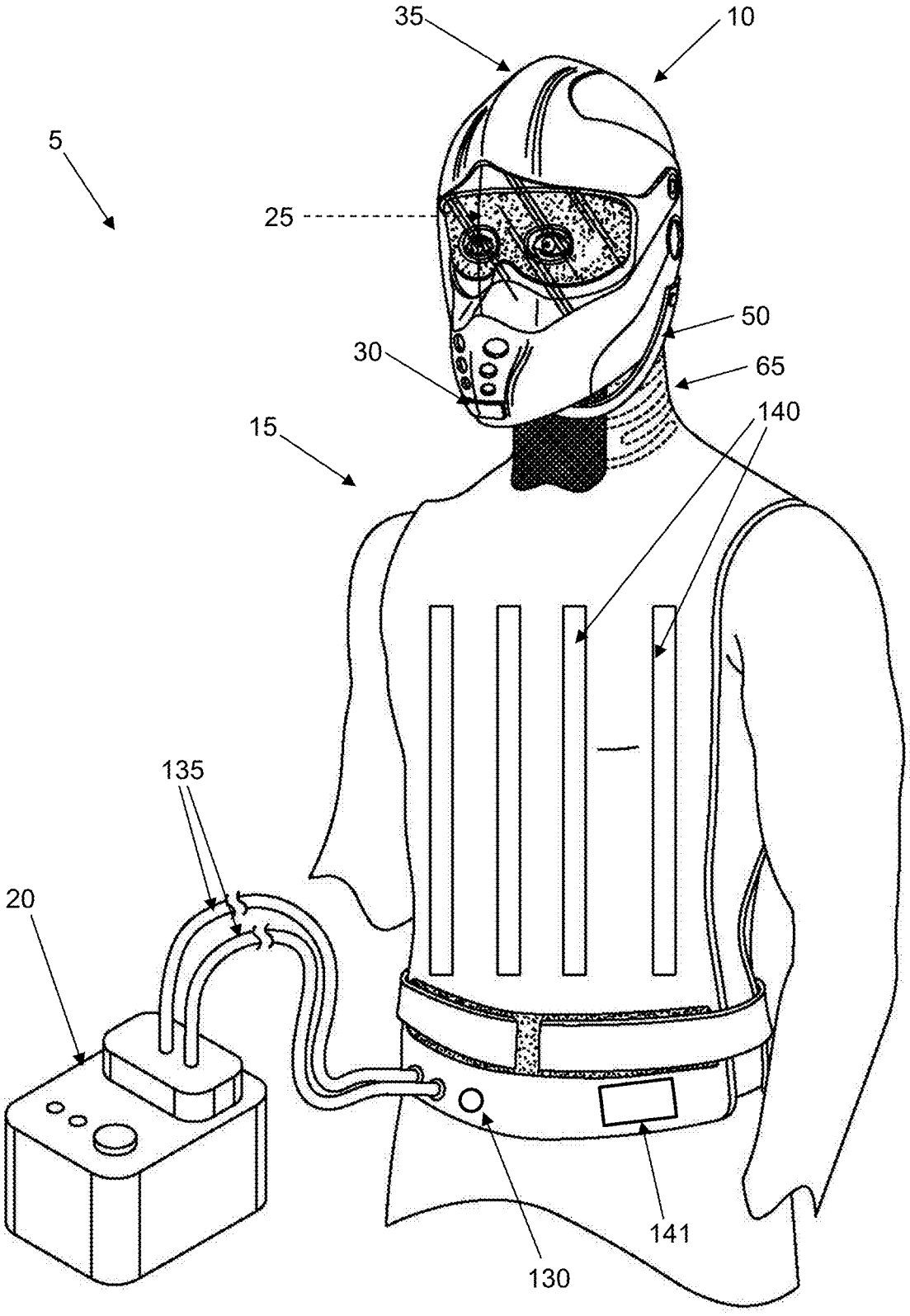
FIGS. 11 and 12 are schematic views showing another novel protective suit formed in accordance with the present invention.
Figure 12:
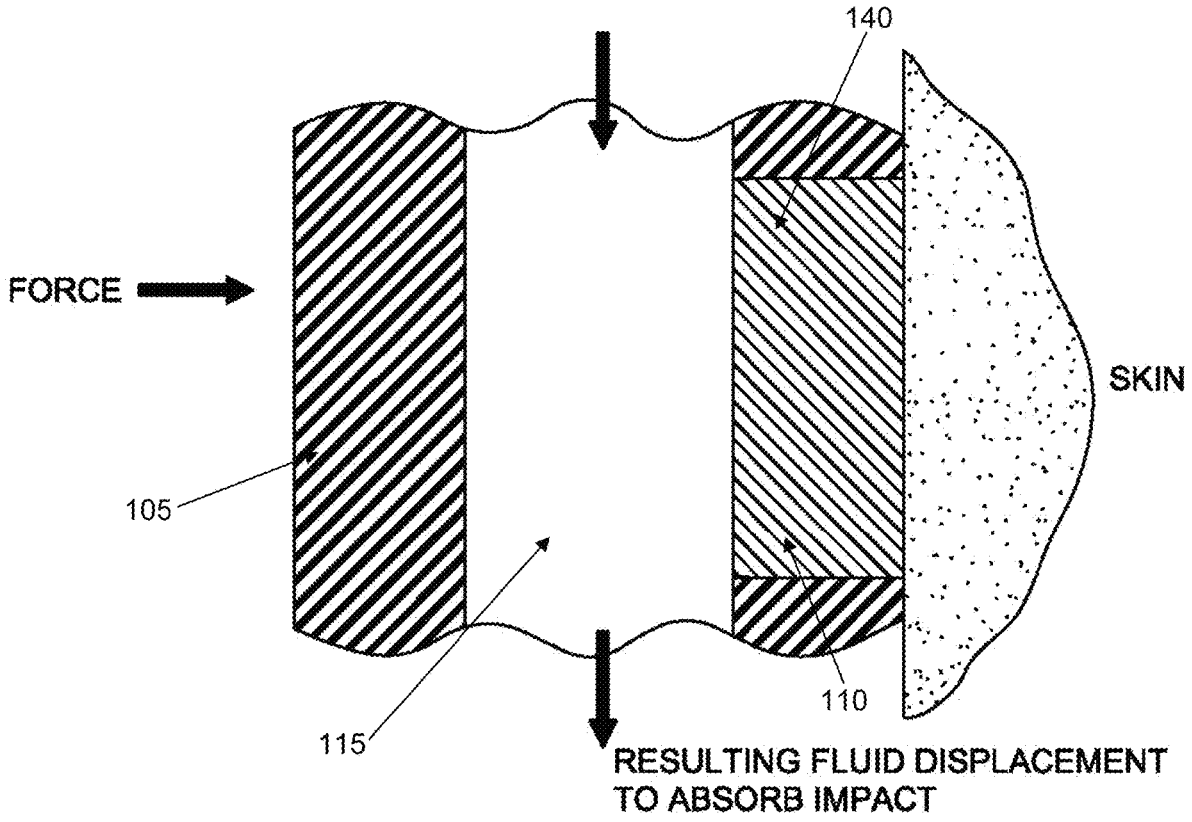

In another preferred form of the invention, and looking next at FIGS. 11 and 12, one or more thermoelectric heat pumps 140, and a power supply (e.g., a battery pack) 141, are incorporated in protective suit 15. More particularly, thermoelectric heat pumps are solid-state active heat pumps which transfer heat from one side of the heat pump to the other side of the heat pump, consuming electrical energy. The direction of heat flow depends on the direction of the electric current. In the present invention, one or more thermoelectric heat pumps 140 are incorporated into protective suit 15 by positioning the heat pumps within fluid reservoir 115, or within or against outer wall 105 and/or inner wall 110.

In one preferred form of the present invention, thermoelectric heat pumps 140 are positioned within inner wall 110, with one side of the thermoelectric heat pump 140 in contact with the skin of the user and the opposite side of the thermoelectric heat pump in contact with the fluid in fluid reservoir 115. In one form of the invention, the thermoelectric heat pumps transfer heat from the skin of the user to the fluid in the fluid reservoir, whereby to lower the body temperature of the user. The heated fluid is then passed through temperature conditioning unit 20 where the fluid is temperature-regulated, e.g., cooled. Of course, if it should be desired to provide heat to the user, the direction of the electrical current supplied to thermoelectric heat pumps 140 is reversed, so that heat is directed into the skin of the user by thermoelectric heat pumps 140. In this case, temperature conditioning unit 20 may be used to supply heat to the fluid in the fluid reservoir.

Preferably thermoelectric heat pumps 140 are incorporated in each of head portion 60, neck portion 65, shoulder portion 70, chest portion 75 and back portion 80, although they may be omitted from one or more of these portions if desired.

In one form of the invention, temperature controls (not shown) for thermoelectric heat pumps 140 may be provided on protective suit 15 or on power supply 141, with appropriate wiring (not shown) extending between the temperature controls (not shown) and thermoelectric heat pumps 140.

In another form of the invention, temperature controls (not shown) for thermoelectric heat pumps 140 may be provided on temperature conditioning unit 20, with appropriate wiring (not shown) extending between the temperature controls (not shown) and thermoelectric heat pumps 140.

Second Construction

Figure 13:
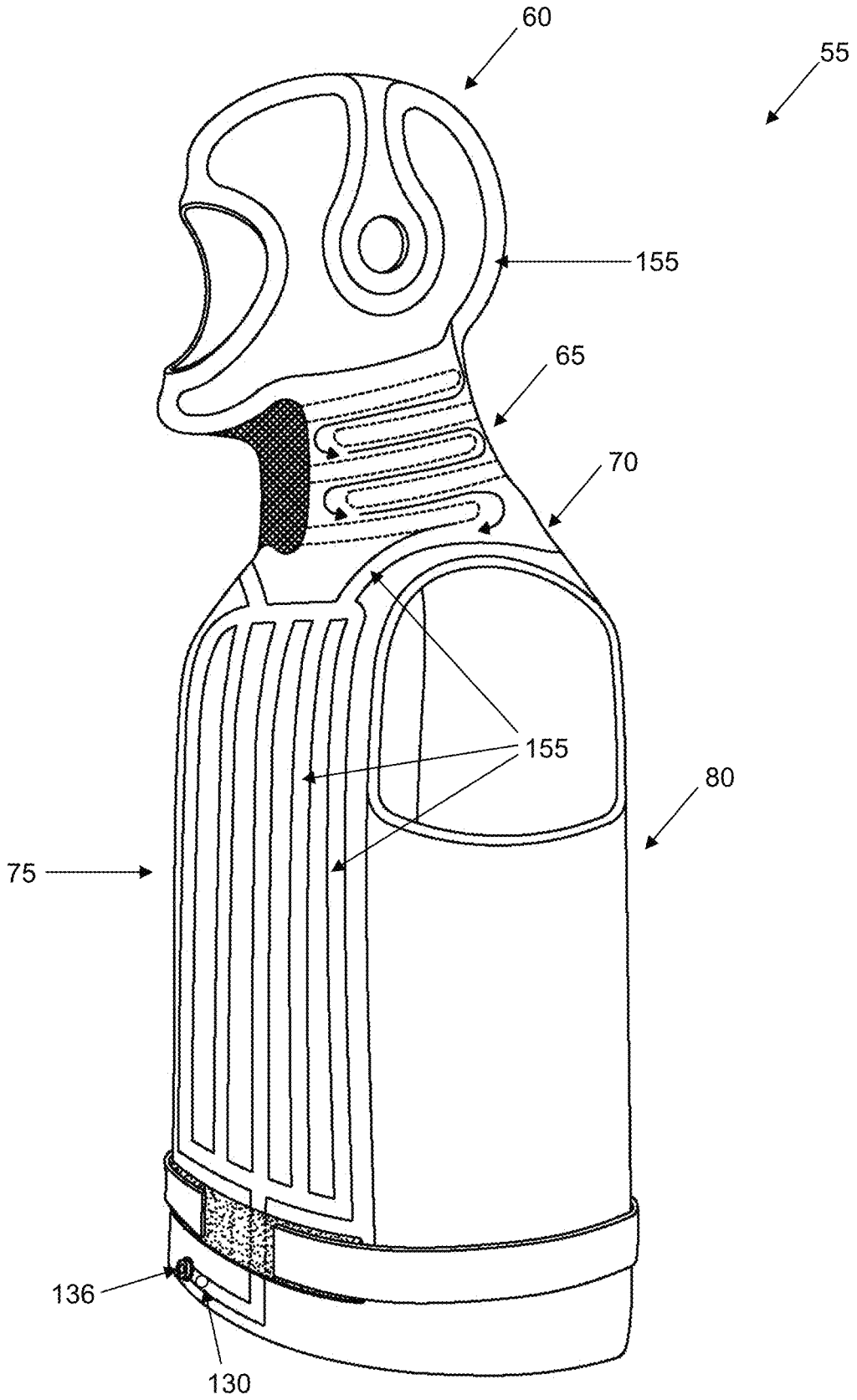
FIGS. 13 and 14 are schematic views showing another novel protective suit formed in accordance with the present invention.
Figure 14:
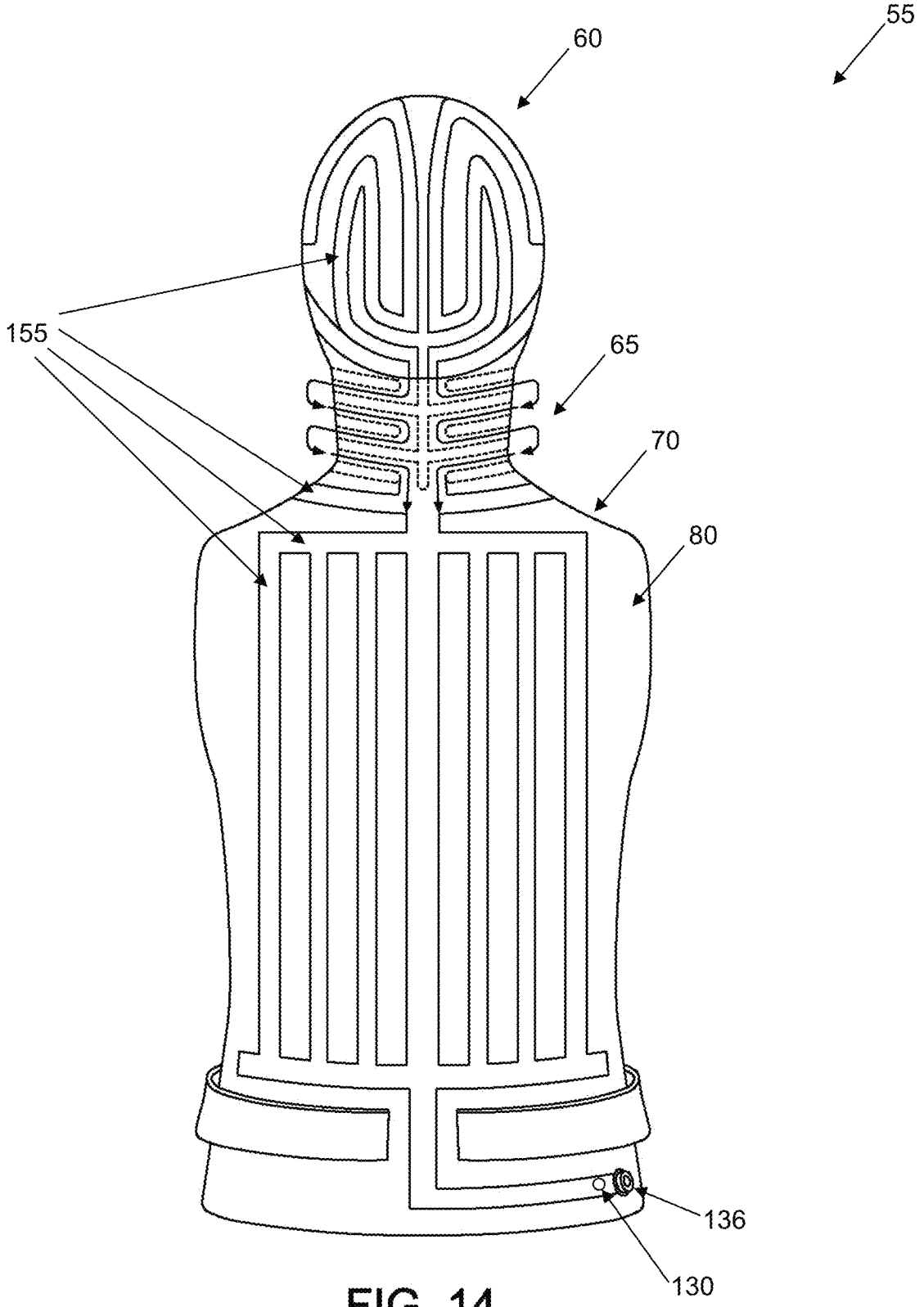
Figure 15:
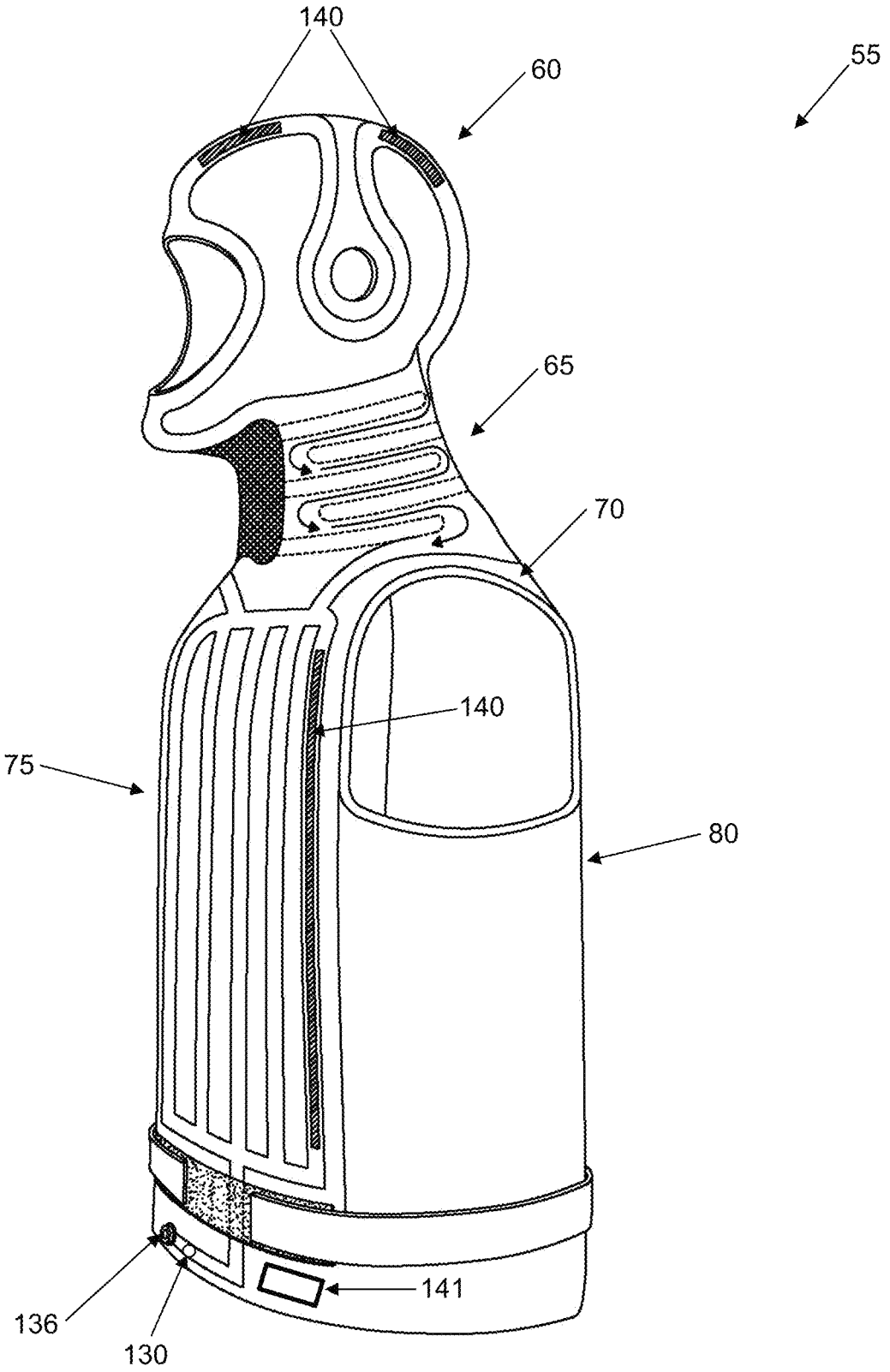
FIGS. 15 and 16 are schematic views showing another novel protective suit formed in accordance with the present invention.
Figure 16:
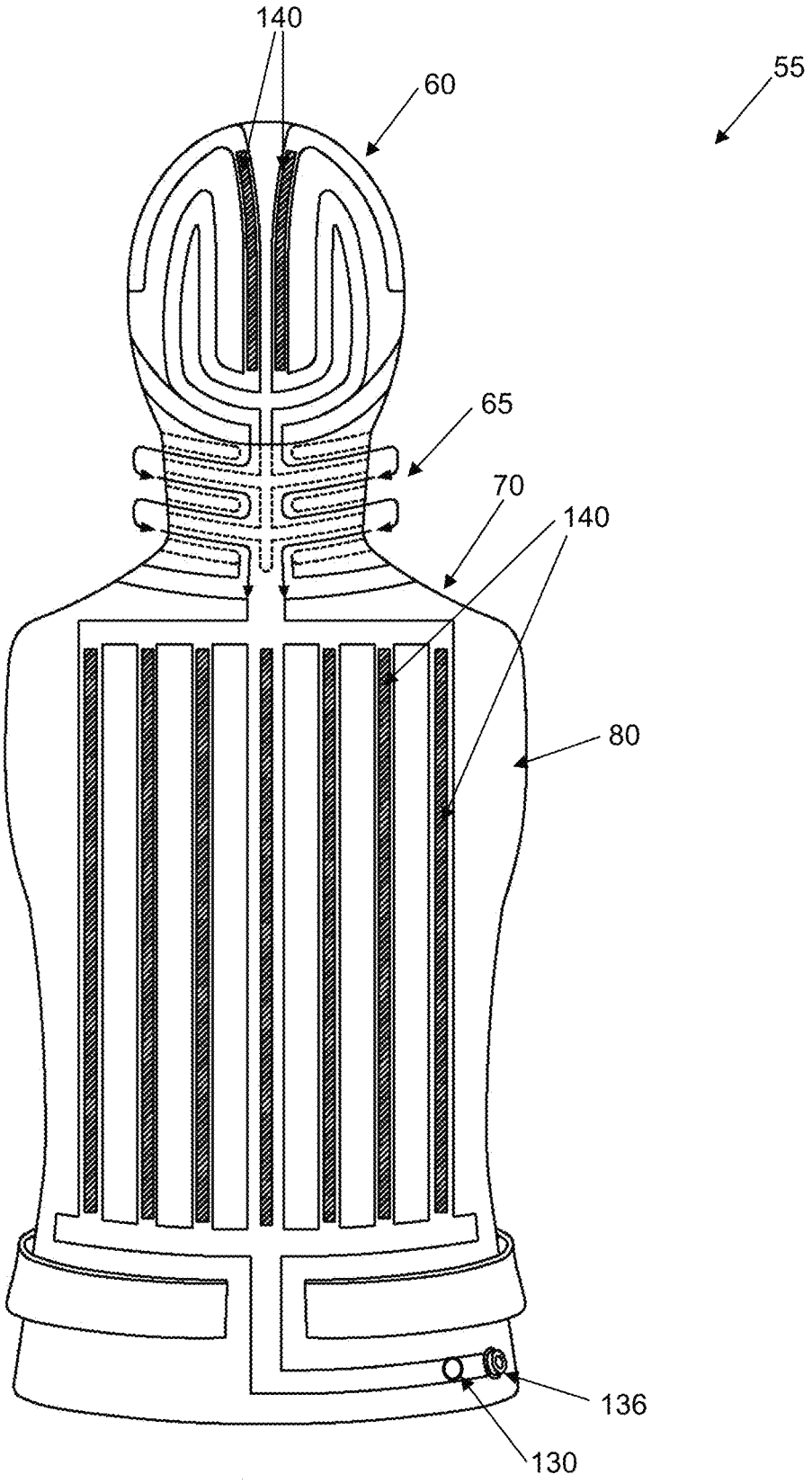

In another form of the invention, and looking now at FIGS. 13 and 14, the fluid reservoir in head portion 60, shoulder portion 70, chest portion 75 and back portion 80 is subdivided into passageways (or channels) 155 which communicate with one another, and with horizontal maze passageways 120 and posterior vertical maze passageways 125 of neck portion 65. In other words, the fluid reservoir in head portion 60, shoulder portion 70, chest portion 75 and back portion 80 is subdivided into passageways (or channels) in a manner similar to the way in which the fluid reservoir in neck portion 65 is subdivided into horizontal maze passageways 120 and posterior vertical maze passageways 125. The aforementioned at least one fluid connector 136 is connected to passageways 155, e.g., in chest portion 75. It should be appreciated that in this form of the invention, passageways 155 effectively form one continuous "tube" of fluid running through protective suit 15.

Passageways 155 have a reduced cross-sectional area which absorbs energy as fluid from an impacted portion of protective suit 15 is forced into another portion of the protective suit. Furthermore, the reduced cross-sectional areas of passageways 155 become stiffer when fluid from an impacted portion of the protective suit 15 is forced into another portion of the protective suit. This increased stiffness of passageways 155, combined with the orientation of the passageways, supports the user's body against translational and rotational forces imparted to the user while still allowing the user's body to bend. It will be appreciated that passageways 155 may have a particular configuration in each of head portion 60, shoulder portion 70, chest portion 75 and back portion 80 so as to provide maximum protection and support for the particular anatomy adjacent to a given portion of protective suit 15.

In one preferred form of the invention, passageways 155 are formed by sealing together outer wall 105 and inner wall 110 at selected locations (e.g., by stitching, glueing, melting, etc.), whereby to form the fluid-directing passageways 155.

In one preferred form of the invention, elastic mesh (similar to elastic mesh 100 of neck portion 65) may be provided in the space between the passageways 155 formed in head portion 60, shoulder portion 70, chest portion 75 and back portion 80, whereby to lighten those portions and whereby to increase the "breathability" of those portions.

Third Construction

In the foregoing constructions, the fluid reservoir of protective suit 15 comprises a single reservoir, in the sense that the fluid in any one of head portion 60, neck portion 65, shoulder portion 70, chest portion 75 and back portion 80 communicates with the fluid in any other one of head portion 60, neck portion 65, shoulder portion 70, chest portion 75 and back portion 80.

However, if desired, the fluid reservoir of protective suit 15 may comprise a plurality of reservoirs, with each reservoir being formed in one or more of head portion 60, neck portion 65, shoulder portion 70, chest portion 75 and back portion 80. Such a construction may be desirable for a number of reasons, e.g., to facilitate temperature conditioning of a selected portion of the protective suit 15 (e.g., head portion 60 and neck portion 65), to better accommodate multiple simultaneous impacts on different portions of the protective suit (e.g., simultaneous impacts to head portion 60 and shoulder portion 70), etc.

Figure 17:
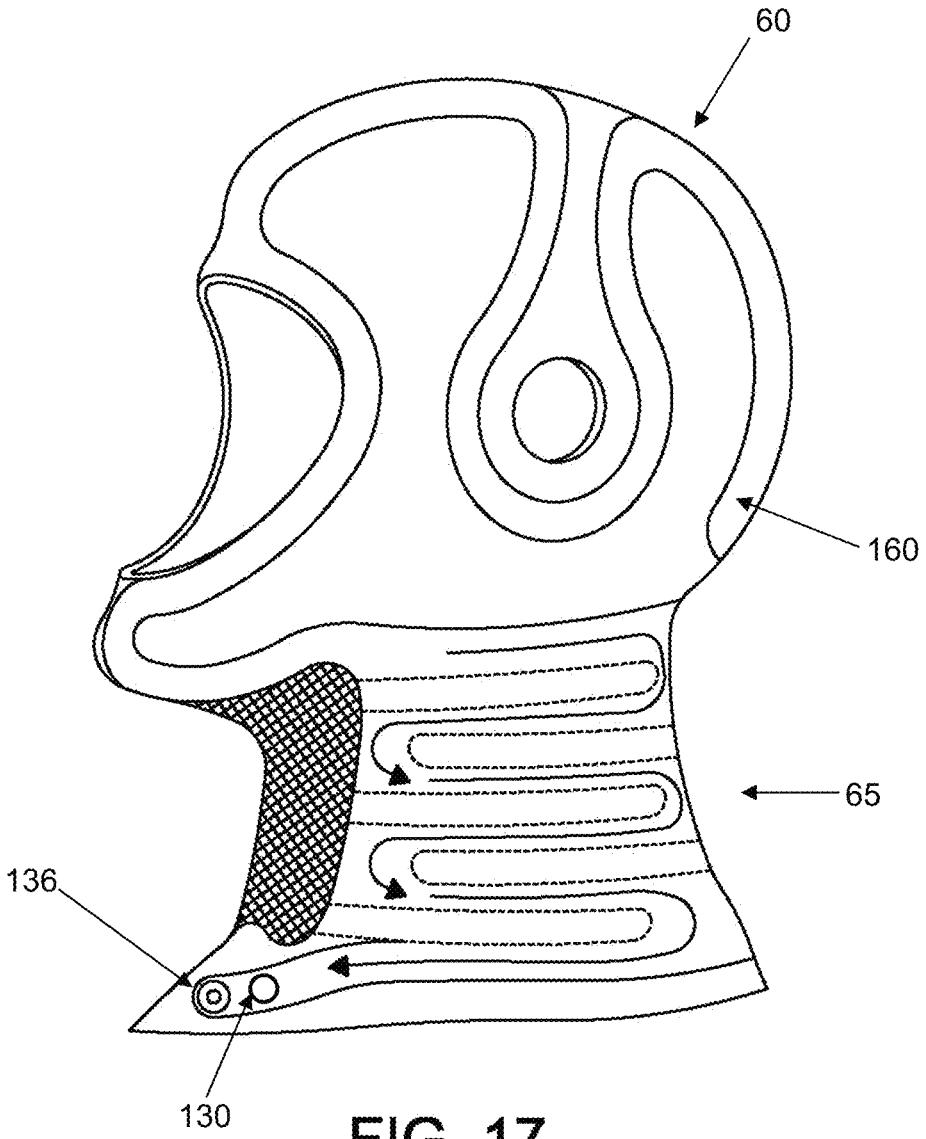
FIGS. 17-23 are schematic views showing another novel protective suit formed in accordance with the present invention.
Figure 18:
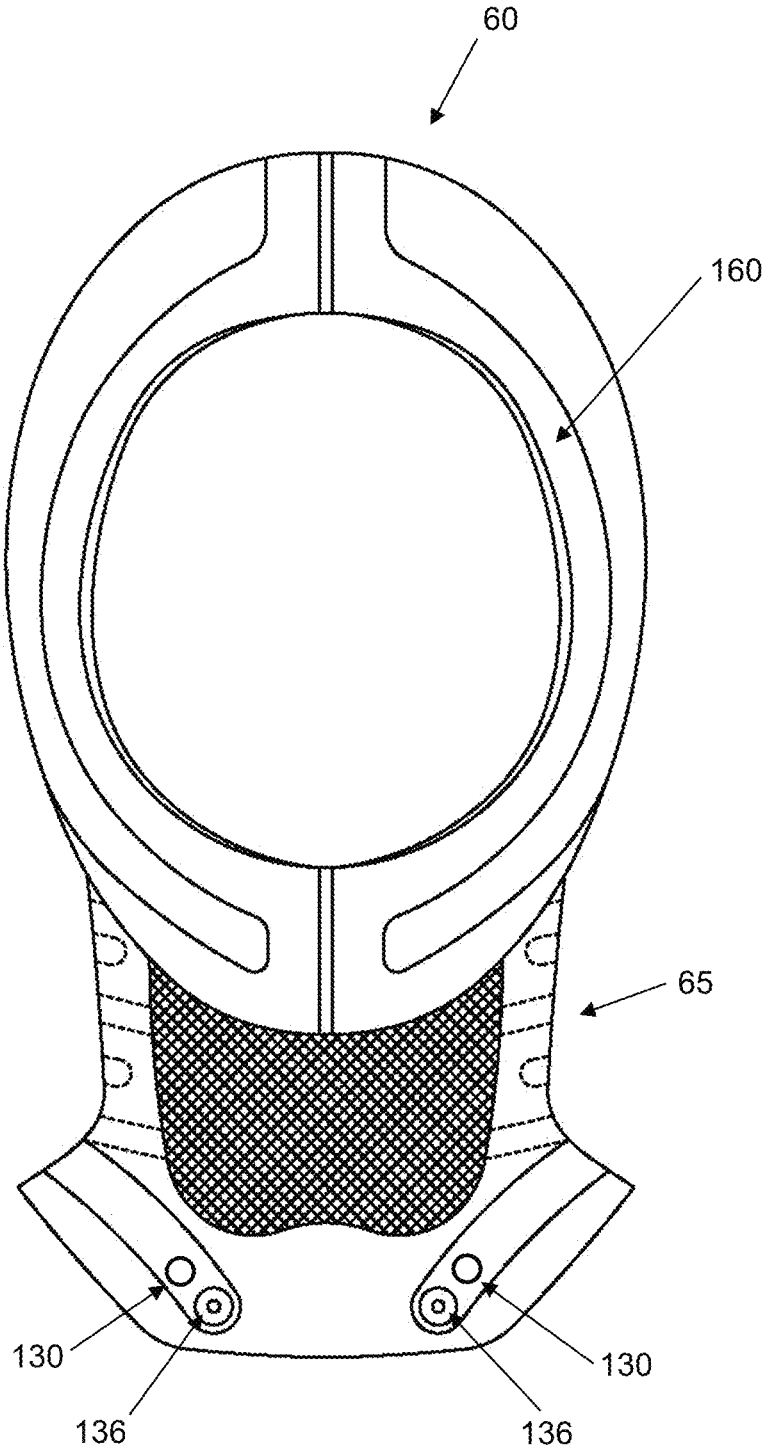
Figure 19:
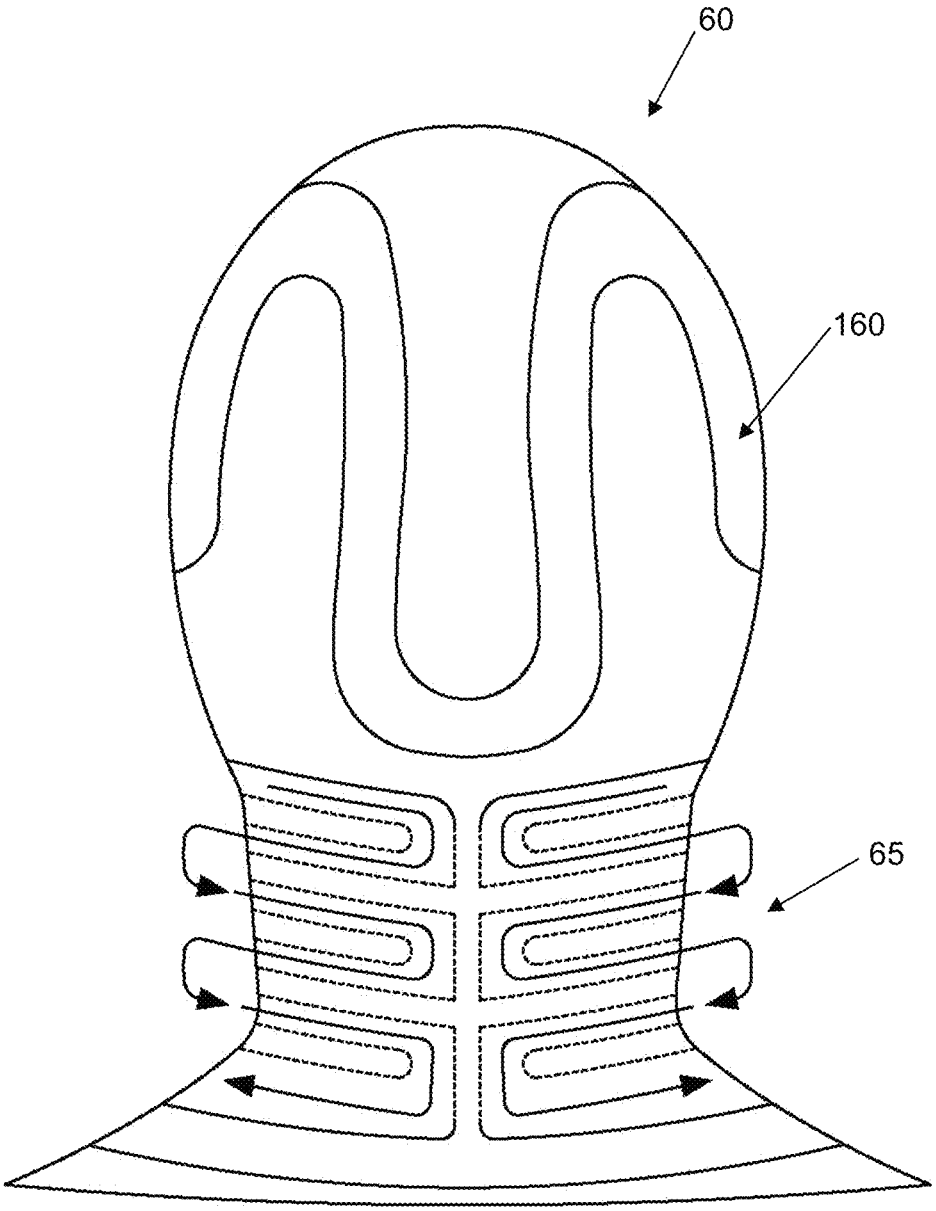
Figure 20:
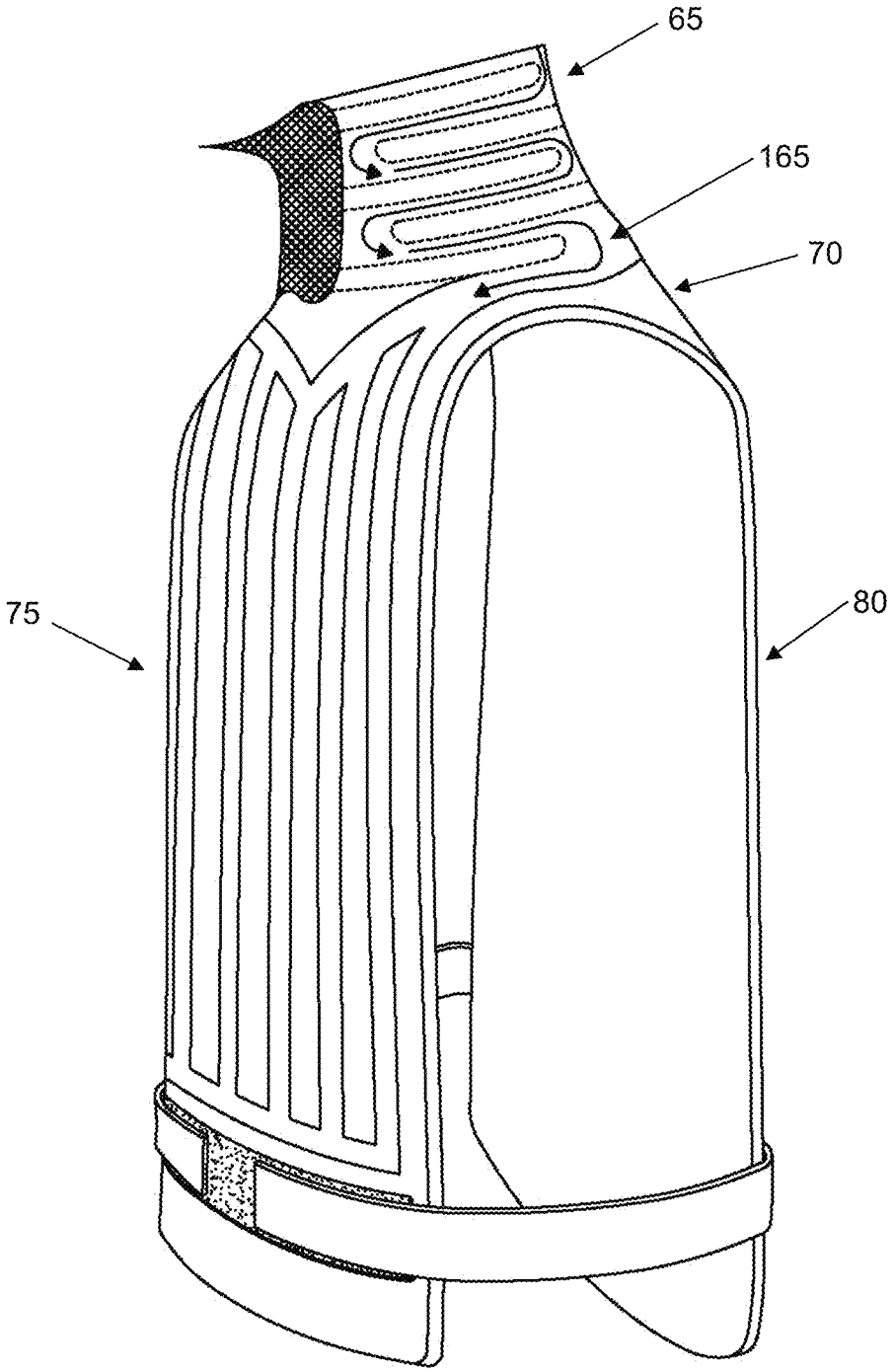
Figure 21:
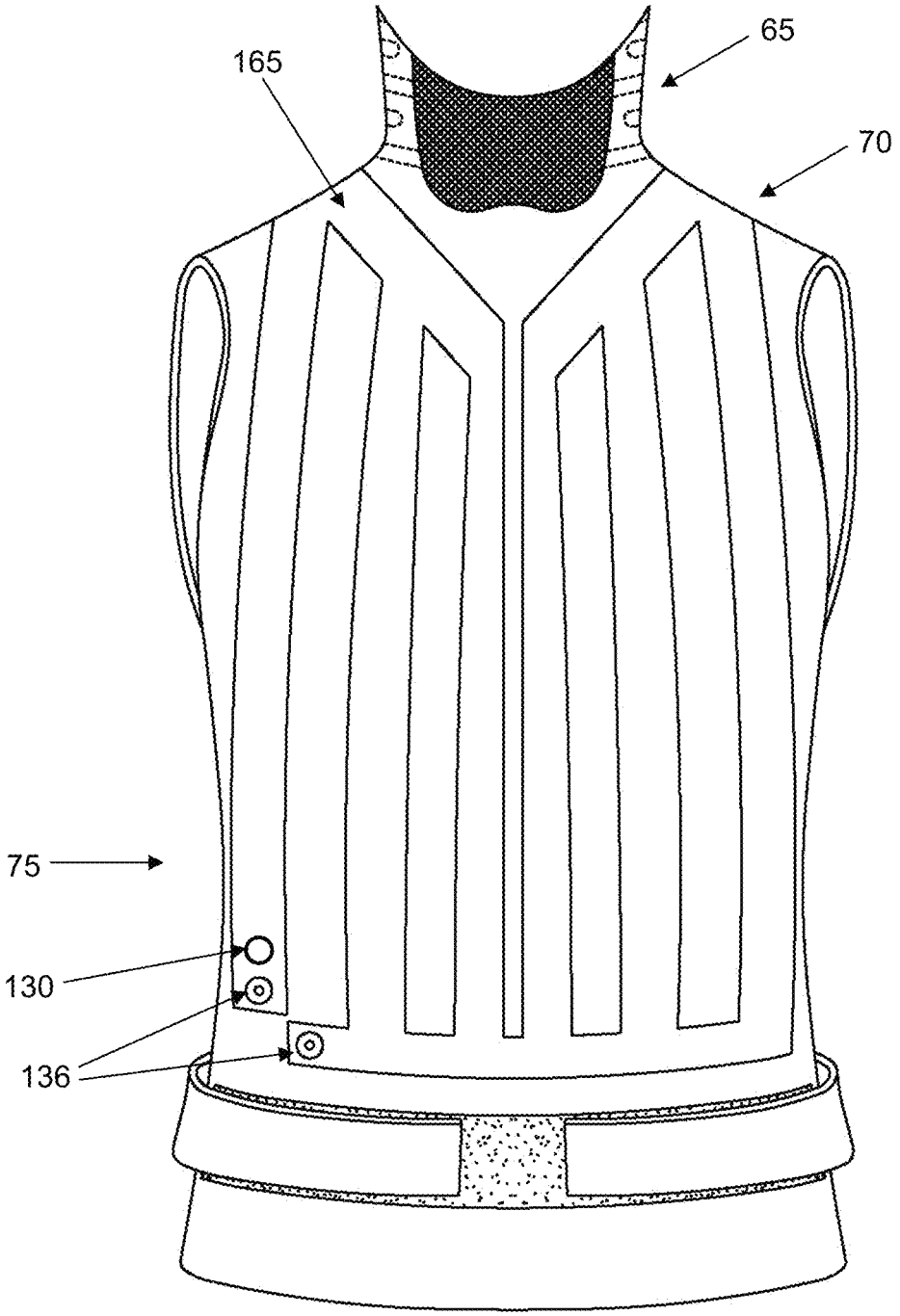
Figure 22:
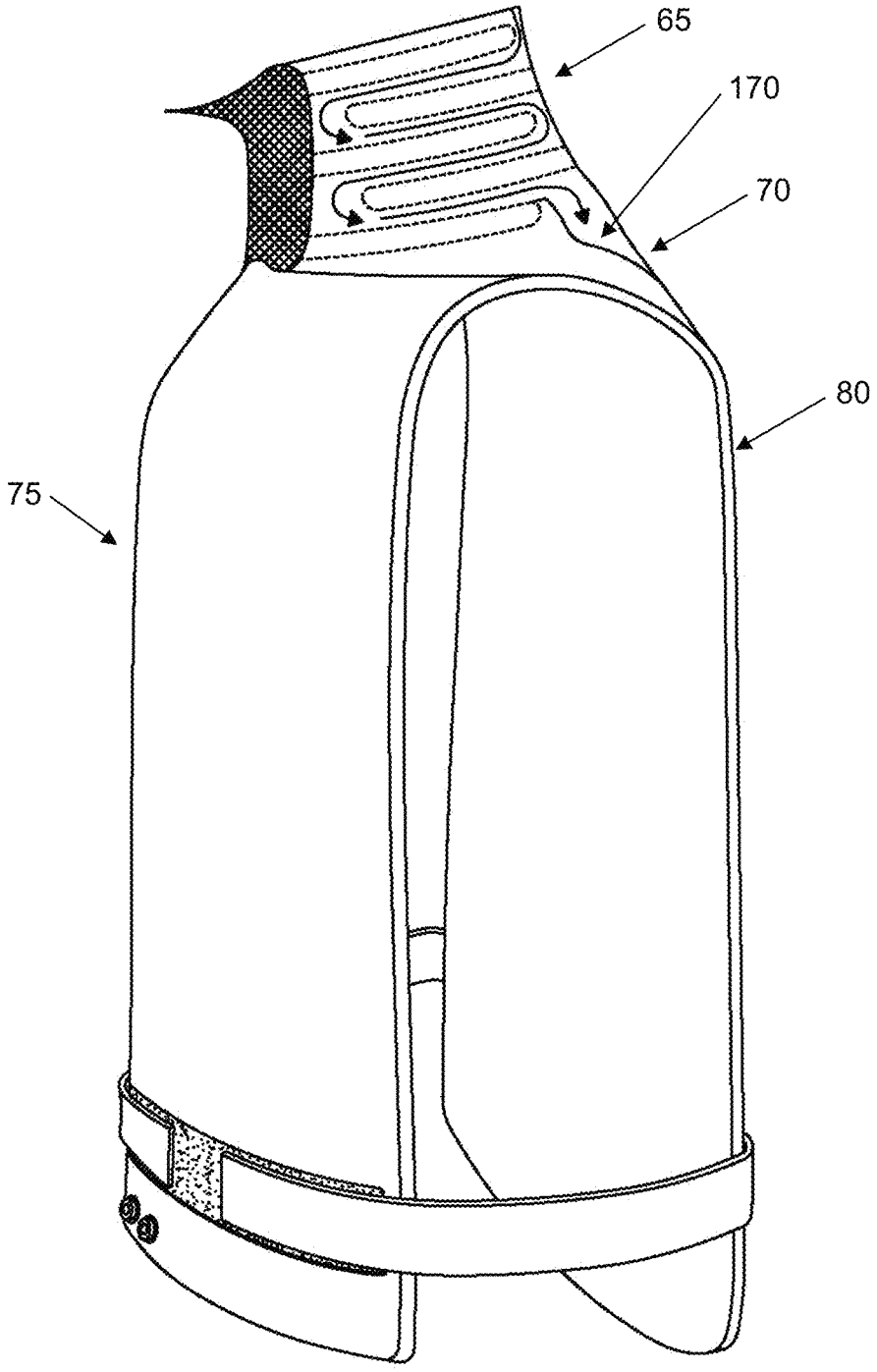
Figure 23:
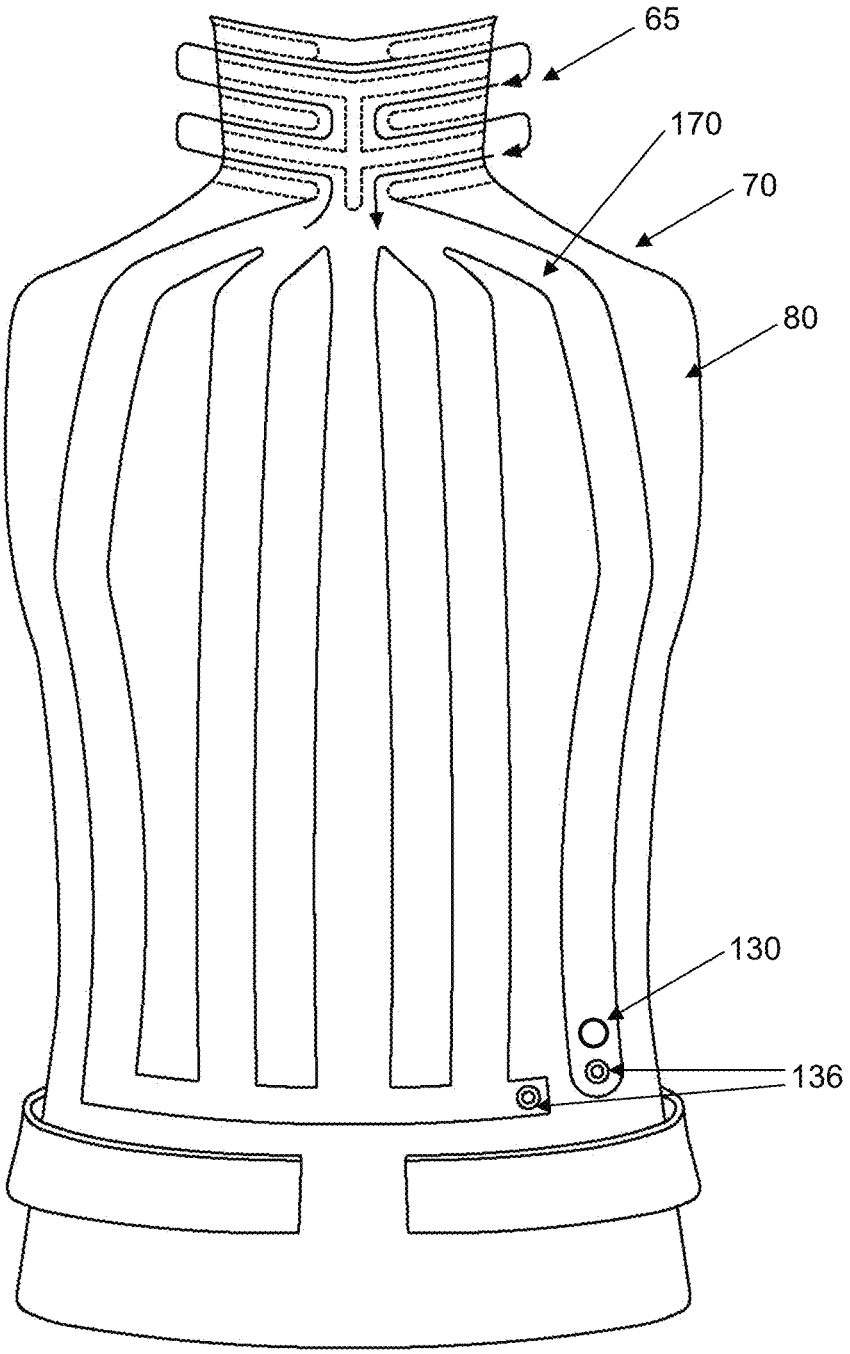

By way of example but not limitation, in one preferred form of the invention, the fluid reservoir of protective suit 15 may comprise three separate reservoirs, i.e., a first fluid reservoir 160 for head portion 60 and neck portion 65 (see FIGS. 17-19), a second fluid reservoir 165 for neck portion 65, shoulder portion 70 and chest portion 75 (see FIGS. 20 and 21), and a third fluid reservoir 170 for neck portion 65, shoulder portion 70 and back portion 80 (see FIGS. 22 and 23). It will be appreciated that each separate reservoir comprises at least one fluid connector 136 so as to enable fluid to be sent to temperature conditioning unit 20. It will also be appreciated that each reservoir preferably comprises its own valve 130 for indicating when an impact of a given magnitude has occurred with respect to that reservoir.

Where a given portion of protective suit 15 contains the fluid passageways for more than one fluid reservoir (e.g., where neck portion 65 contains fluid passageways for first fluid reservoir 160, second fluid reservoir 165 and third fluid reservoir 170), the fluid passageways for the multiple fluid reservoirs may be placed alongside one another, laterally displaced from one another.

Figure 24:
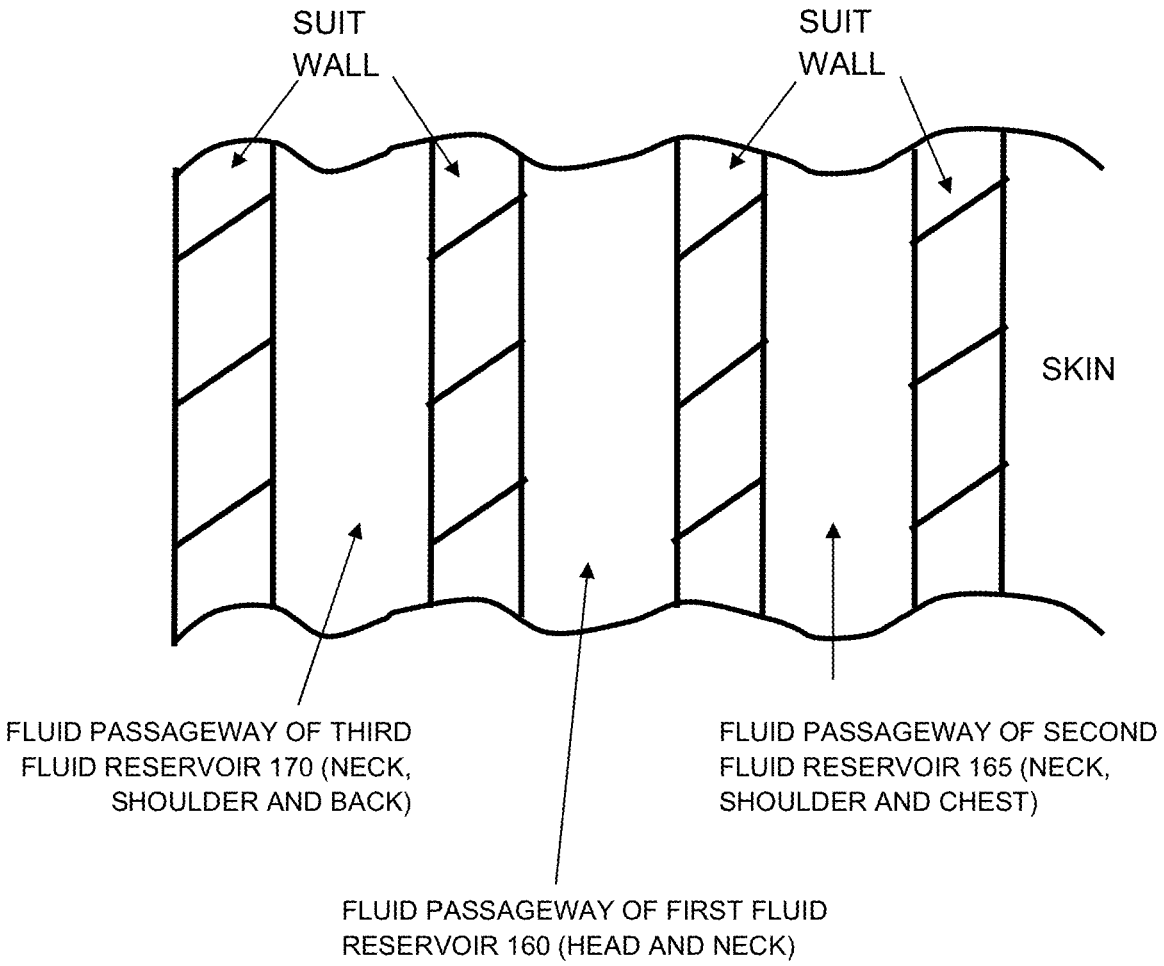
FIG. 24 is a schematic view showing aspects of another novel protective suit formed in accordance with the present invention.

Alternatively, where a given portion of protective suit 15 contains the fluid passageways for more than one fluid reservoir (e.g., where neck portion 65 contains fluid passageways for first fluid reservoir 160, second fluid reservoir 165 and third fluid reservoir 170), the fluid passageways for the multiple fluid passageways may be placed over one another, vertically displaced from one another. By way of example but not limitation, FIG. 24 shows one exemplary construction where neck portion 65 of protective suit 15 contains fluid passageways for first fluid reservoir 160, second fluid reservoir 165 and third fluid reservoir 170. More particularly, in this exemplary construction, the fluid passageways of first fluid reservoir 160 (head and neck) overlay the fluid passageways of second fluid reservoir 165 (neck, shoulder and chest) and the fluid passageways of third fluid reservoir 170 (neck, shoulder and back) overlay the fluid passageways of first fluid reservoir 160 (head and neck).

It should be appreciated that in any construction where fluid passageways are used, the configurations (e.g., diameters) of the fluid passageways, and/or the elasticity of the walls of the passageways, can be varied so as to preferentially direct fluid flow. In one preferred form of the invention, the fluid passageways are configured so as to preferentially direct fluid flow towards the neck of the user.

Different Grades of Novel System 5

In one preferred form of the invention, system 5 may be provided in three different "grades" of systems:

(i) "collision sport grade" (e.g., football, hockey, lacrosse, etc.);

(ii) "vehicle grade" (e.g., motorcycle, mountain/dirt bike, snowmobile, etc.); and (iii) "military grade" (e.g., armed forces, SWAT, etc.).

The collision sport grade system is the "basic" system. Helmet 10 may be formed out of impact-resistant plastic. Standard football, hockey, lacrosse, etc. pads may be worn over protective suit 15.

The vehicle grade system is similar to the "basic" system but the vest (i.e., shoulder portion 70, chest portion 75 and back portion 80) of protective suit 15 is supplemented with sleeves so as to constitute a full shirt top, preferably with built-in Kevlar™ padding. Helmet 10 may be reinforced with non-plastic materials, e.g., Kevlar™. With this form of the invention, the depressurization indicator (i.e., indicator light 30) may be located on the vest (e.g., on chest portion 75), and no indicator light 30 may be provided on helmet 10.

The military grade system is similar to the vehicle grade system but preferably includes bulletproof padding. The military grade system may also include fluid-based exoskeletal body armor in the form of separate pants with bulletproof padding. In this form of the invention, there may be two temperature conditioning units 20, one for the shirt and one for the pants (or the shirt and pants may carry thermoelectric heat pumps 140). Helmet 10 is preferably military grade, e.g., bulletproof. The depressurization indicator (i.e., indicator light 30) is on the shirt (e.g., on chest portion 75), and no indicator light 30 may be provided on helmet 10.

Example

Figure 25:
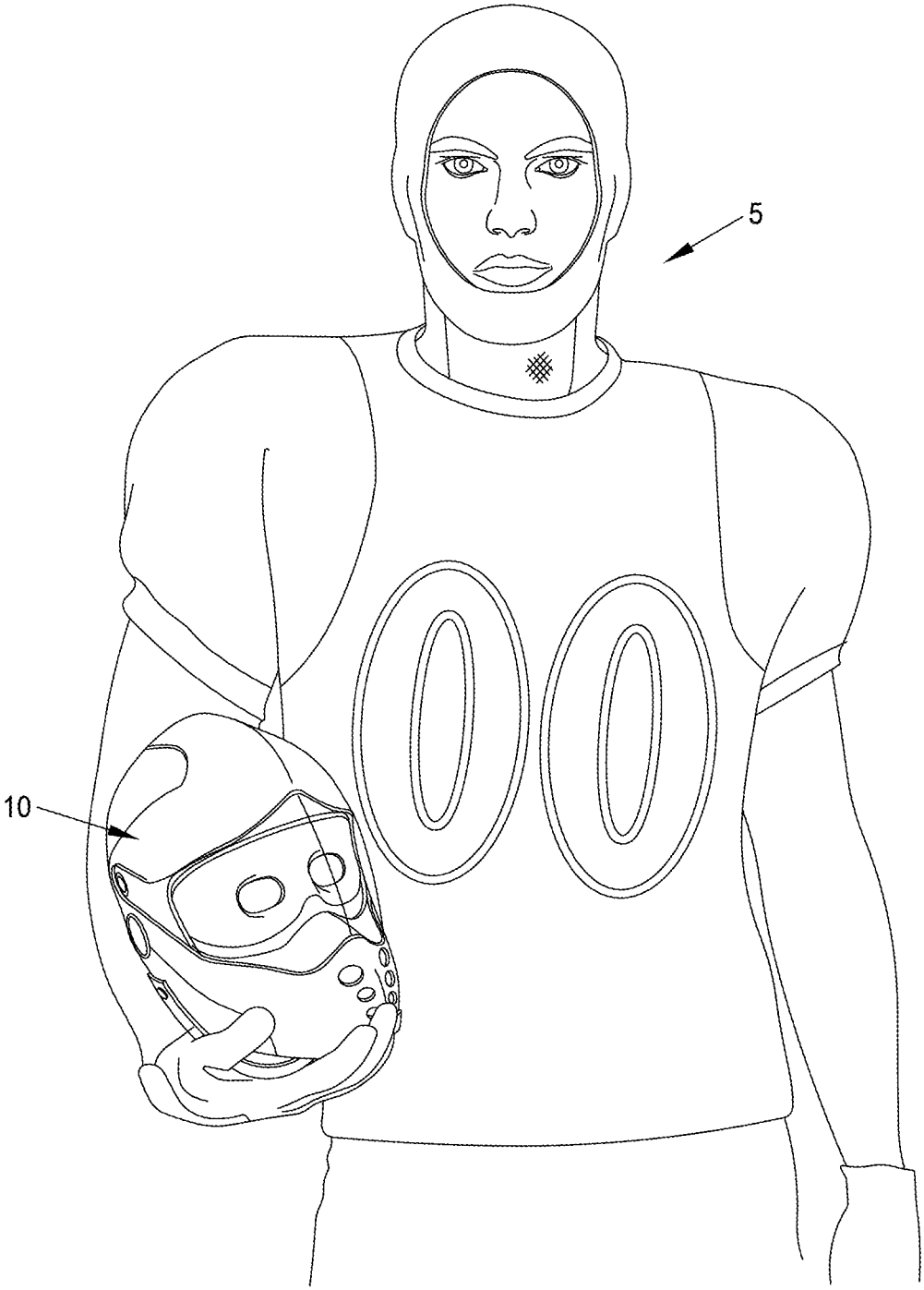
FIGS. 25 and 26 are schematic views showing an exemplary application for the fluid-based exoskeletal body armor of the present invention.
Figure 26:
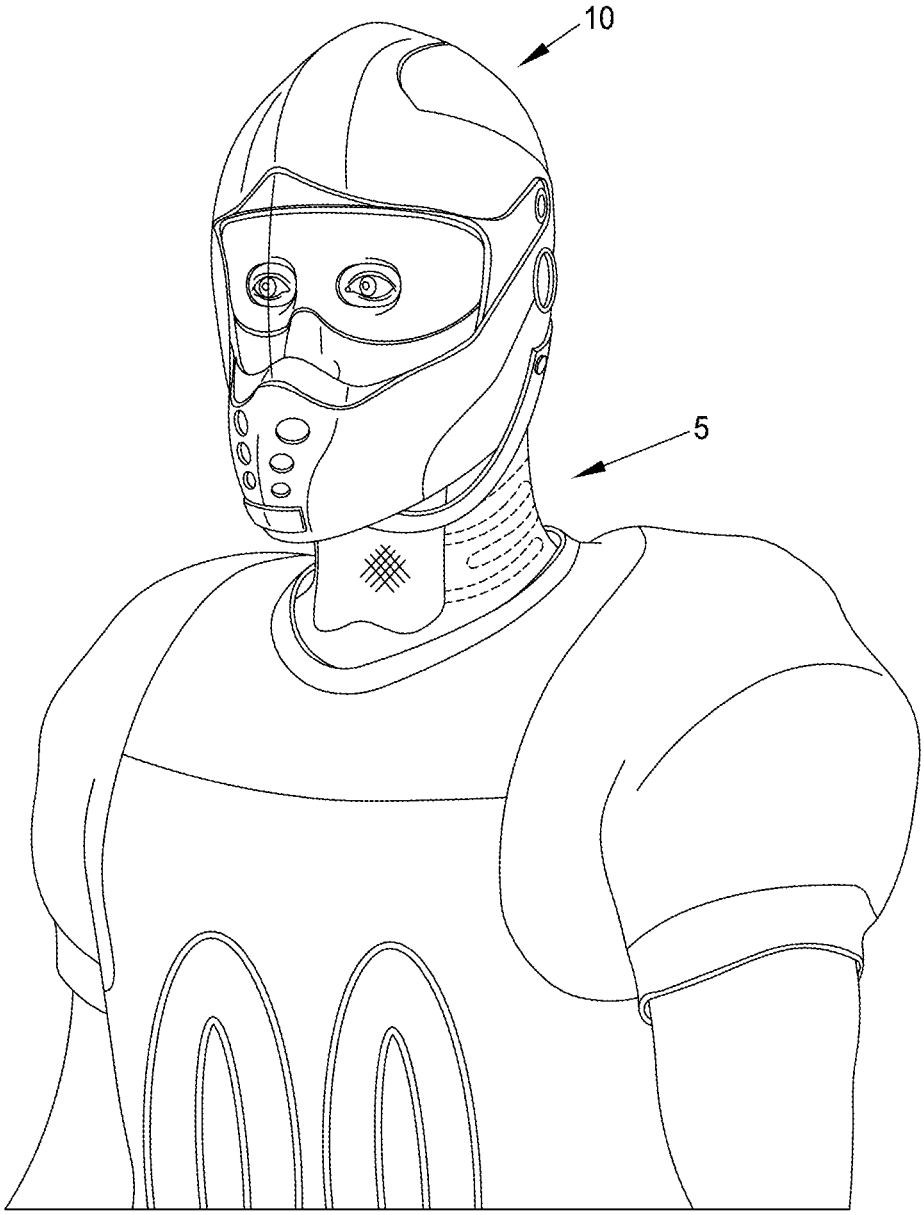

FIGS. 25 and 26 show an exemplary application for the fluid-based exoskeletal body armor of the present invention: in FIG. 25, a football player is shown wearing protective suit 5 and holding helmet 10, and in FIG. 26 a football player is shown wearing protective suit 5 and wearing helmet 10.

Alternative Fluid-Based Exoskeletal Body Armor

Figure 27:
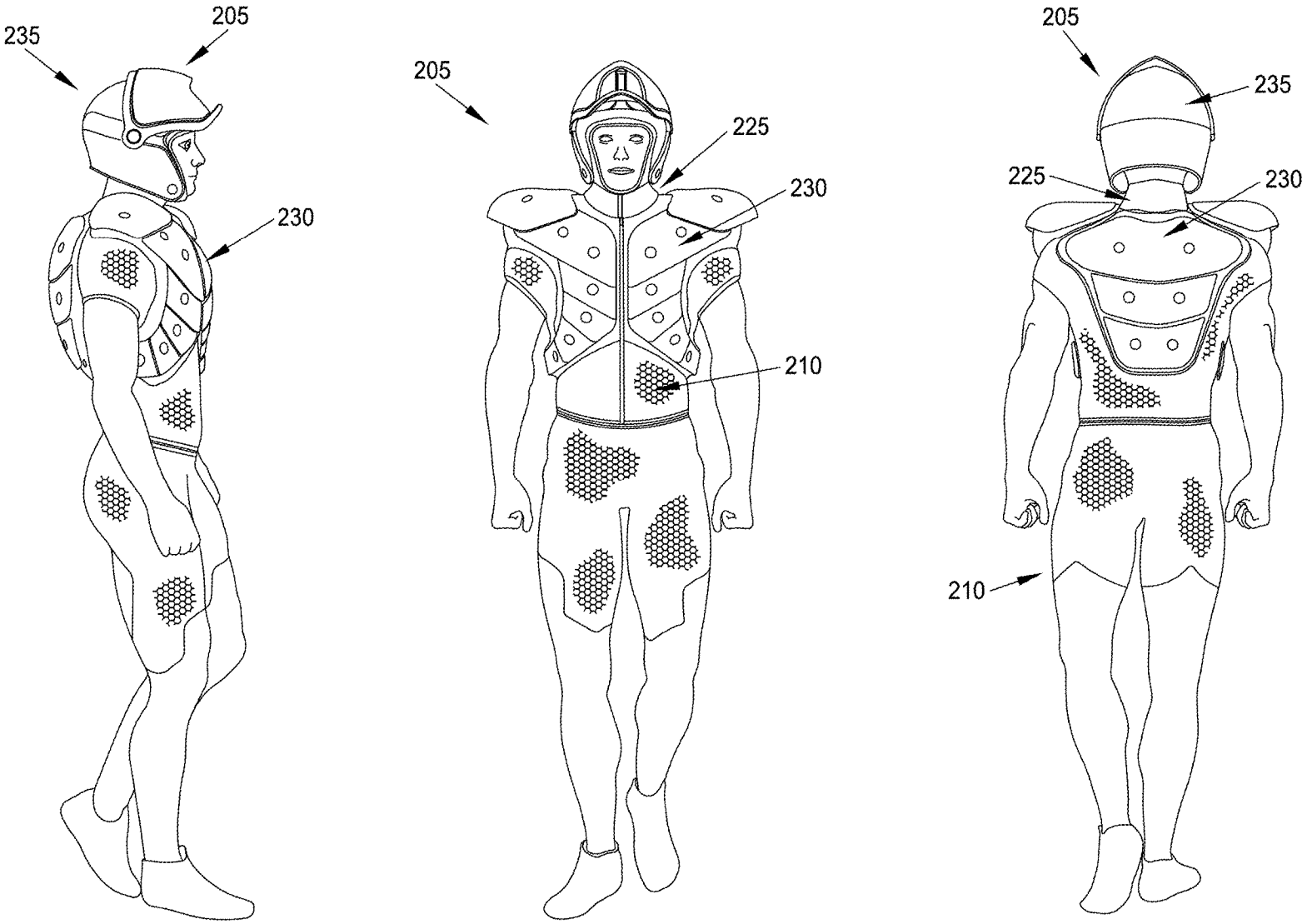
FIGS. 27-29 are schematic views showing an alternative novel system formed in accordance with the present invention.
Figure 28:
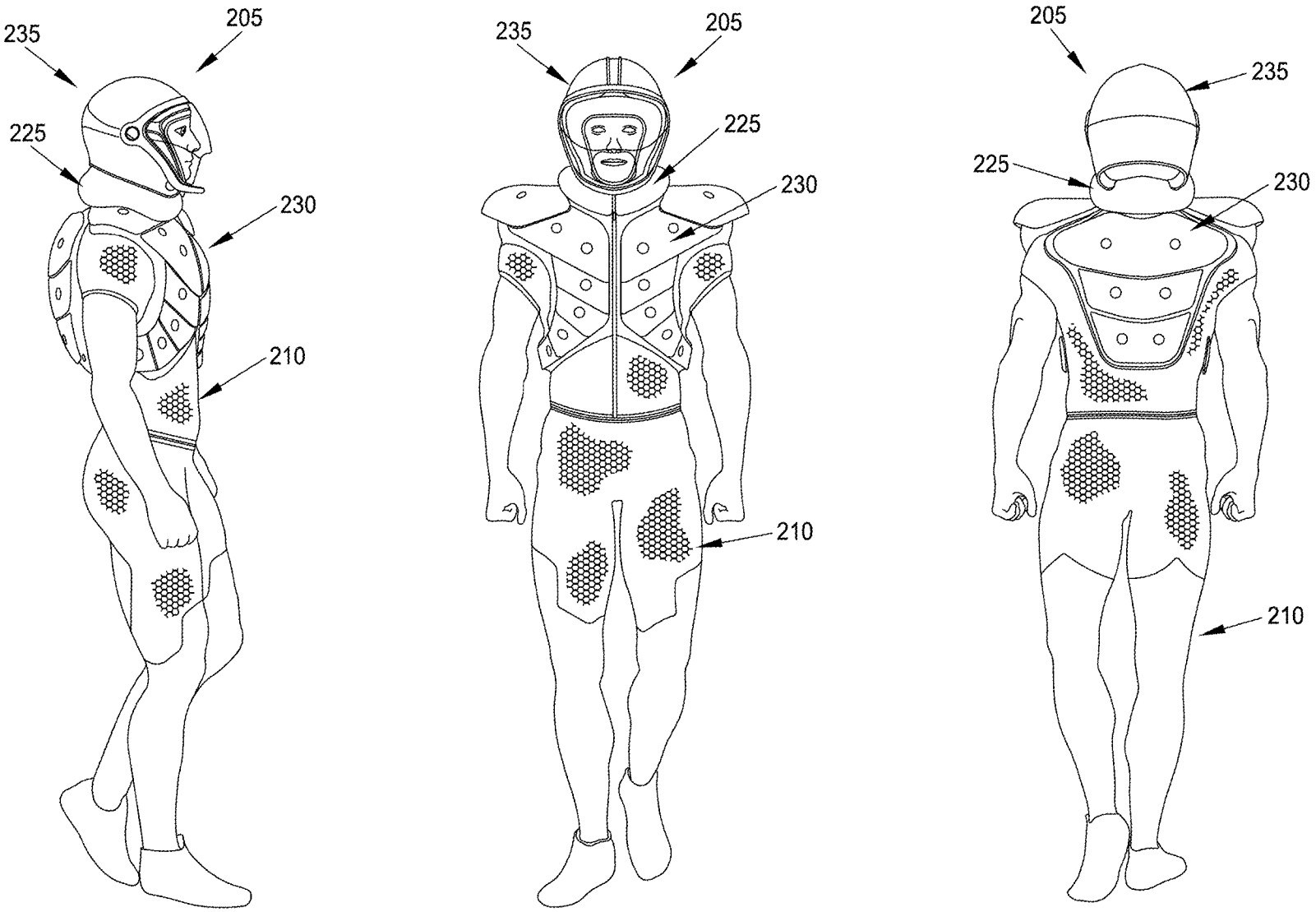
Figure 29:
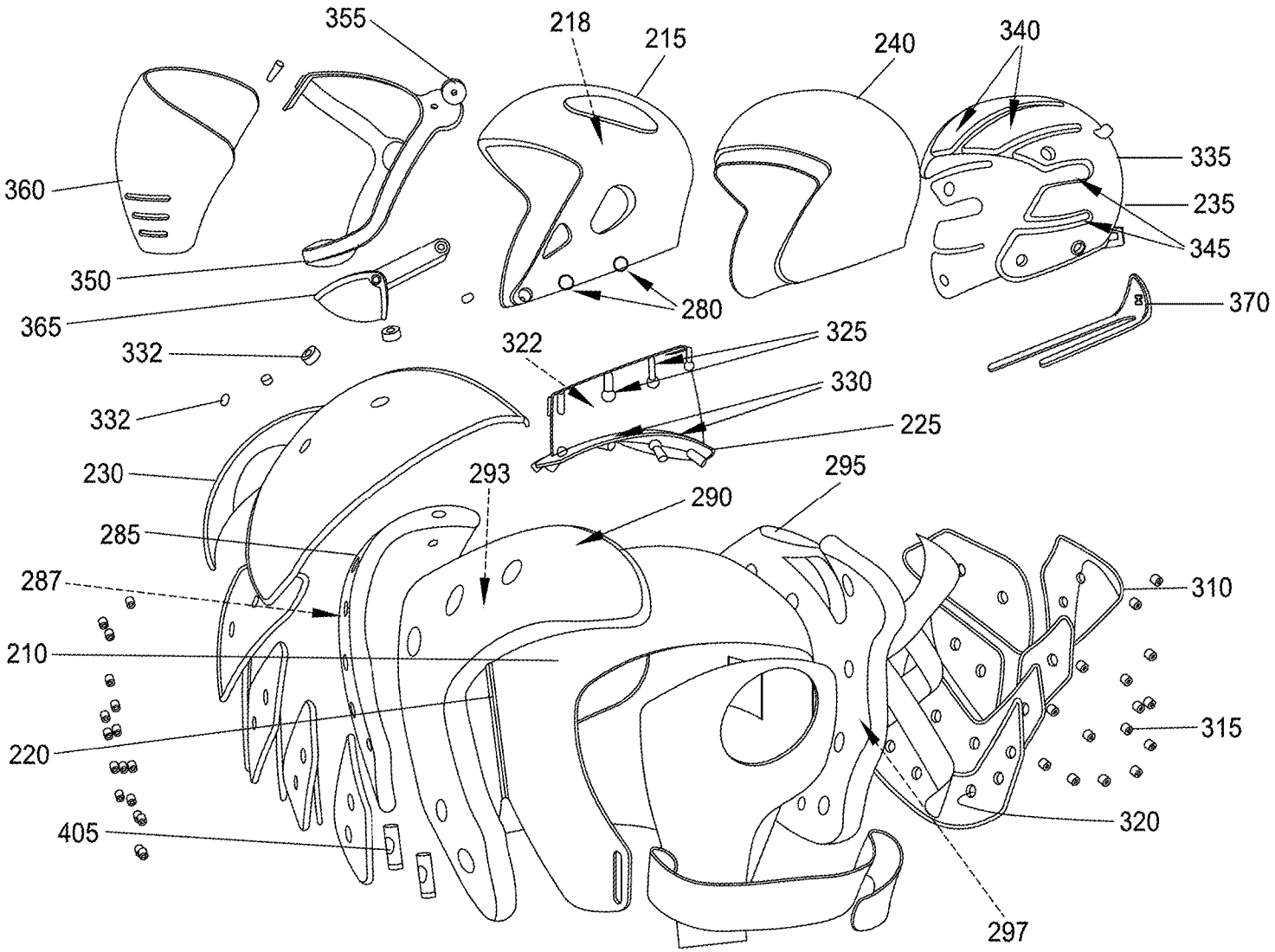

In an alternative form of the present invention, and looking now at FIGS. 27-29, there is provided a novel system 205 which provides another form of fluid-based exoskeletal body armor.

As used in connection with describing novel system 205 herein, the term "wearer" refers to the person who is wearing novel system 205. The terms "superior", "inferior", "anterior" and "posterior" have their customary anatomical meaning, and as used herein refer to the elements of novel system 205 with reference to the body of the wearer.

Novel system 205 generally comprises (i) a compressive base layer 210, (ii) a fluid-based head bladder 215, (iii) a fluid-based vest 220, (iv) a protective outer vest covering 230, (v) a fluid-based protective neck bladder 225, and (vi) a novel helmet 235. In a preferred form of the present invention, novel system 5 also comprises novel electronics, communications and sensors for tracking various aspects of system 205 and the person wearing system 205.

1. Compressive Base Layer 210

Figure 30:
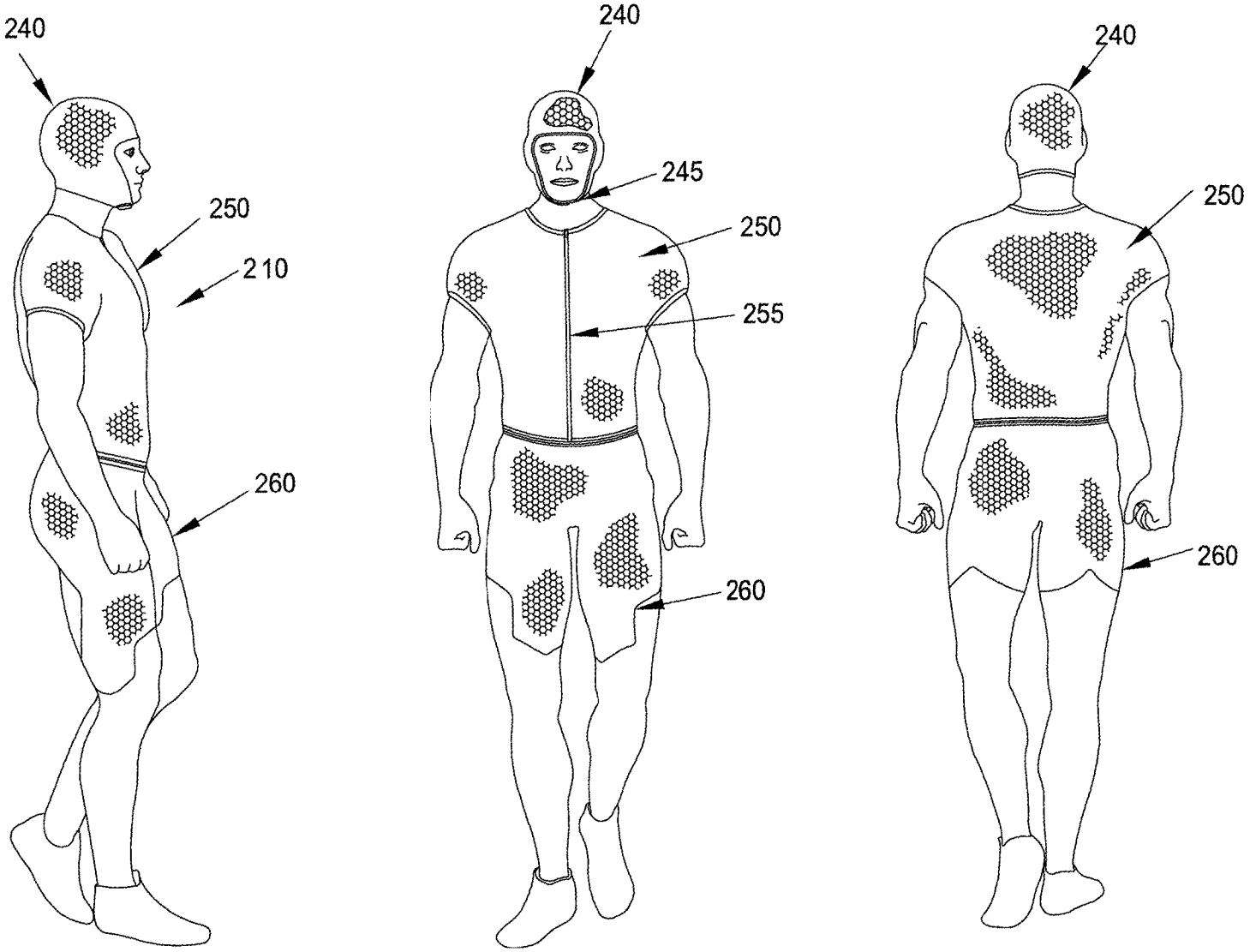
FIGS. 30 and 30A are schematic views showing further details of the novel compressive base layer of the novel system of FIGS. 27-29.

Looking now at FIG. 30, compressive base layer 210 preferably comprises hexagonal foam lined with four-way stretch Lycra (or similar material). Compressive base layer 210 is sized and shaped so as to allow compressive base layer 210 to fit close against the skin of the wearer (while also yielding as needed in order to accommodate different physiologies).

In one form of the invention compressive base layer 210 can be made of an insulating warm material to be used on cold days to maintain the physiologic temperature of the wearer. In another form of the invention compressive base layer 210 can be made of a breathable mesh material to promote evaporation and cooling of the wearer to be used on warm days to maintain the physiologic temperature of the wearer.

In one preferred form of the invention, compressive base layer 210 comprises a compressive hood 240 configured to closely fit over the head of the wearer. Compressive hood preferably comprises an adjustable chin-strap 245 for maintaining compressive hood 240 in position on the head of the wearer.

Figure 30A:
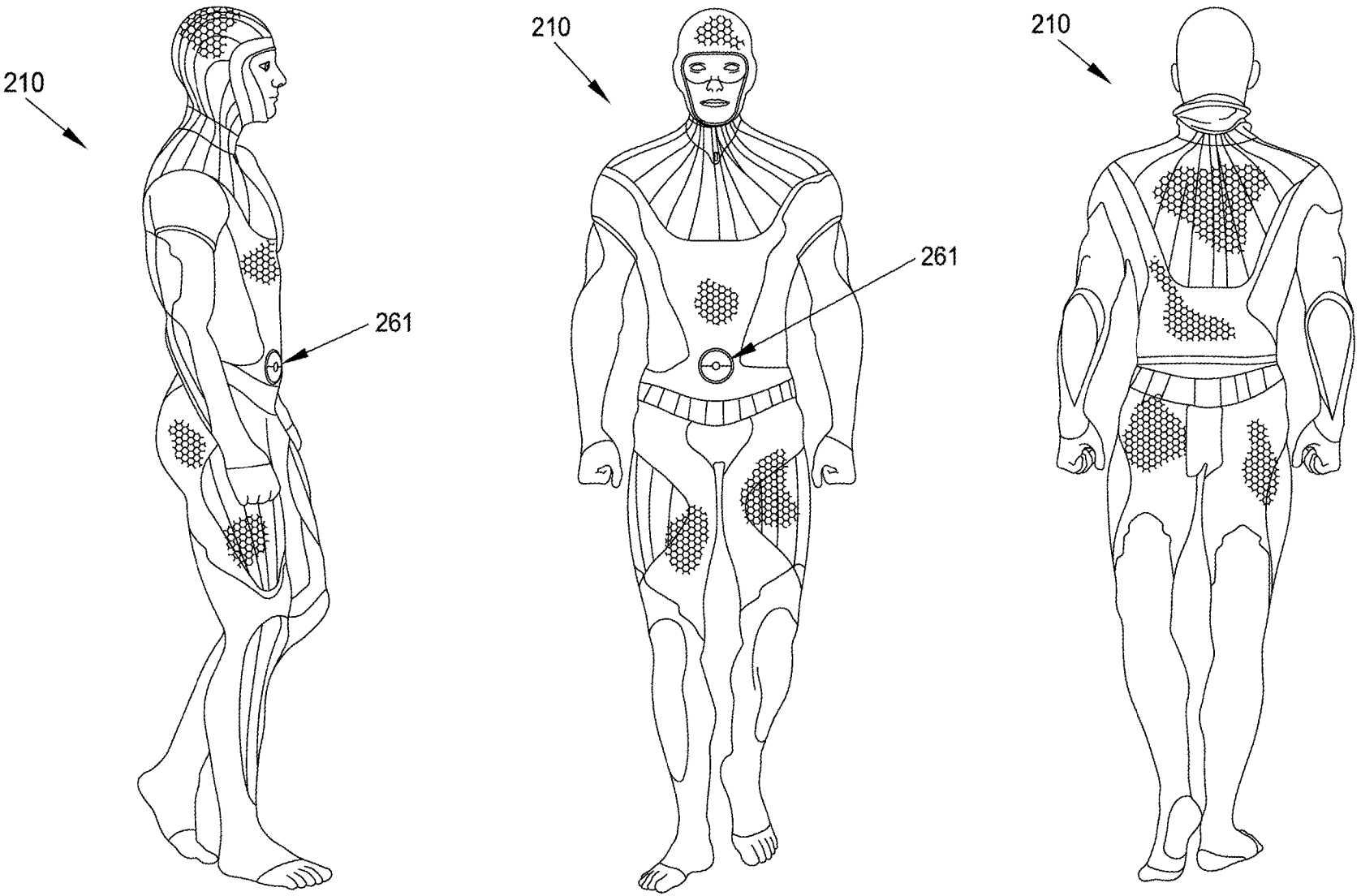
Figure 31:
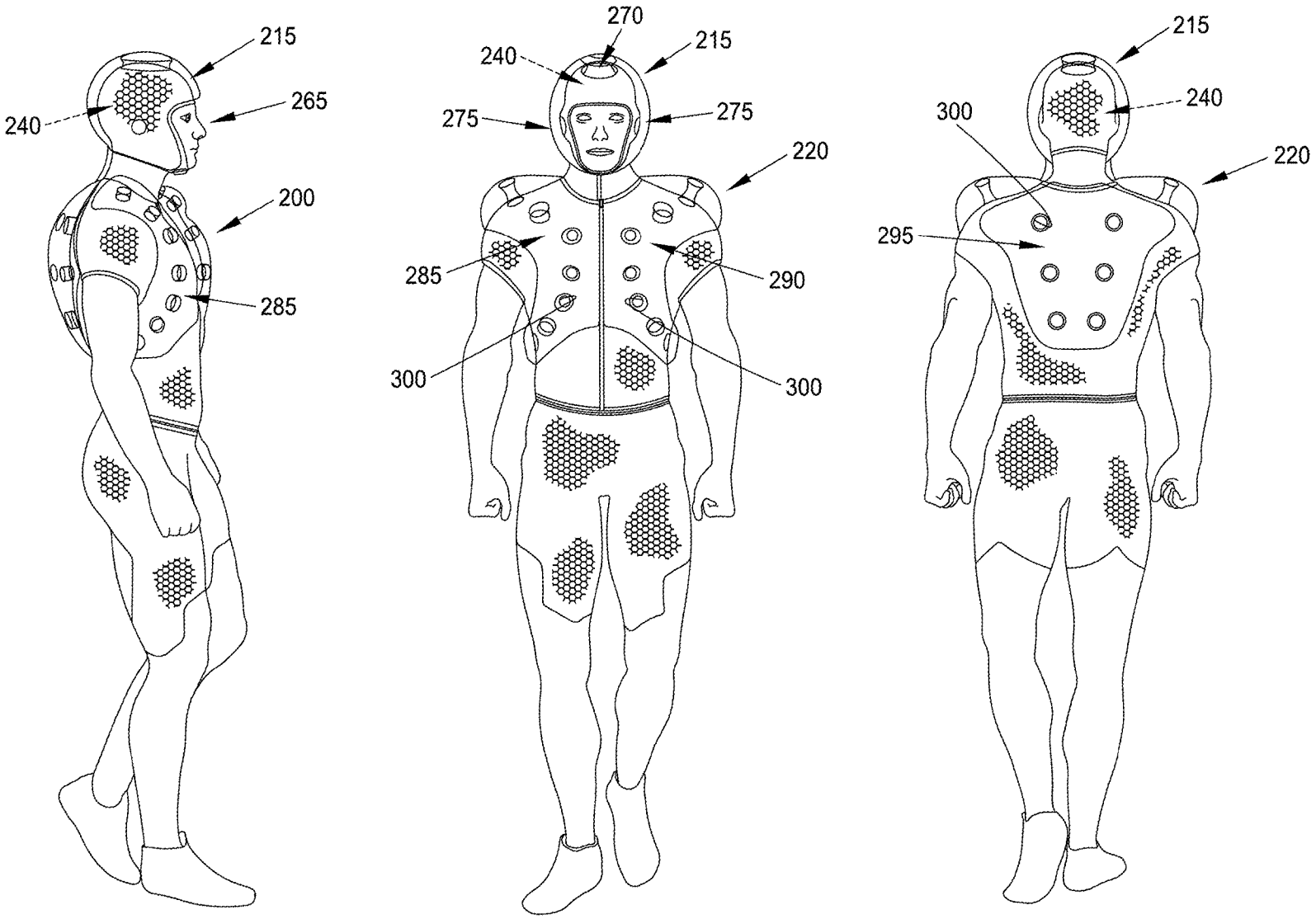
FIGS. 31, 32, 32A-32F, 33-36 and 36A are schematic views showing further details of the novel fluid-based head bladder, the novel fluid-based protective neck bladder and the novel fluid-based vest of the novel system of FIGS. 27-29.
Figure 32:
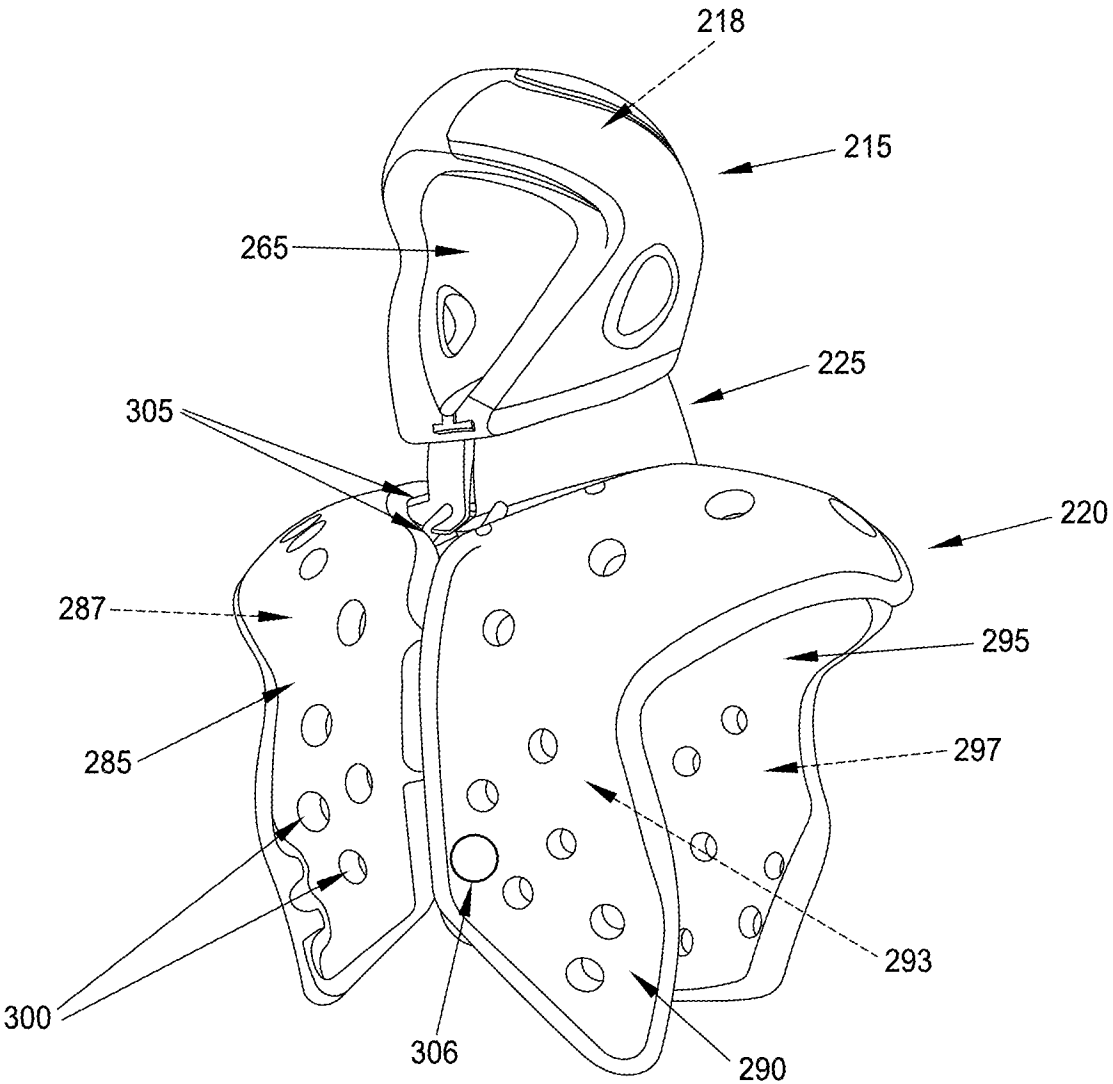
Figure 32A:
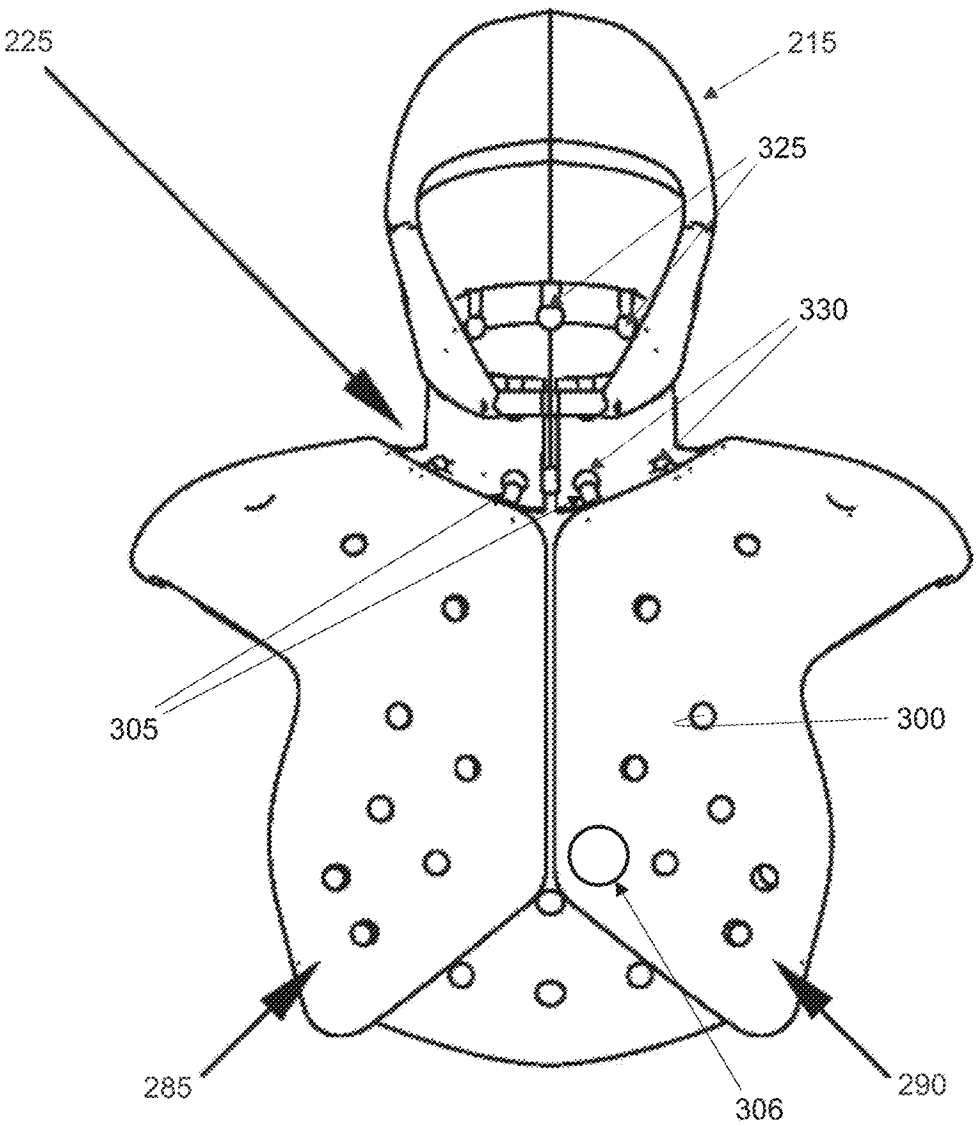
Figure 32B:
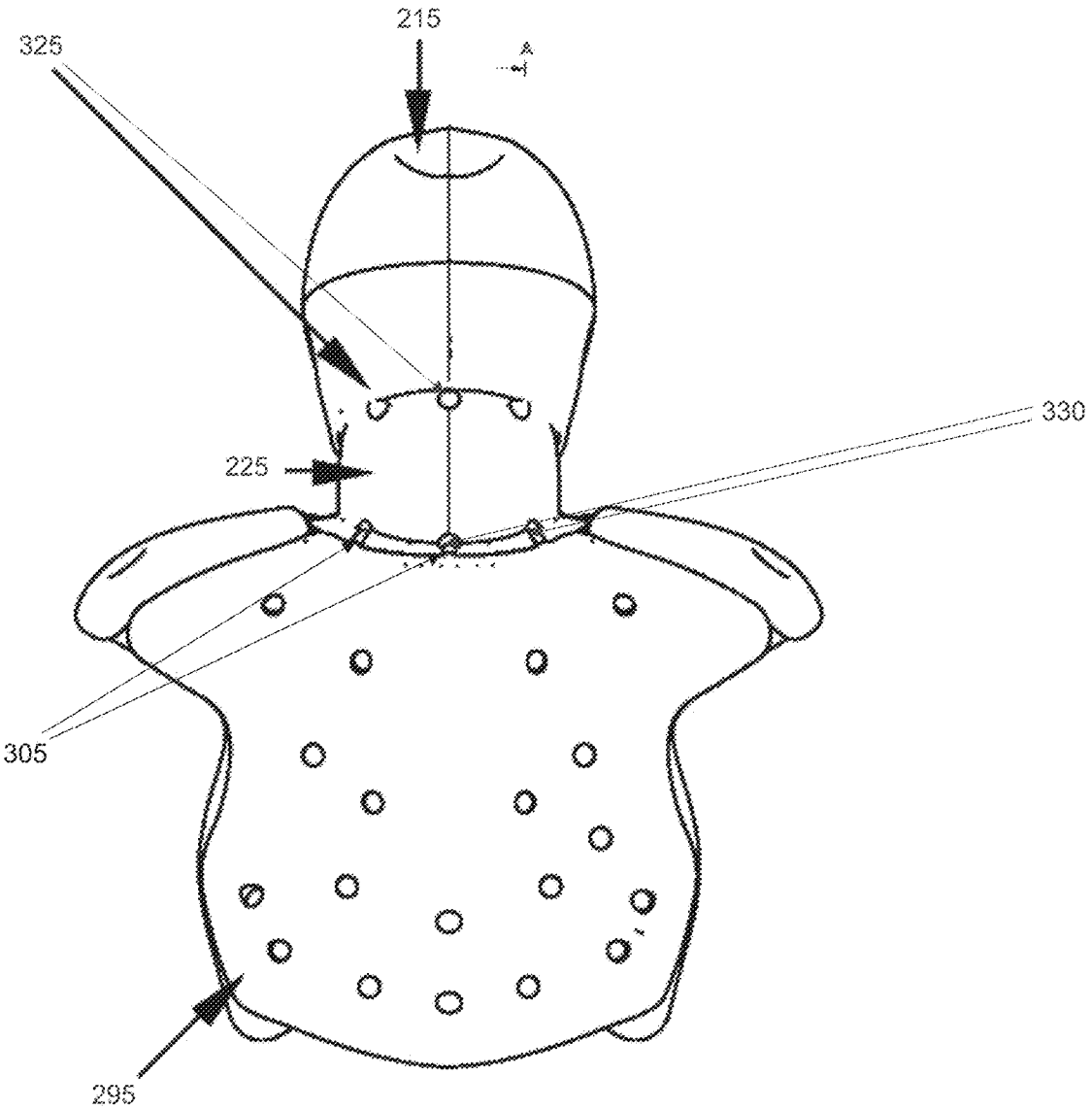
Figure 32C:
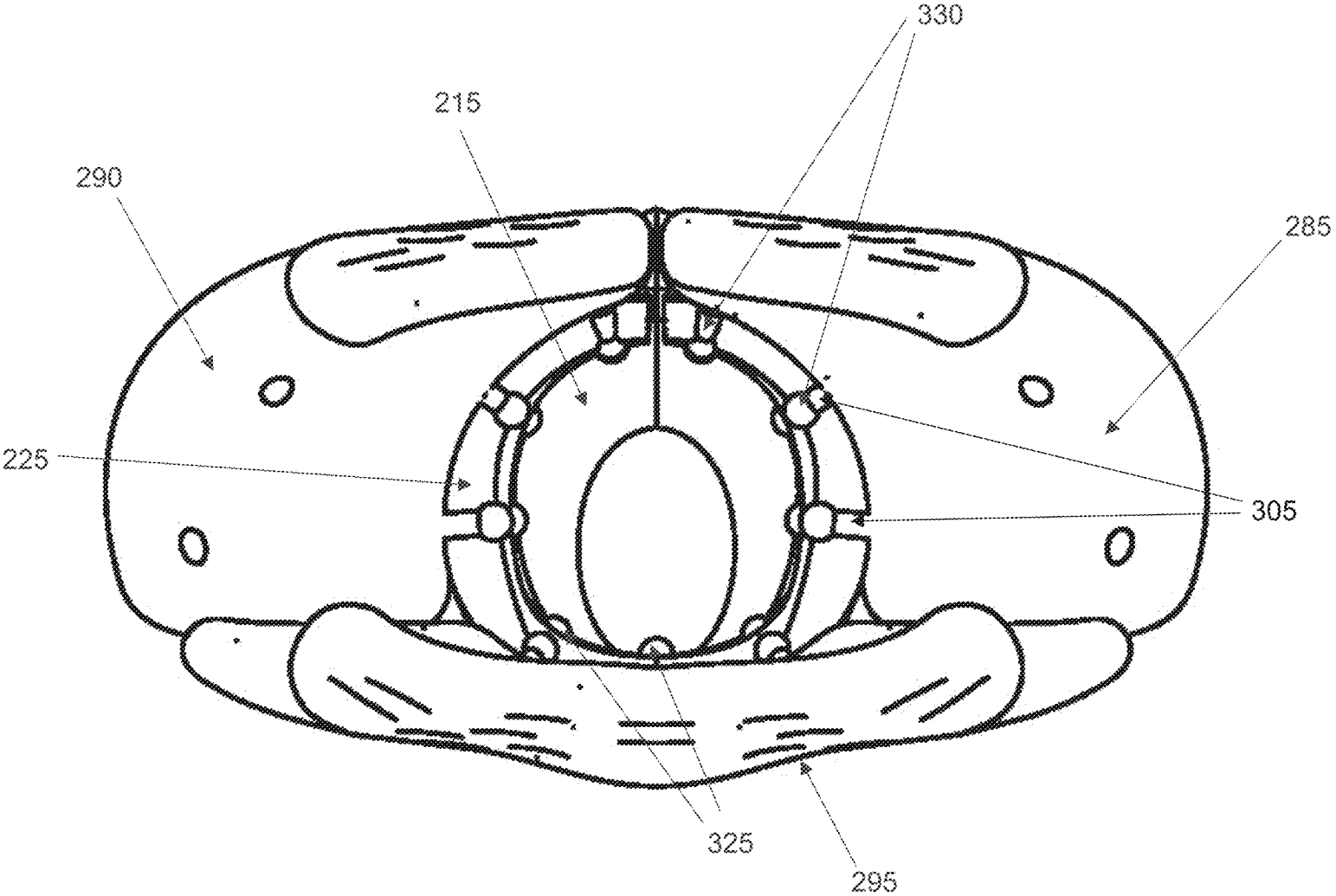
Figure 32D:
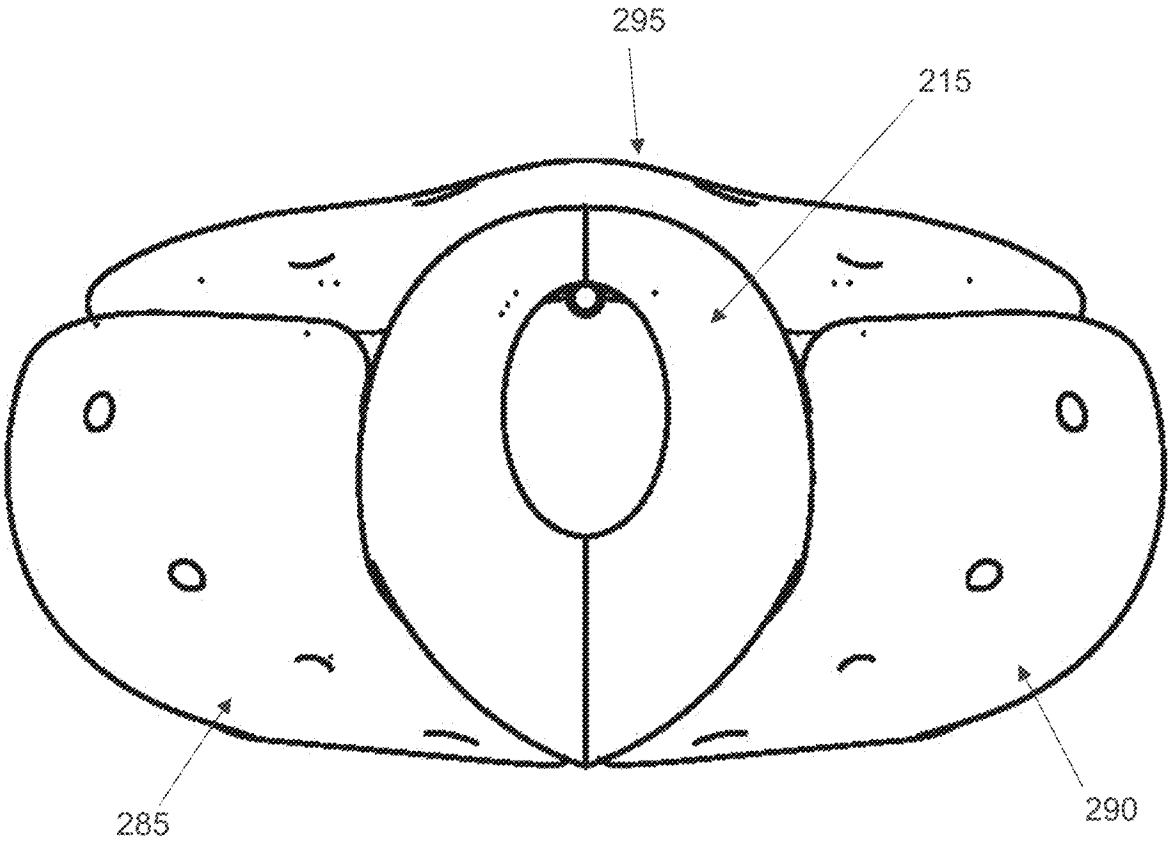
Figure 32F:
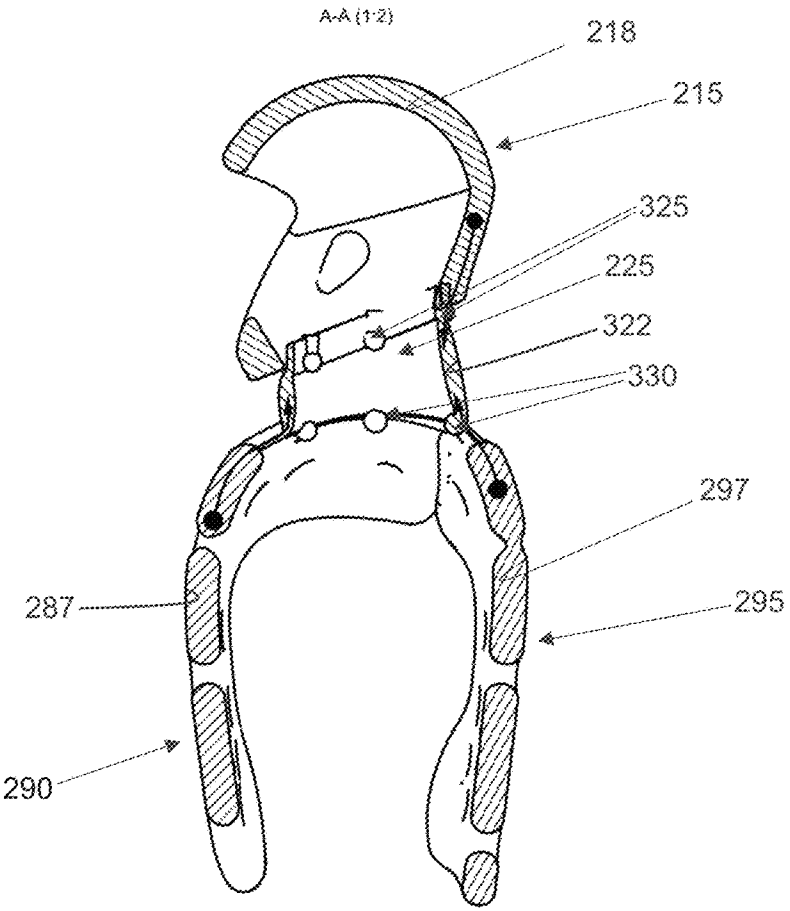
Figure 32E:
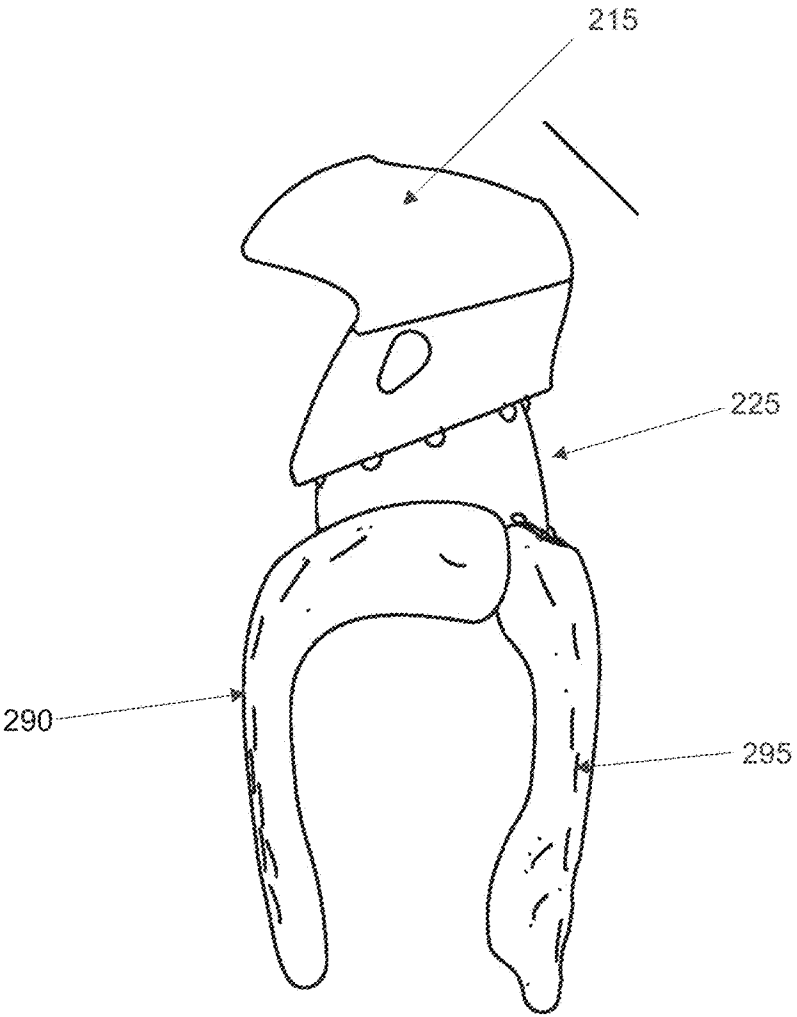
Figure 33:
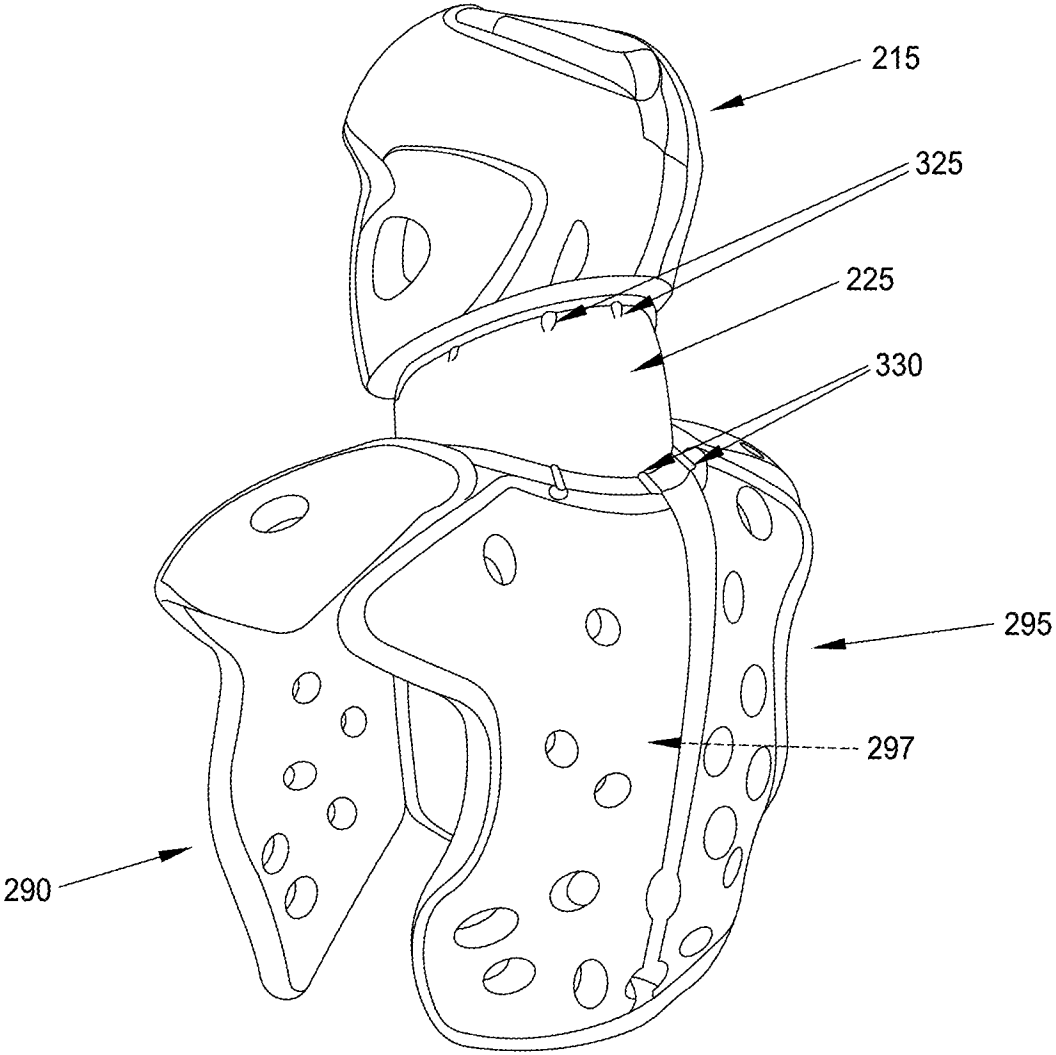
Figure 34:
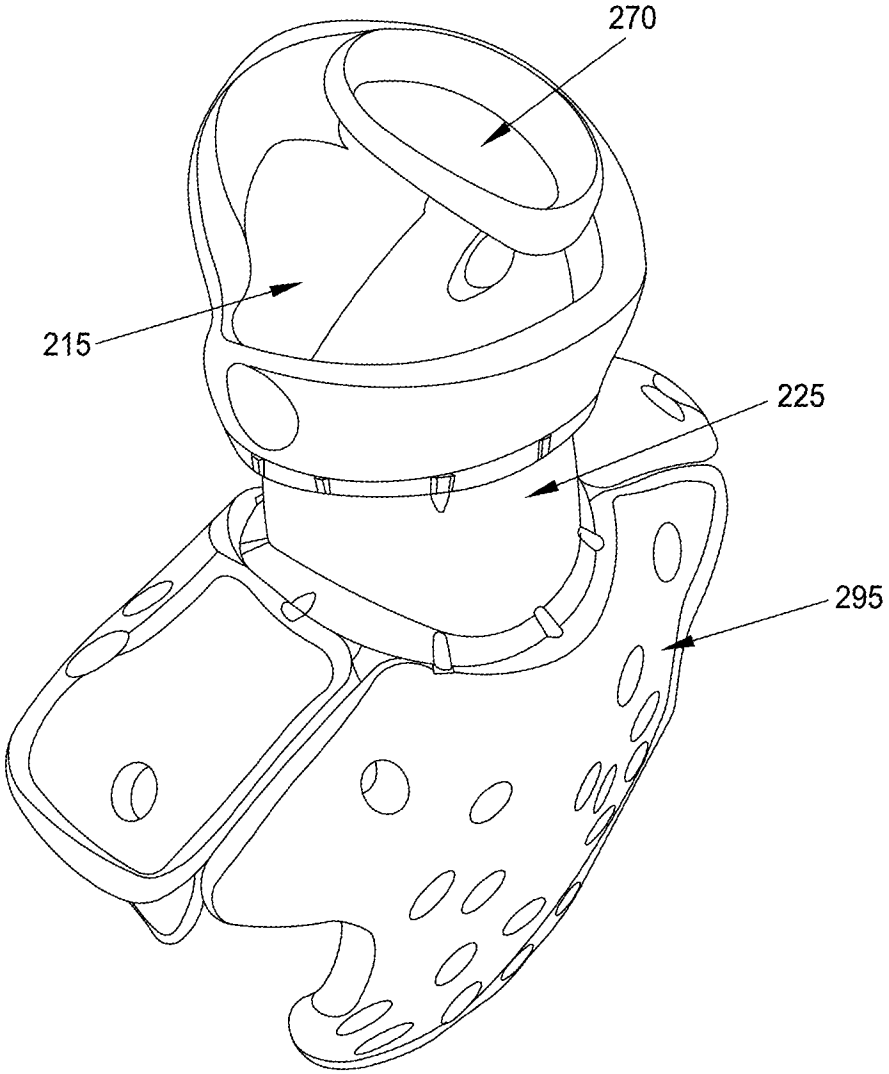
Figure 35:
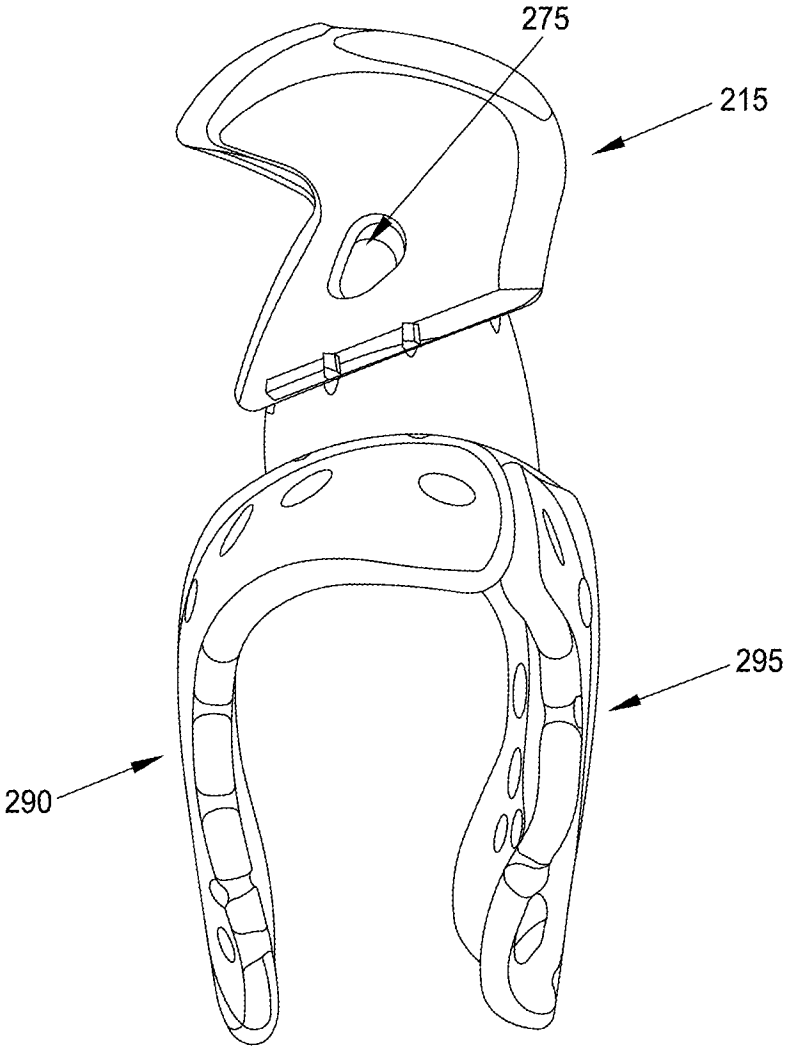
Figure 36:
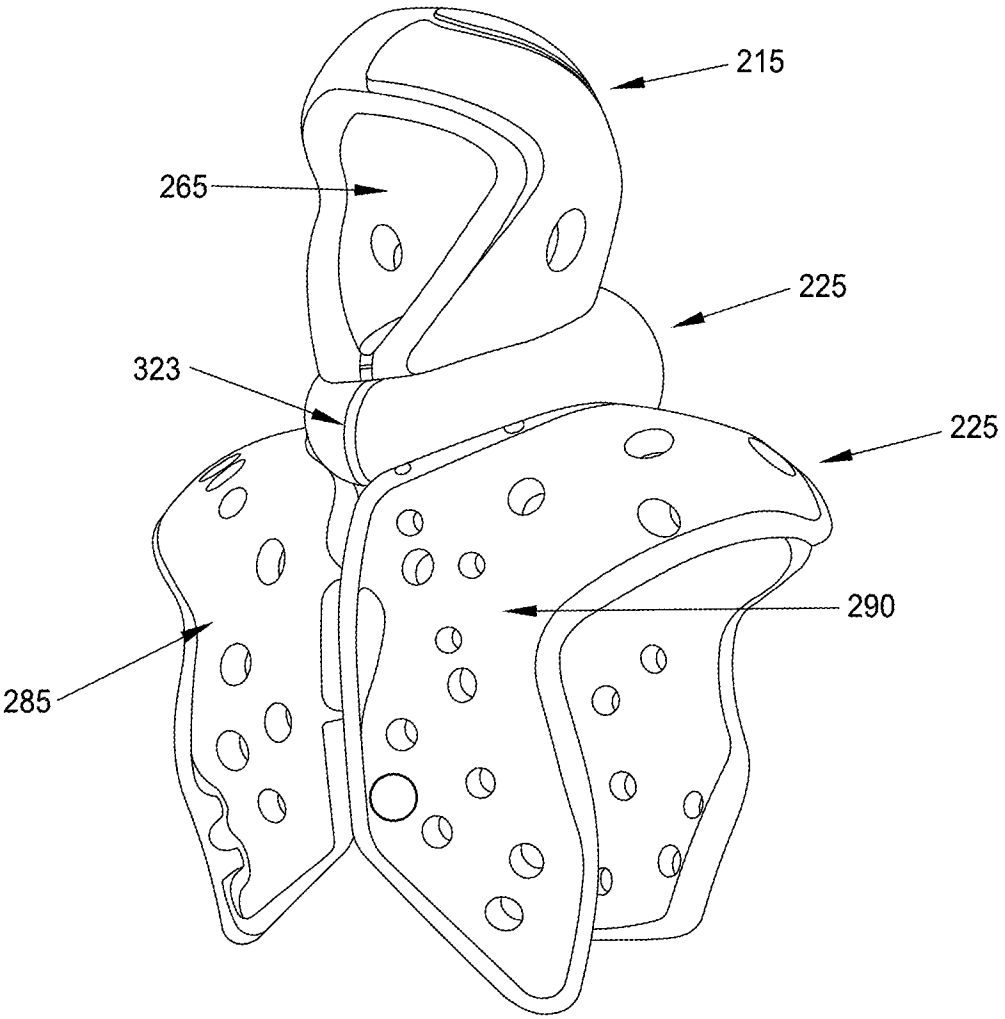
Figure 36A:
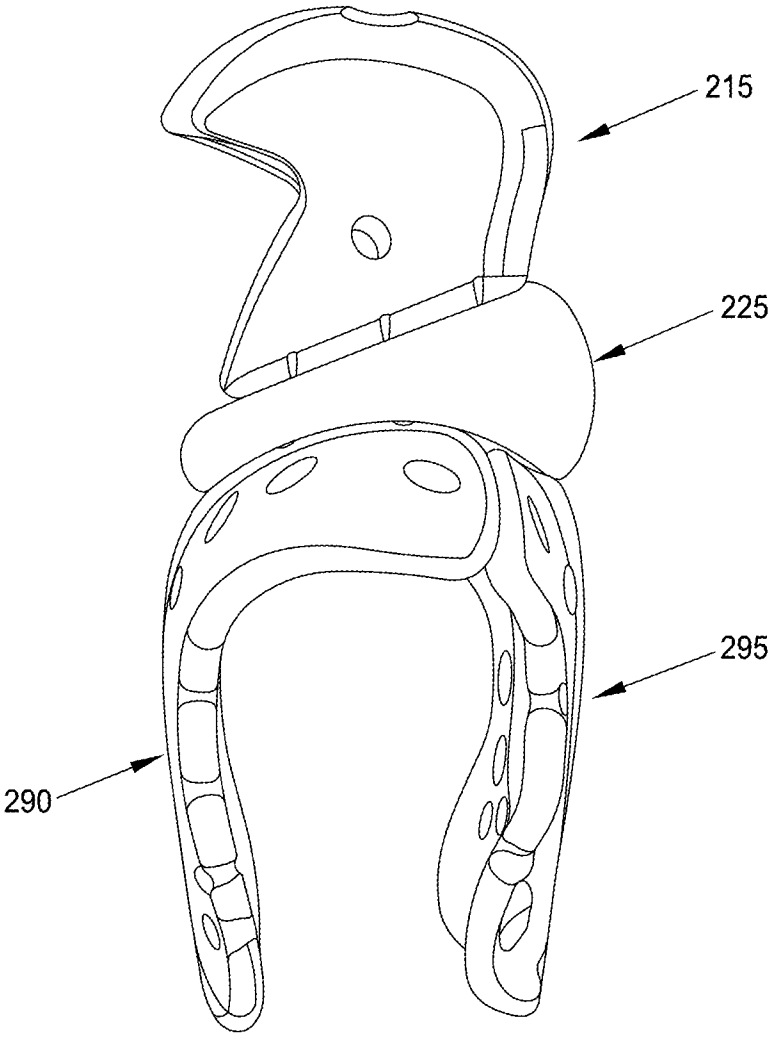
Figure 37:
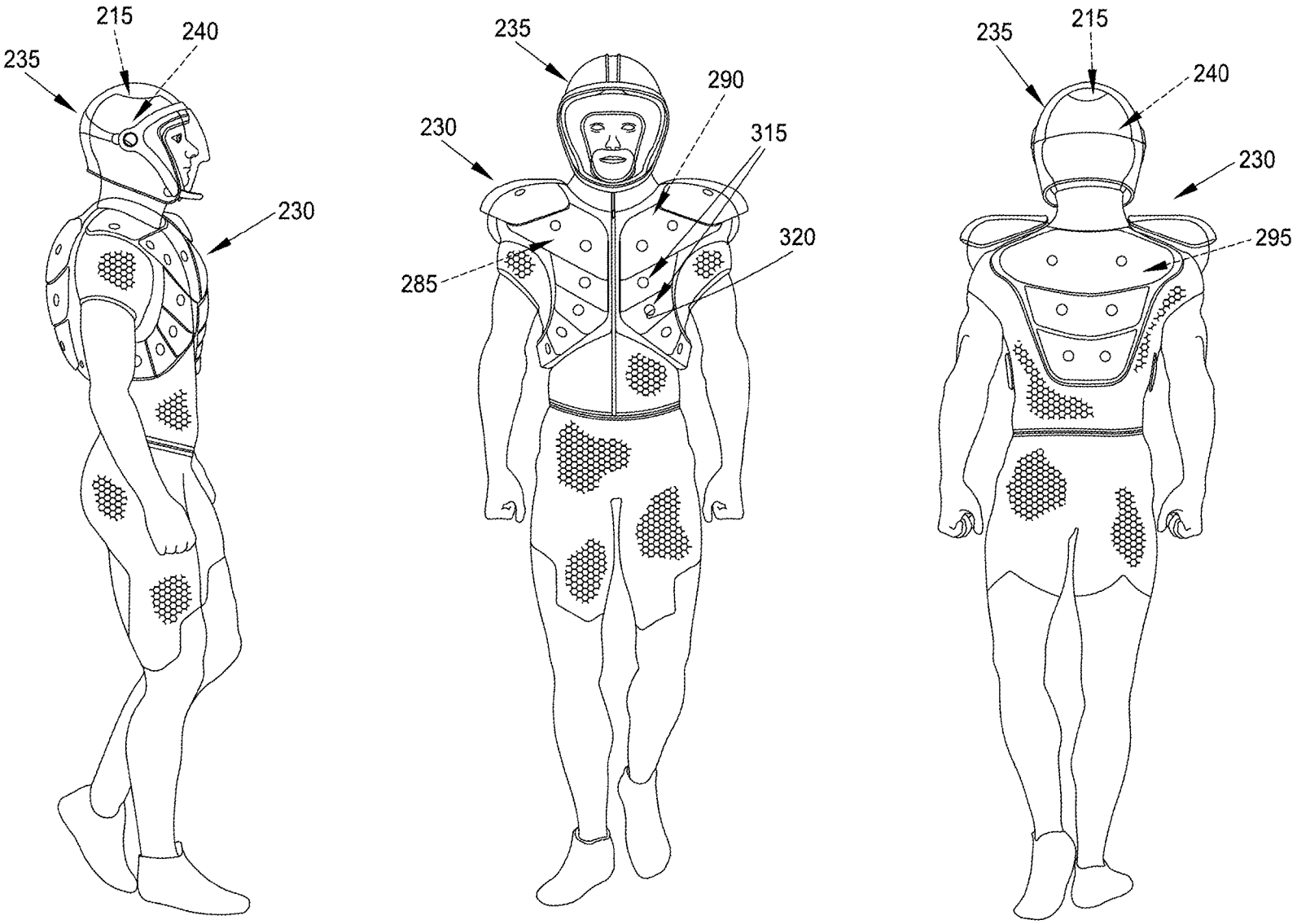
FIGS. 37, 38 and 38A-38F are schematic views showing further details of the novel protective outer vest covering of the novel system of FIGS. 27-29.
Figure 38:
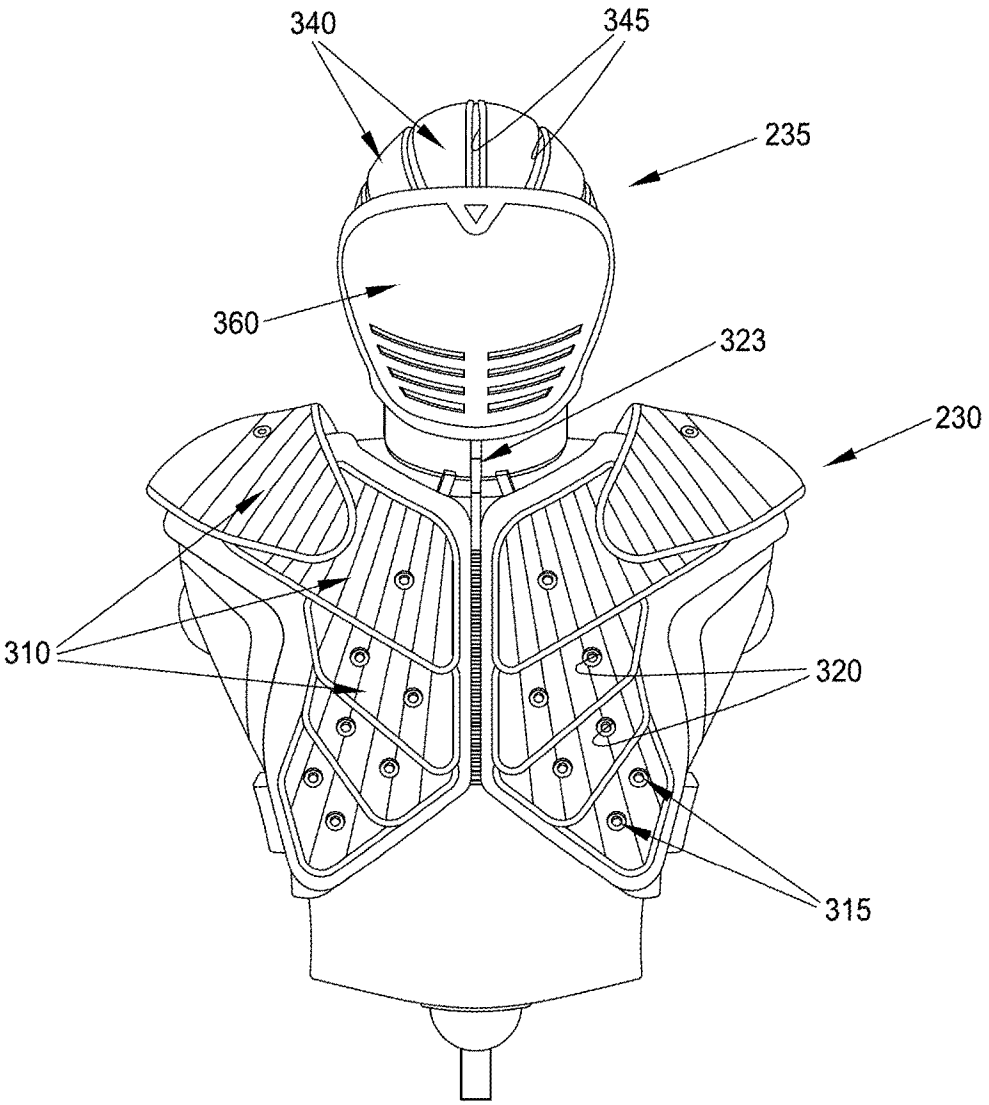
Figure 38A:
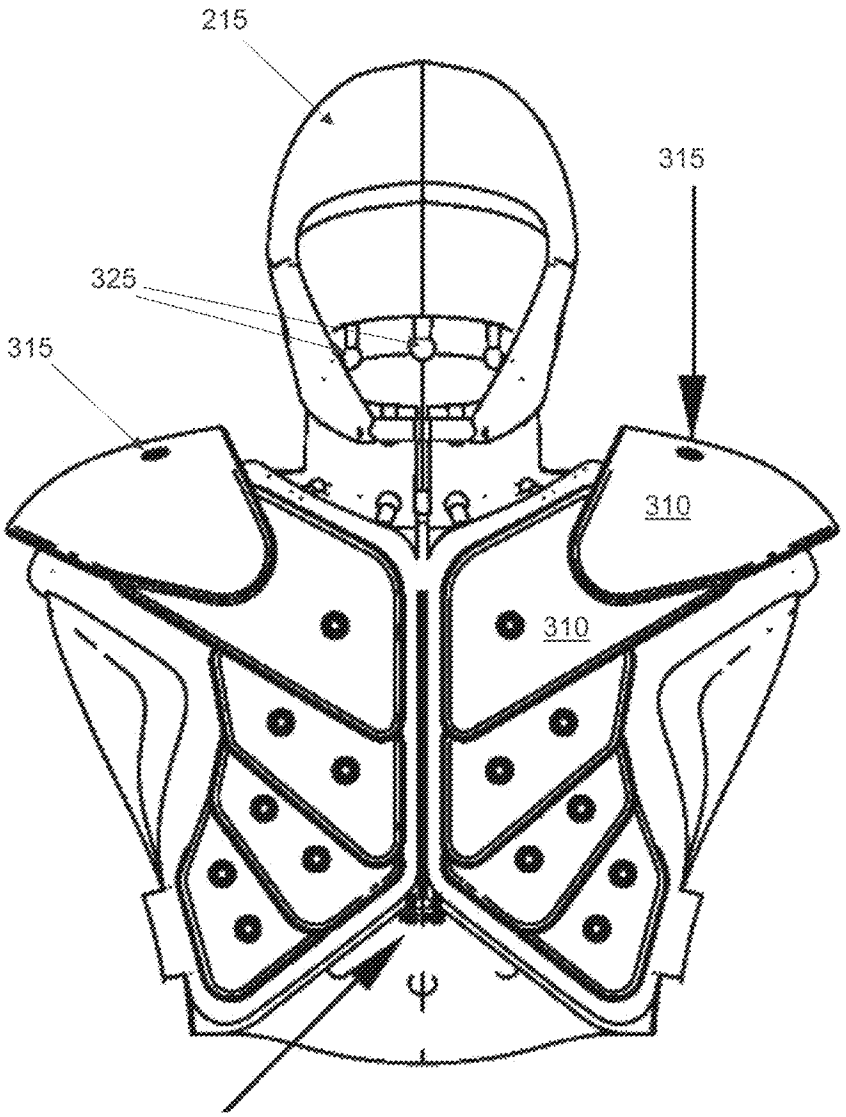
Figure 38B:
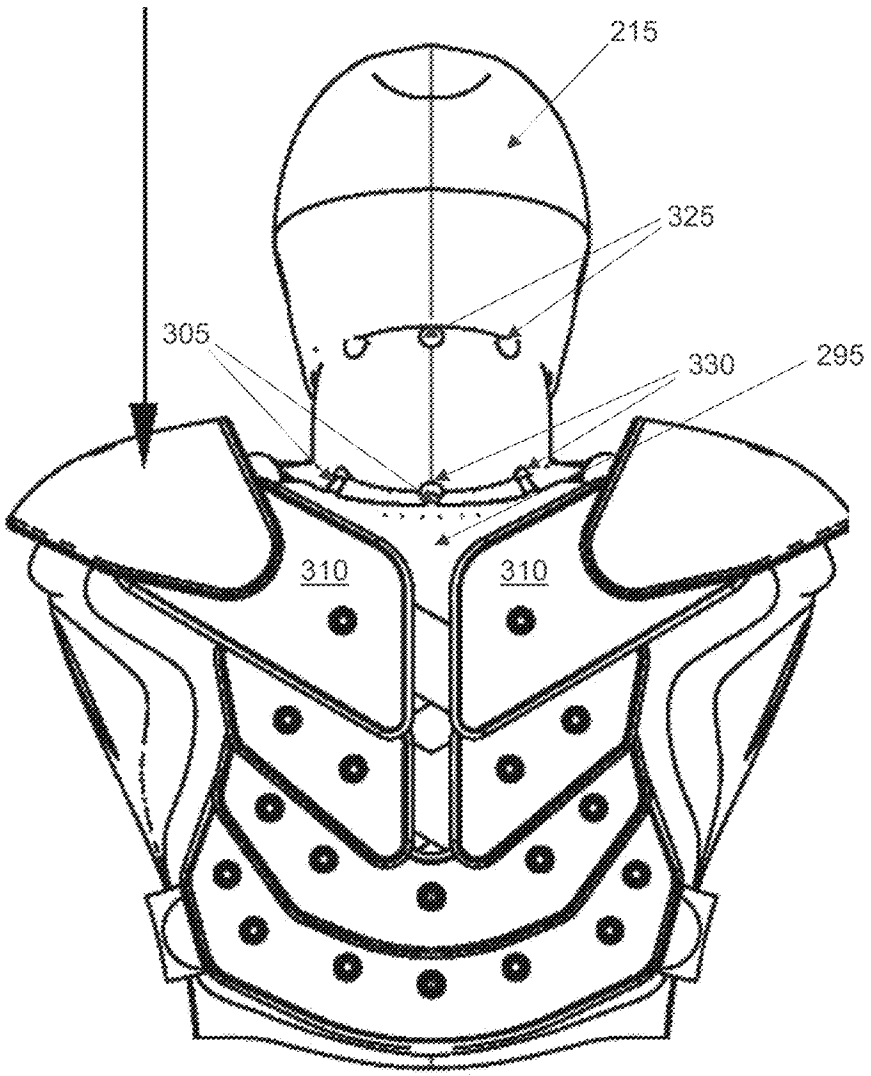
Figure 38C:
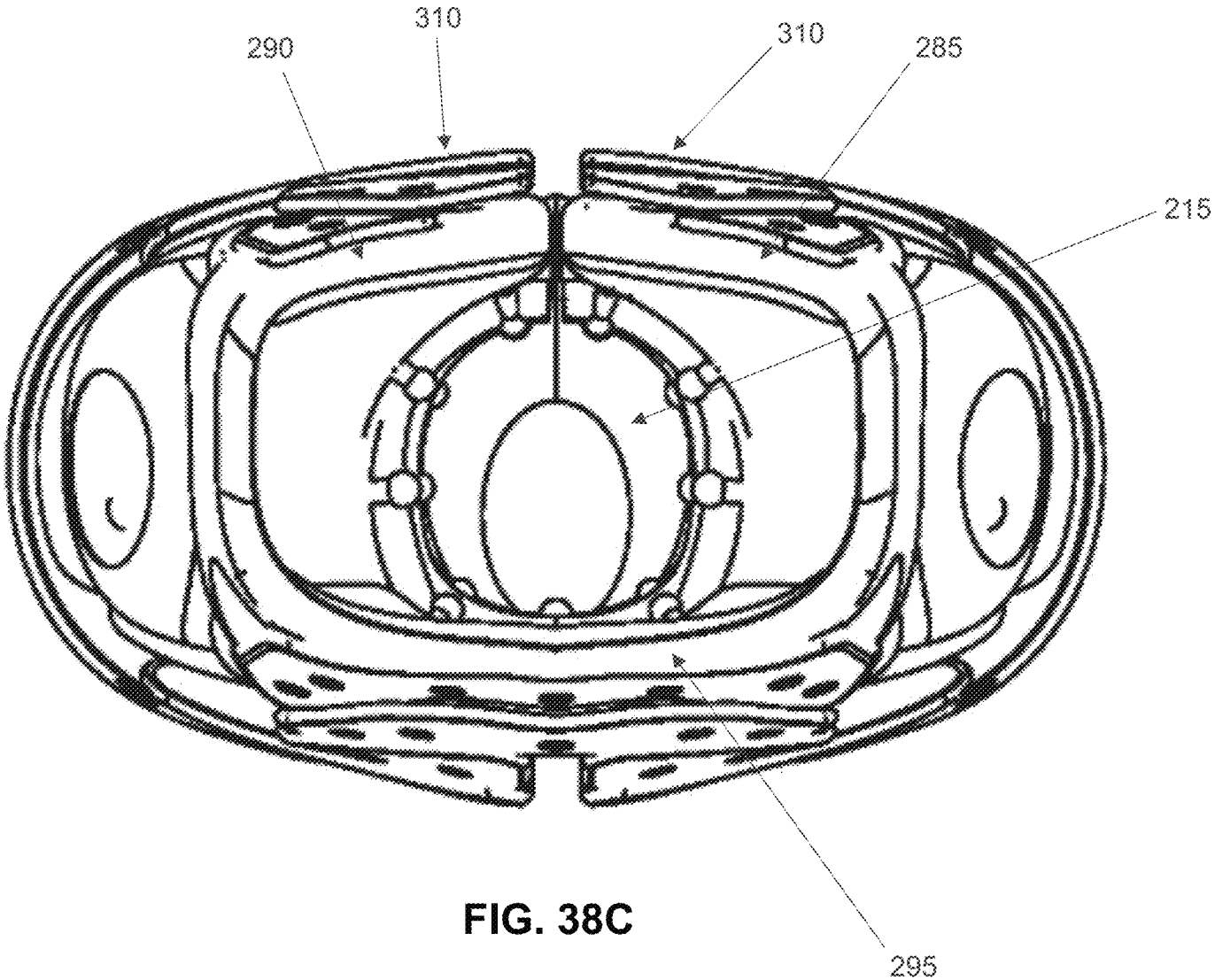
Figure 38D:
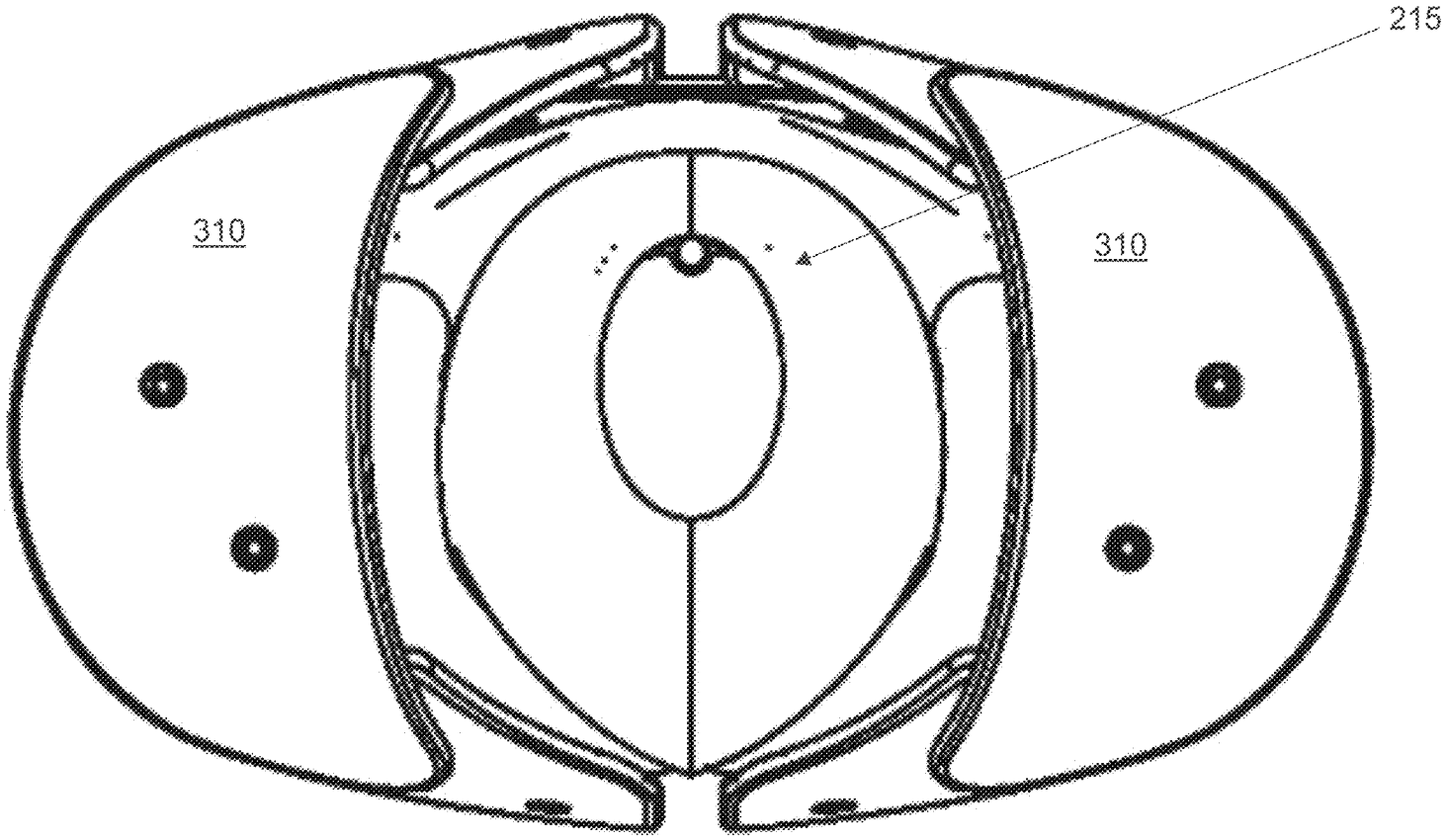
Figure 38F:
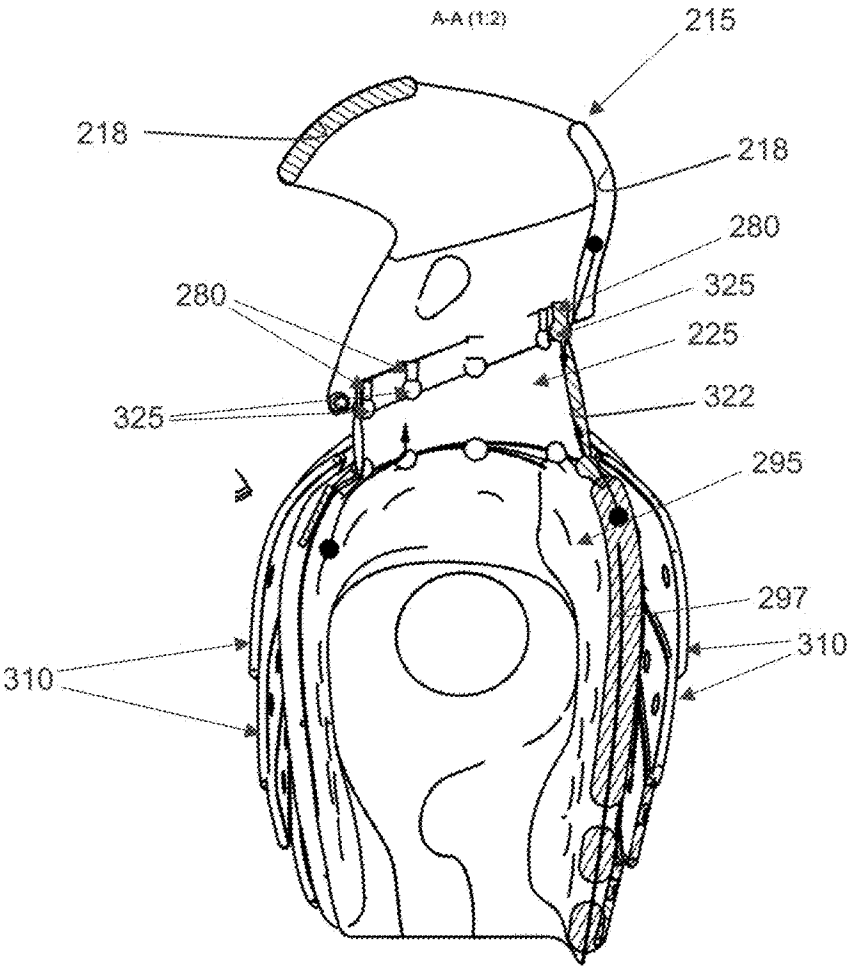
Figure 38E:
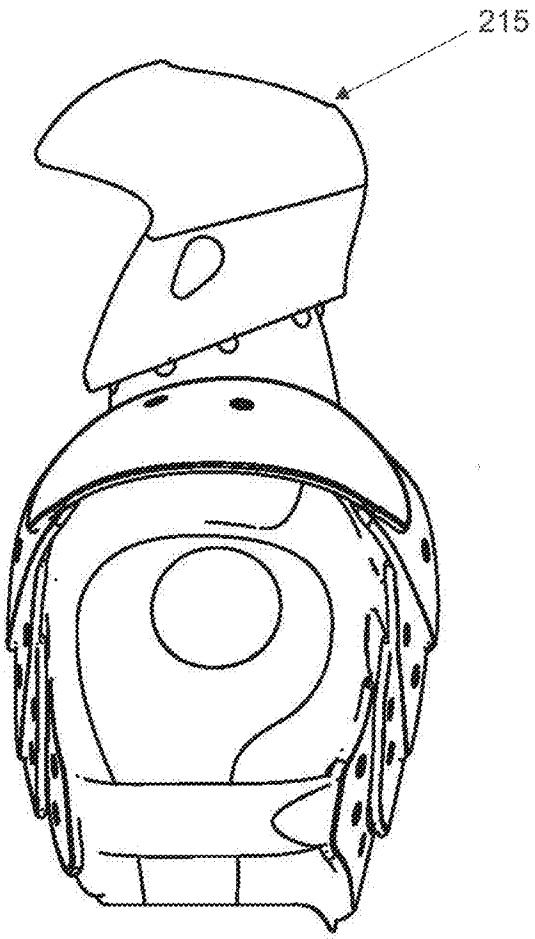
Figure 38H:
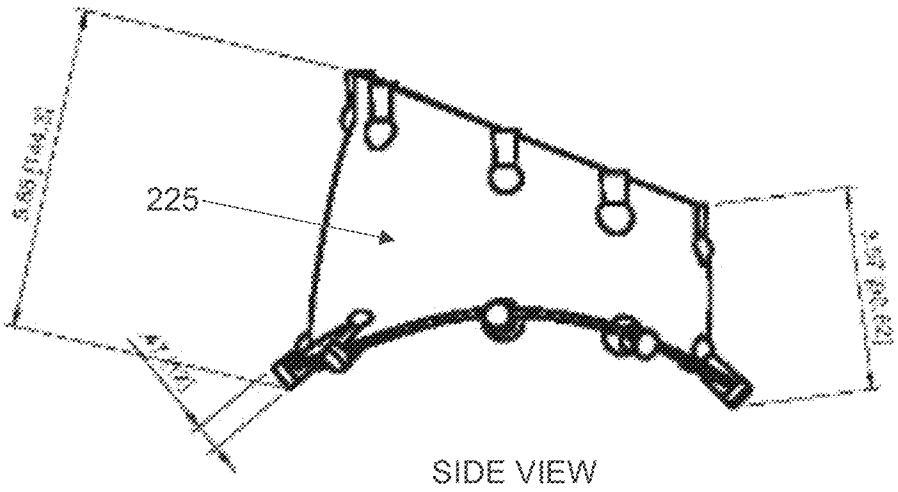
FIGS. 38G-38S are schematic views showing further details of the novel fluid-based protective neck bladder of the novel system of FIGS. 27-29.
Figure 38G:
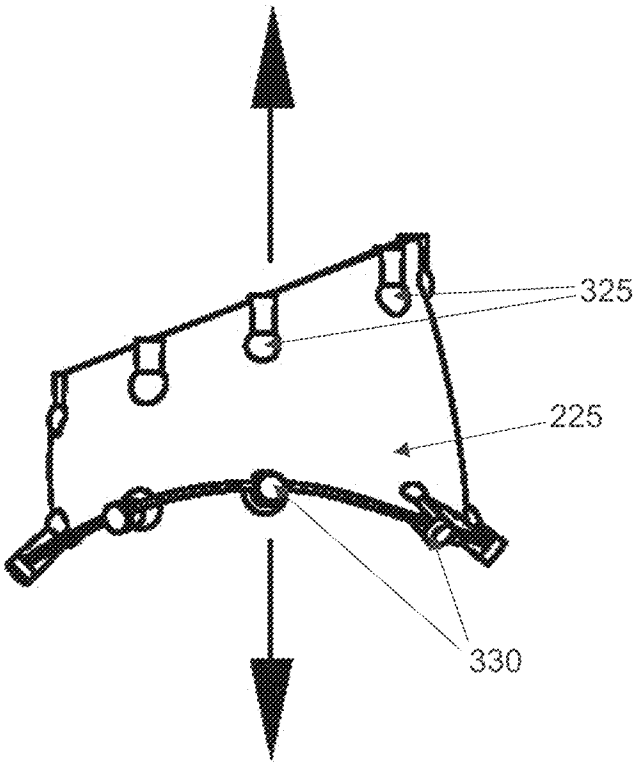
Figure 38J:
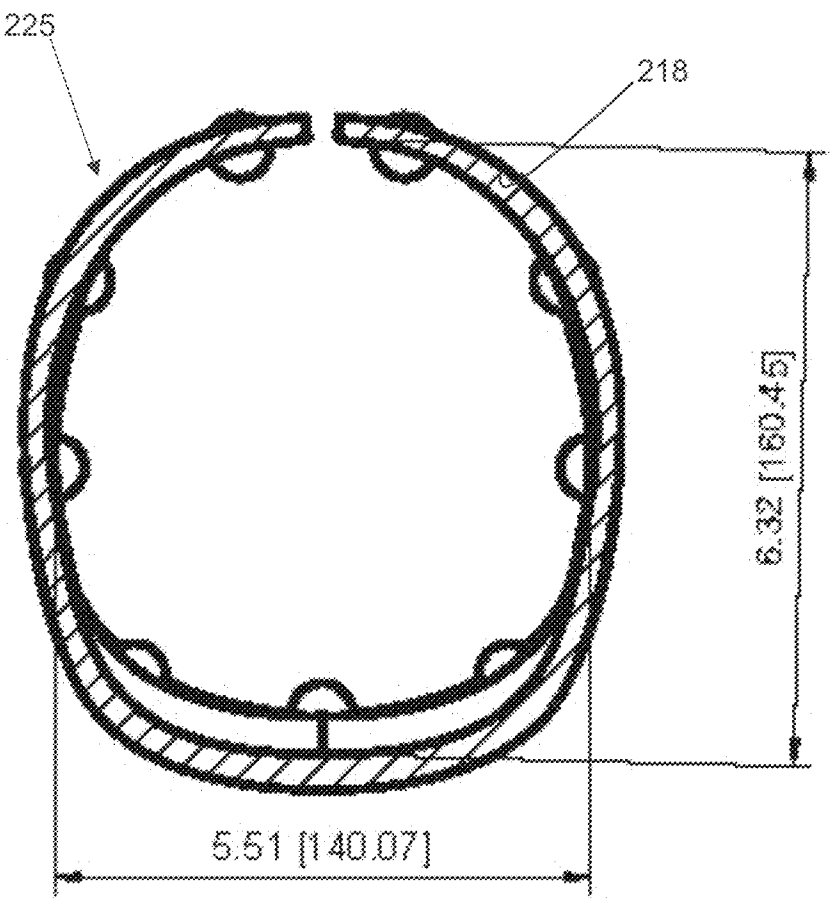
Figure 38I:
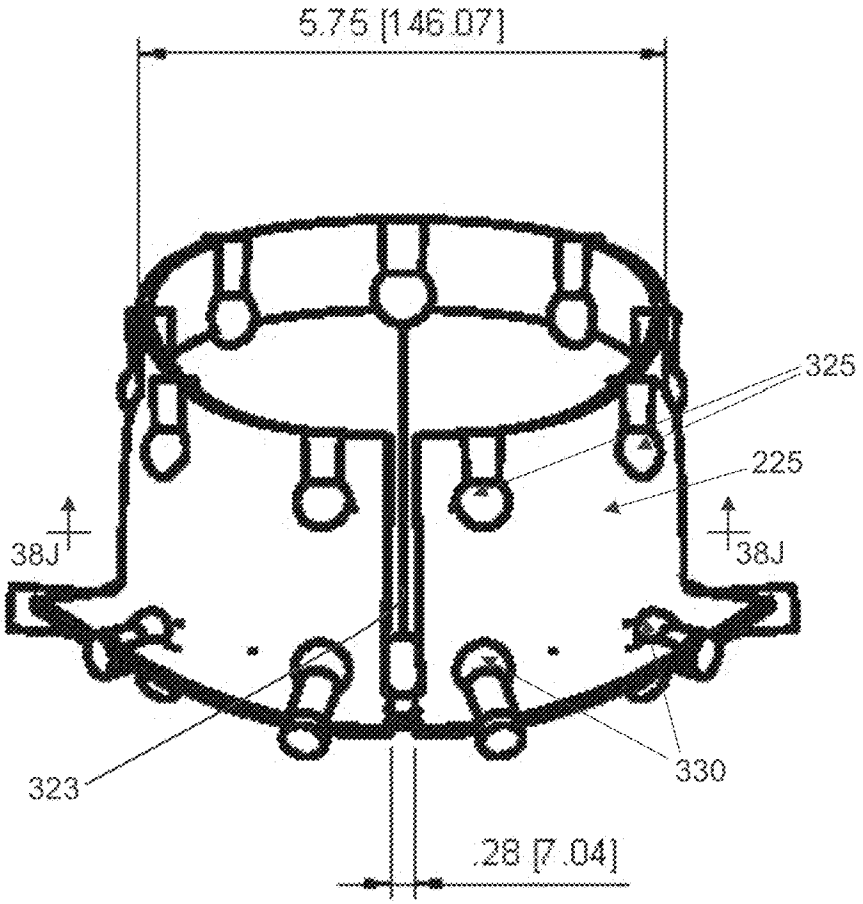
Figure 38L:
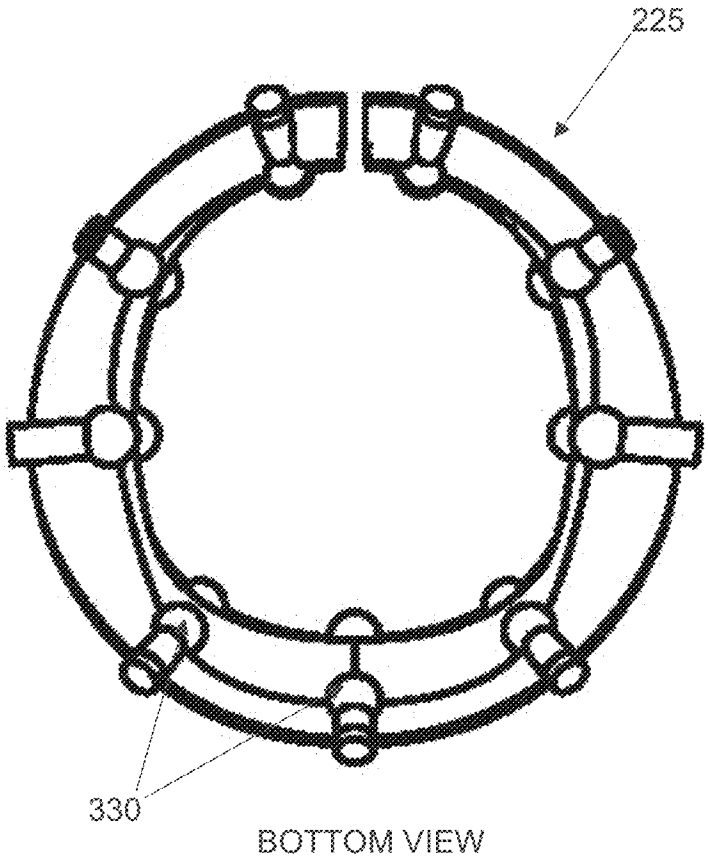
Figure 38K:
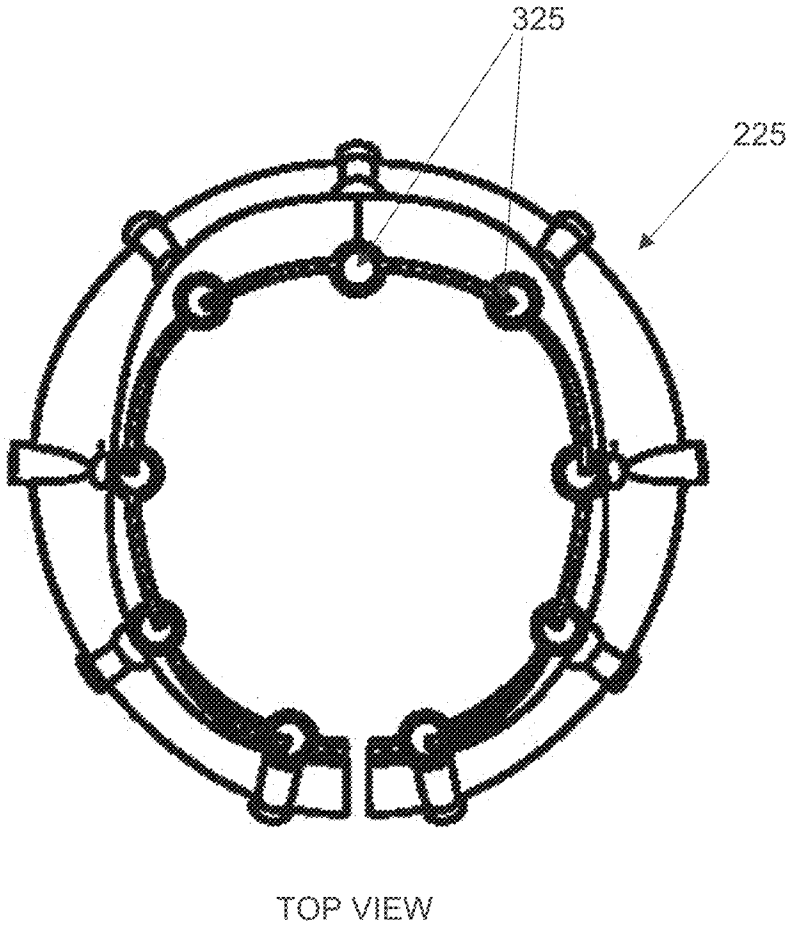
Figure 38N:
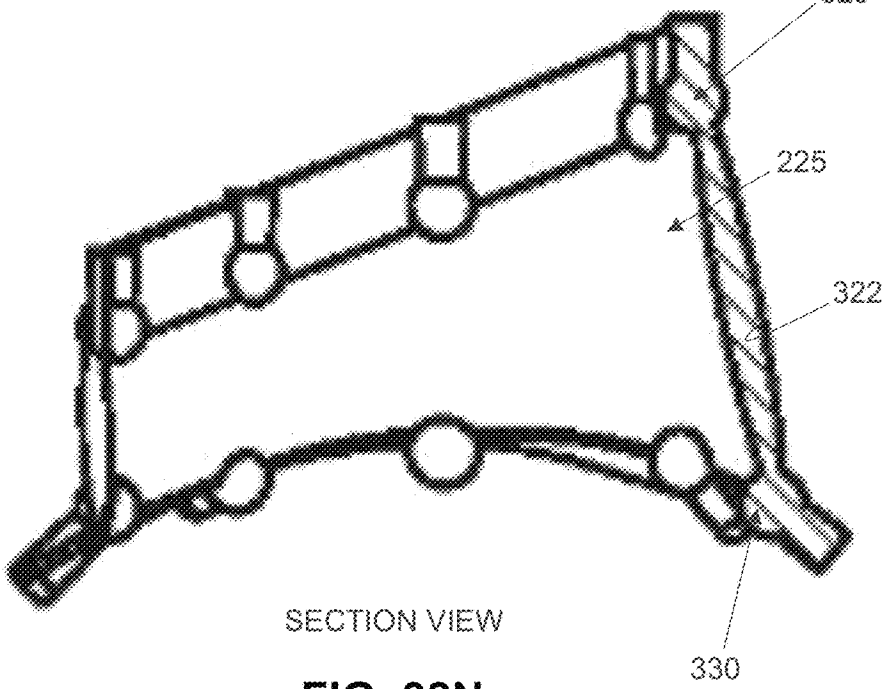
Figure 38M:
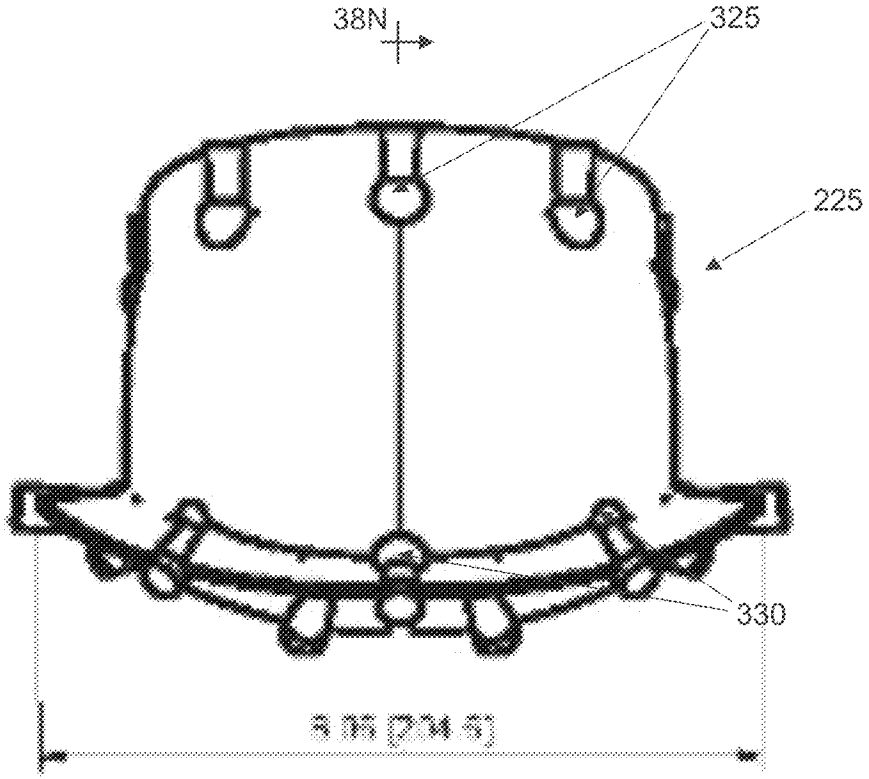
Figure 38P:
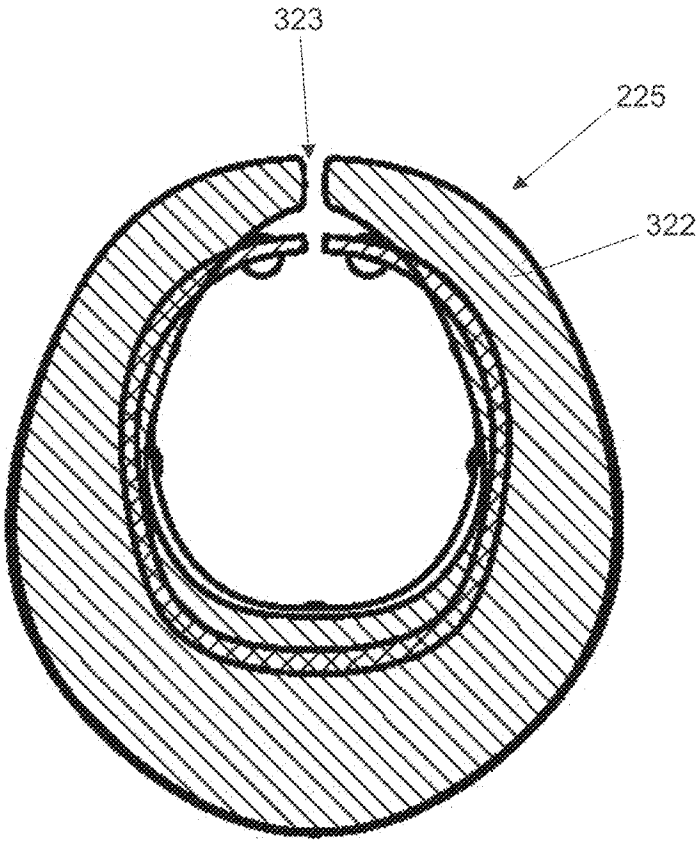
Figure 38O:
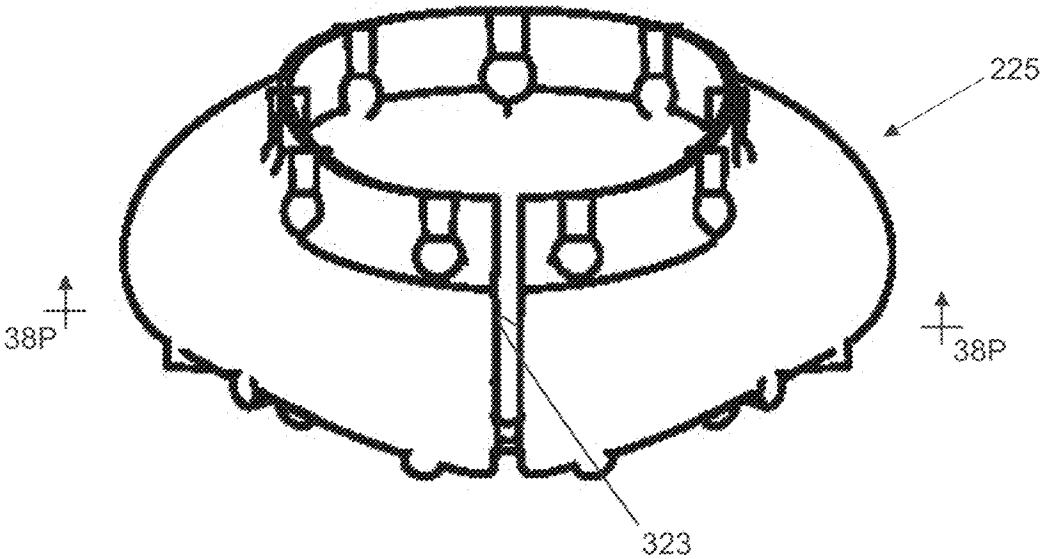
Figure 38R:
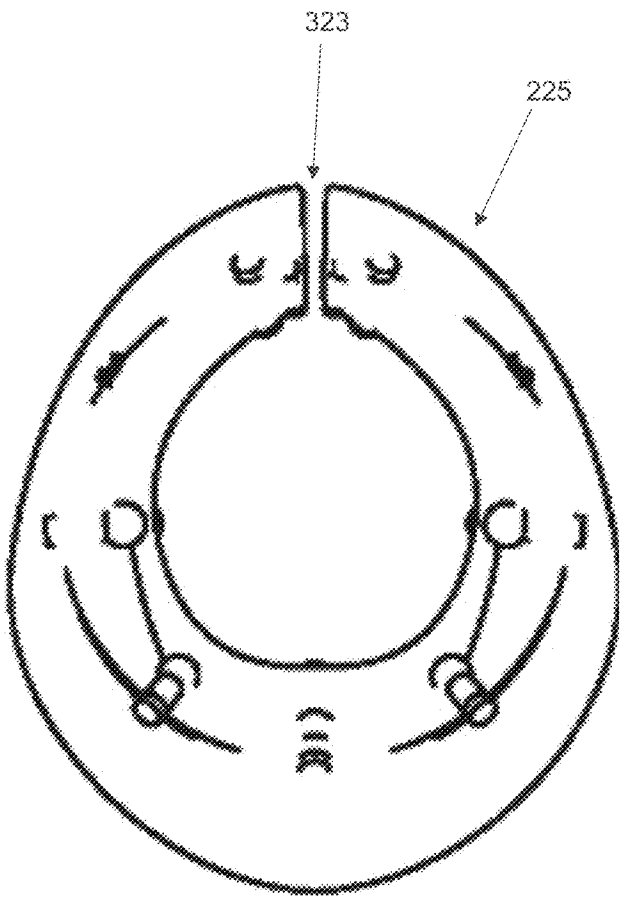
Figure 38Q:
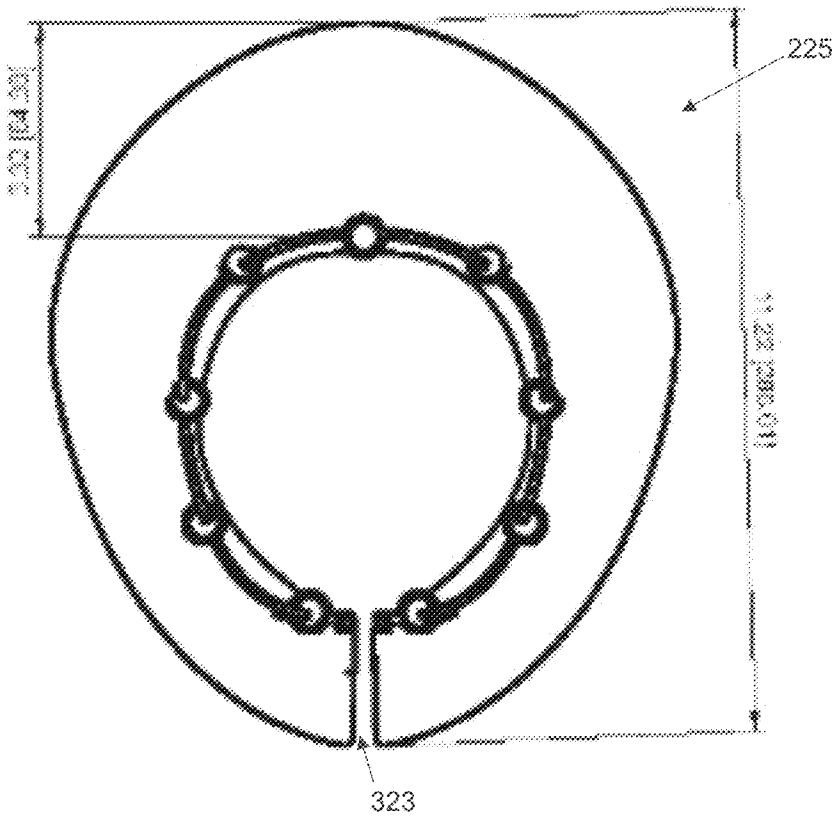
Figure 38S:
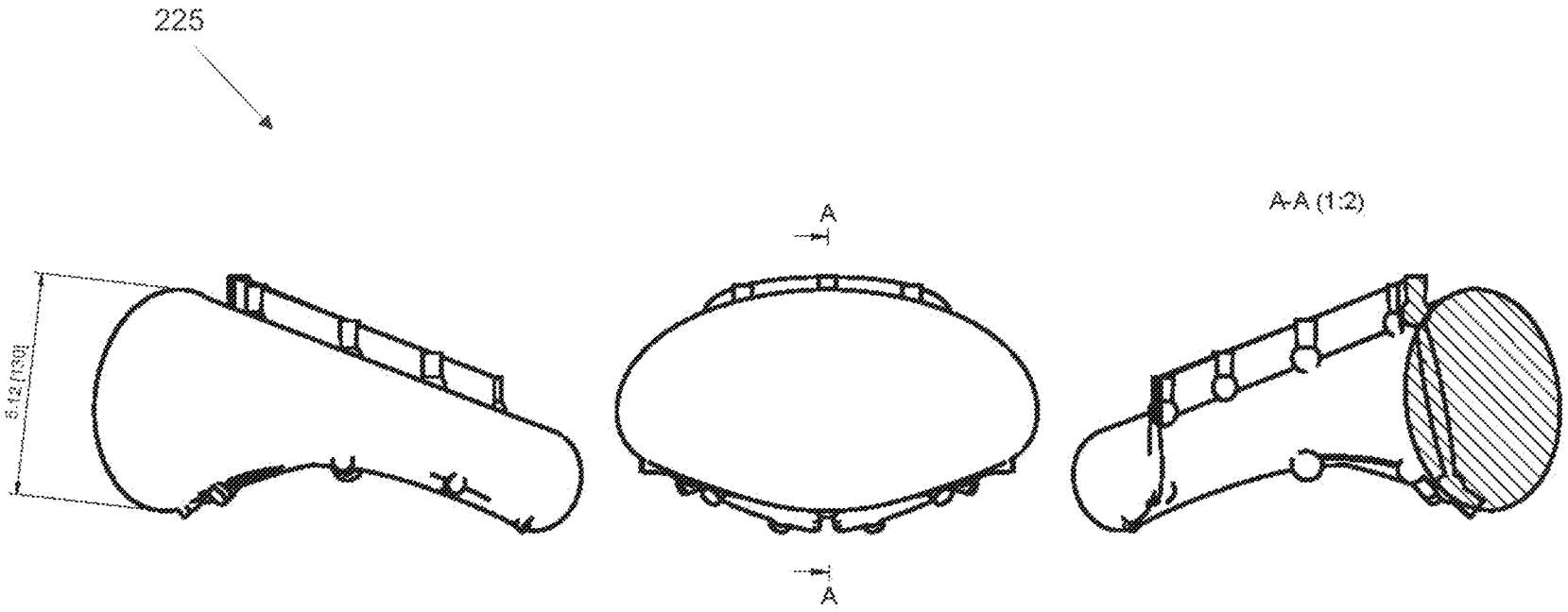
Figure 38T:
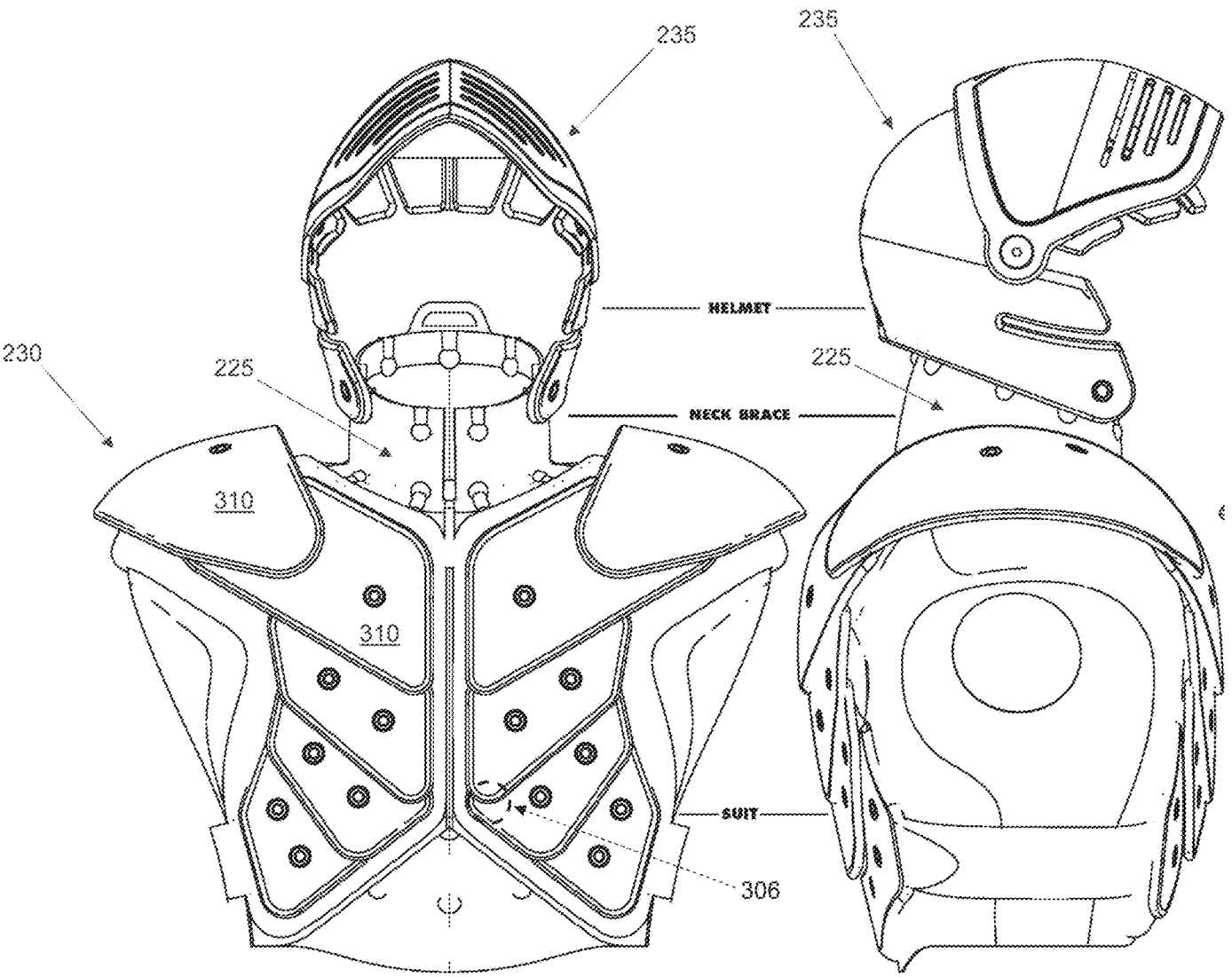
FIGS. 38T-38Z and 39-50 are schematic views showing further details of the novel helmet, the novel fluid-based protective neck bladder and the novel protective outer vest covering of the novel system of FIGS. 27-29.
Figure 38U:
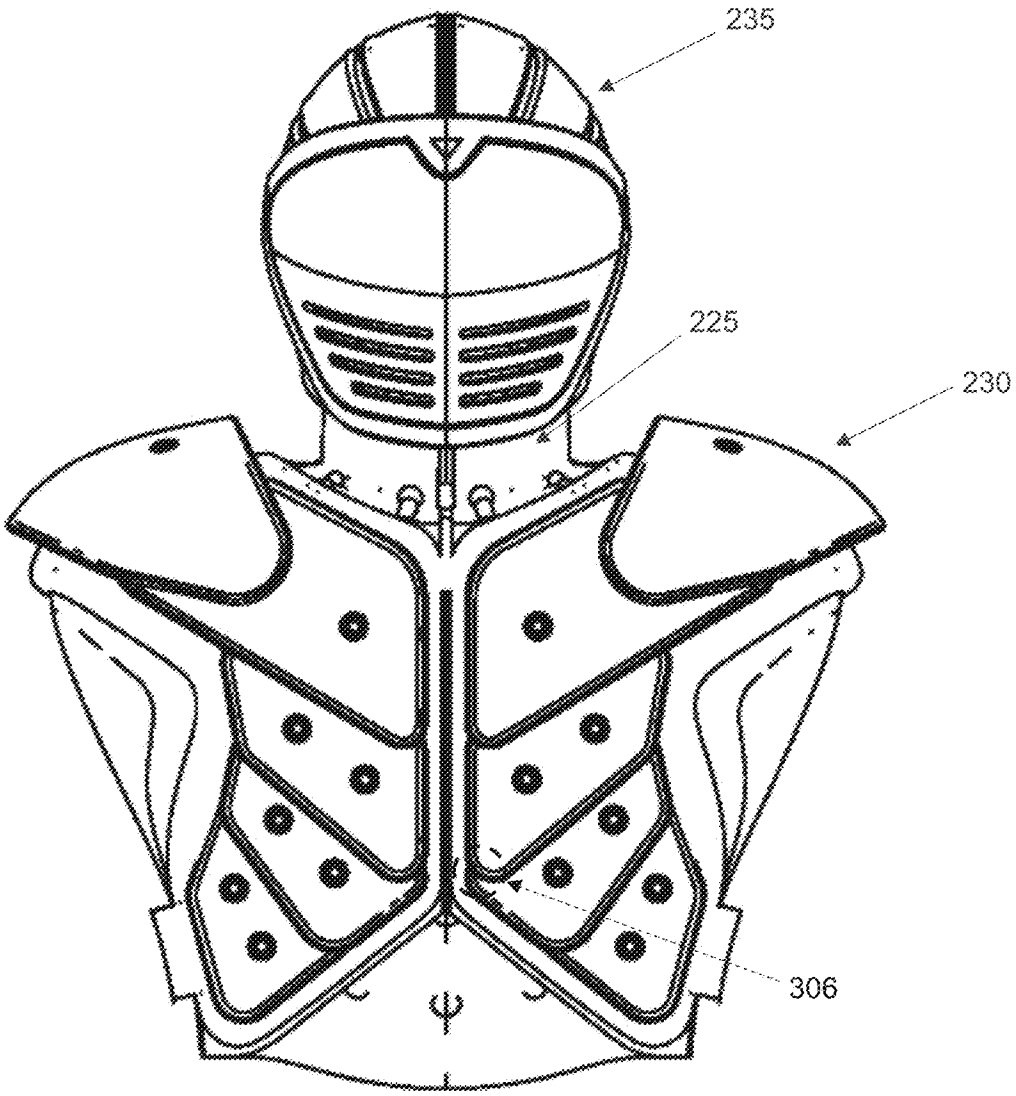
Figure 38V:
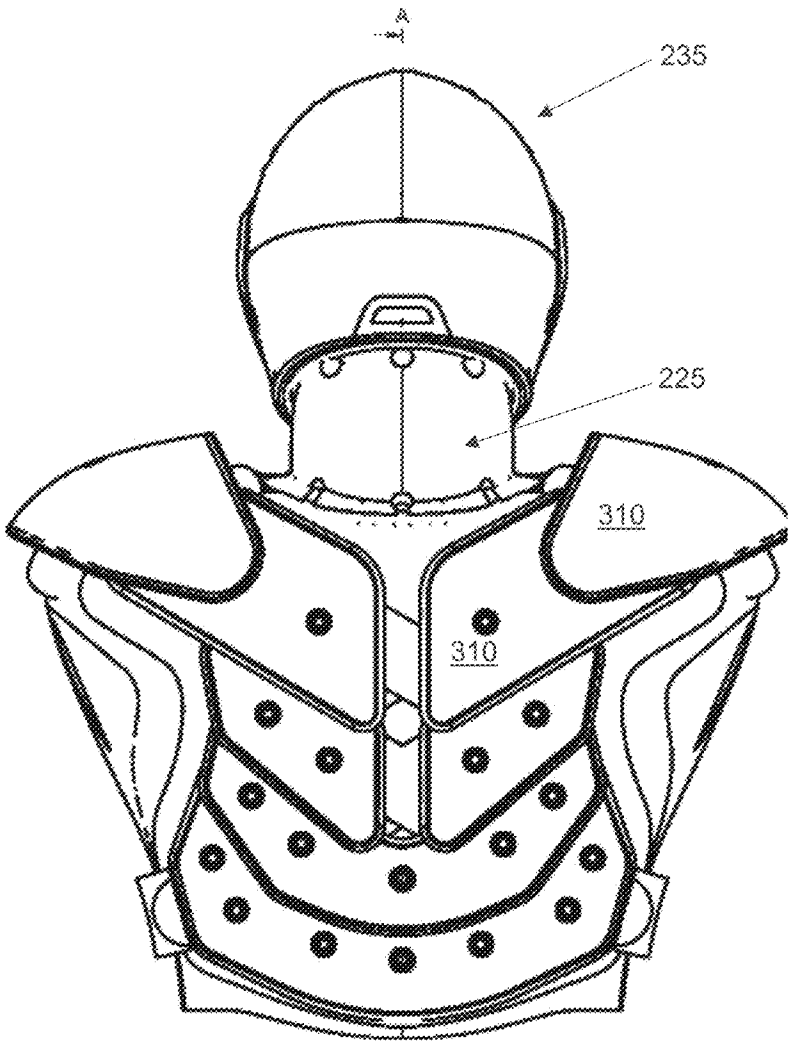
Figure 38W:
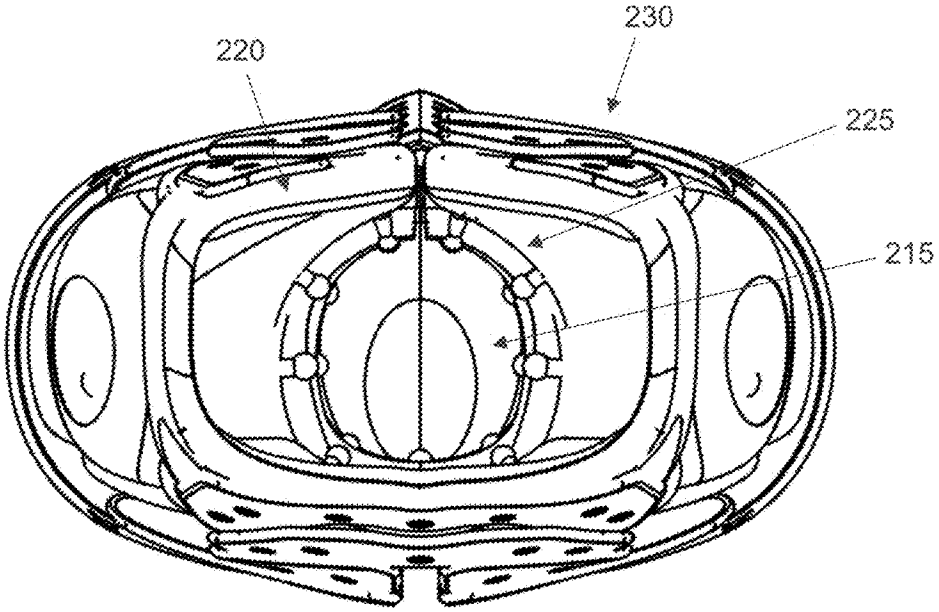
Figure 38X:
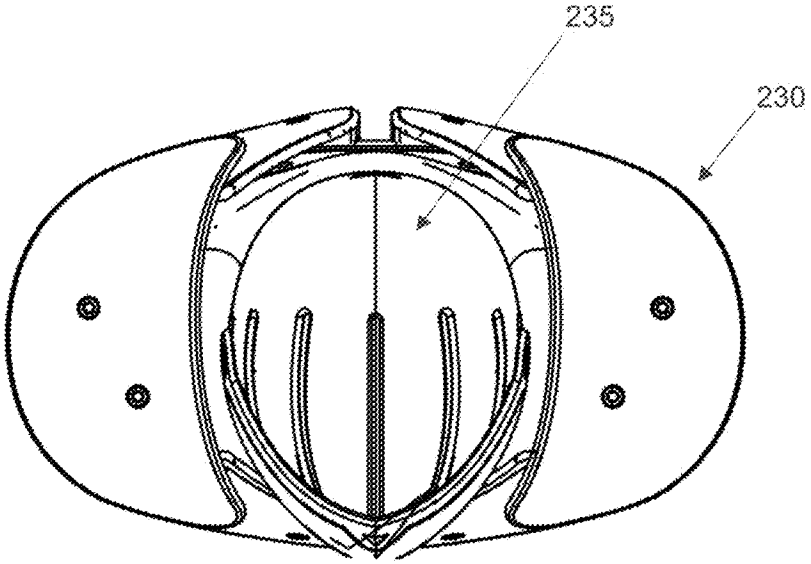
Figure 38Z:
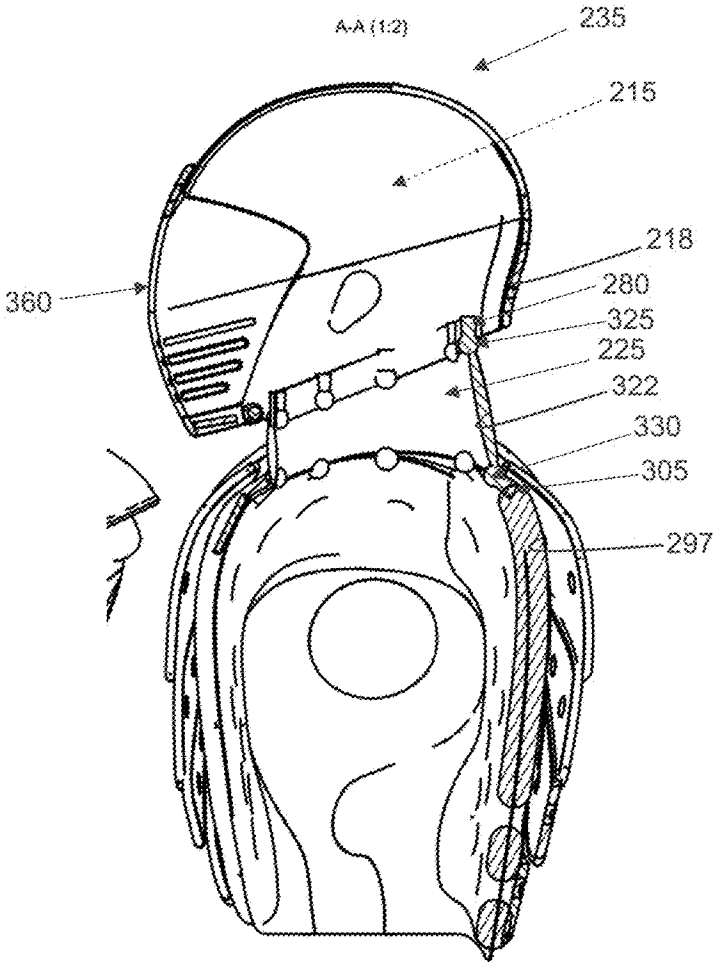
Figure 38Y:
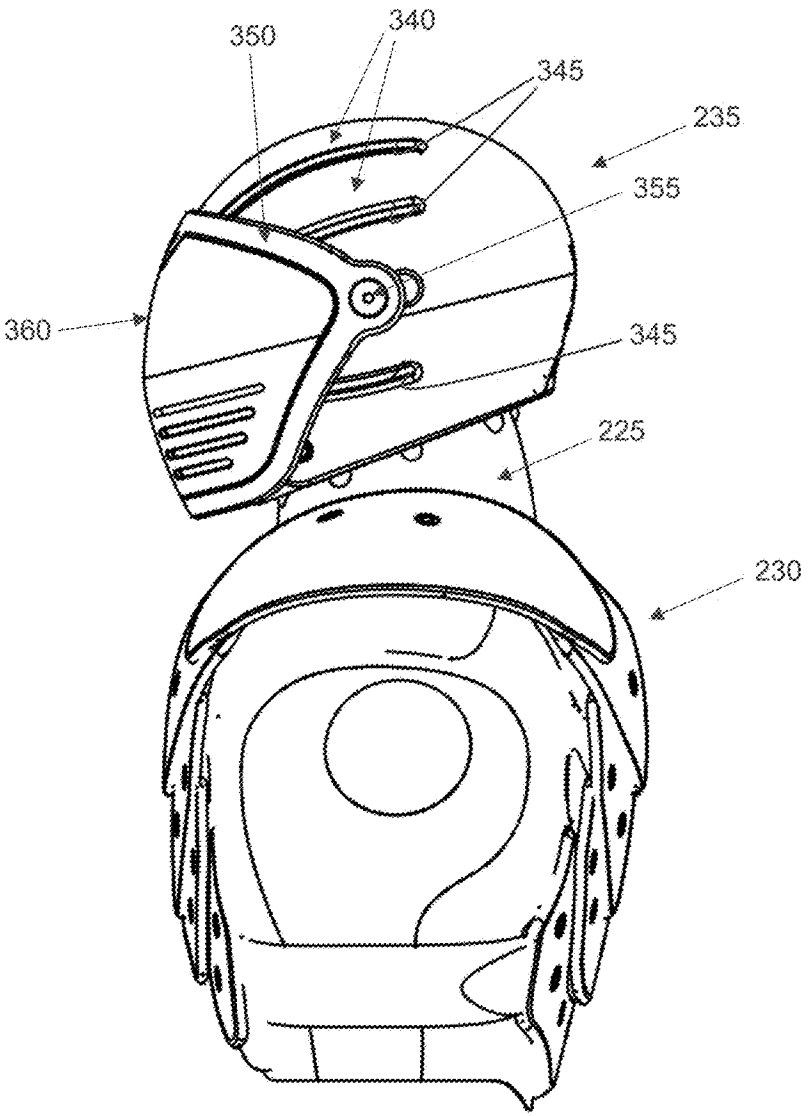
Figure 39:
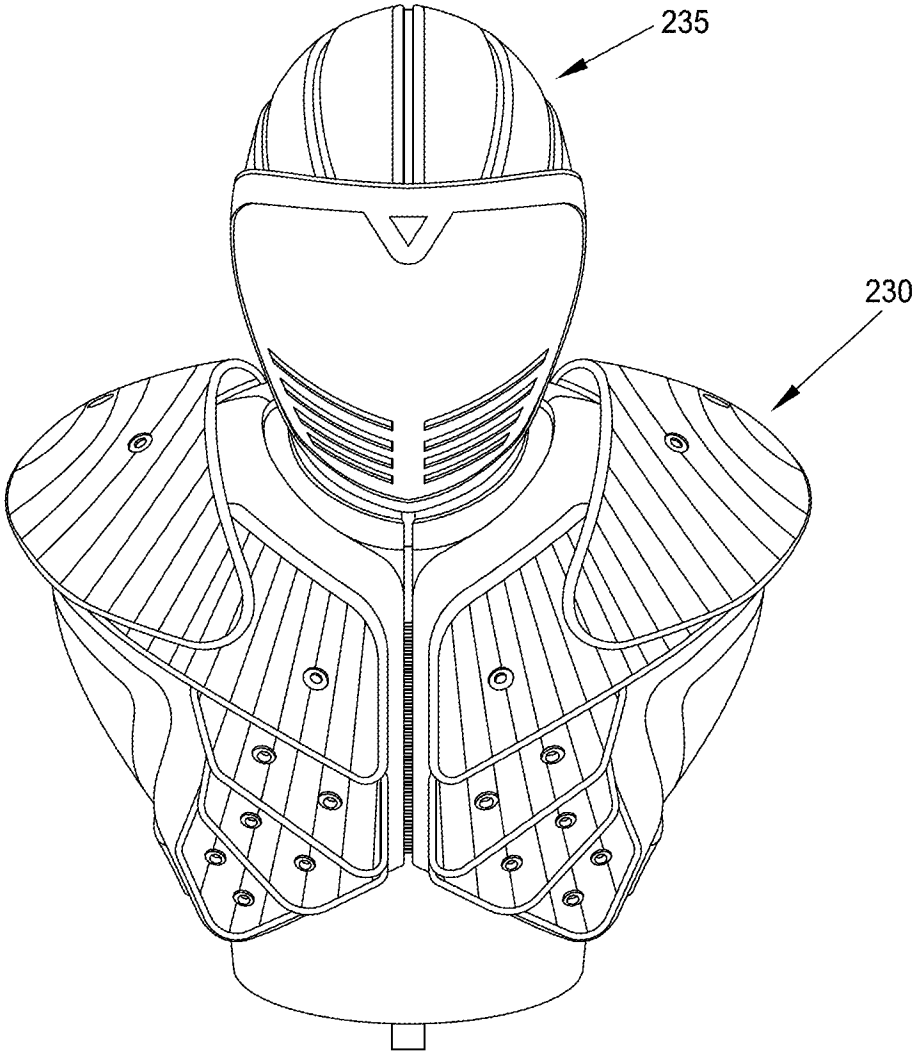
Figure 40:
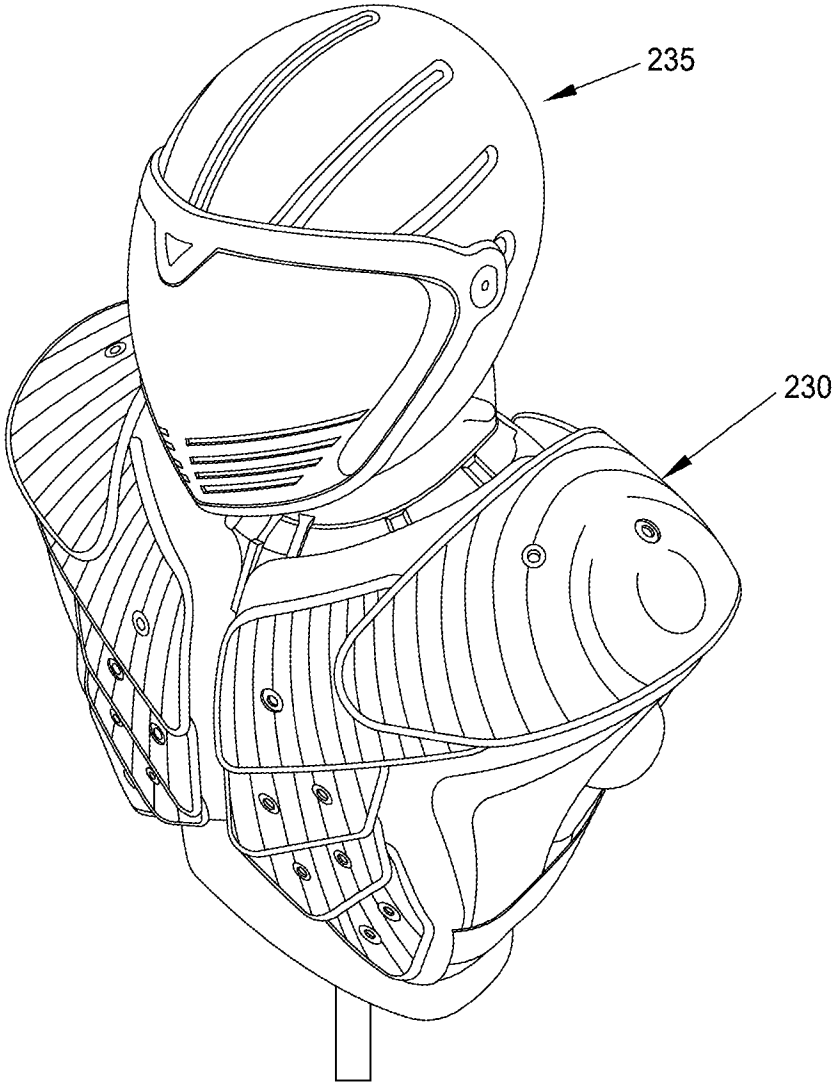
Figure 41:
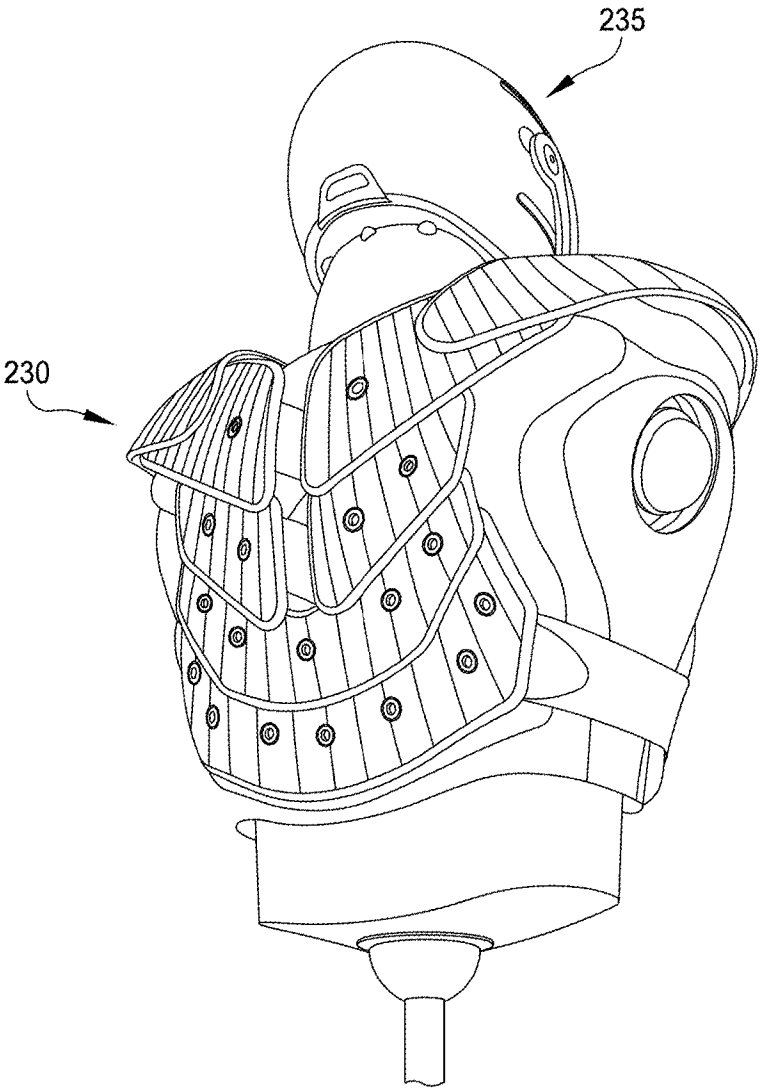

In another form of the invention, compressive hood 240 may be connected to (or formed integral with) the other elements of compressive base layer 210 so as to form one single base layer piece and chin-strap 245 may be omitted (FIG. 30A).

Compressive base layer 210 also preferably comprises a compressive top 250 configured to fit over and cover the abdomen, chest and shoulders of the wearer so as to make a close fit thereto. If desired, compressive top 250 may comprise an opening 255 (e.g., a full-length or partial-length front zipper, buttons, etc.) for facilitating the donning of compressive top 250. Compressive top 250 is shown as a "short-sleeved" top in FIG. 30, however, it should be appreciated that, if desired, compressive top 250 may comprise "long sleeves" (i.e., sleeves that extend to the wrist of the wearer) or may be configured to be sleeveless.

In one preferred form of the invention, compressive base layer 210 further comprises compressive pants 260, however, it should be appreciated that compressive pants 260 may be omitted if desired. Alternatively, compressive pants 260 may be joined with compressive top 250 to form a single, one-piece compressive base layer (not shown).

If desired, compressive base layer 210 may comprise a removable electronics module 261 (FIG. 30A) containing sensors to monitor one or more physiological conditions (e.g., body temperature, pulse, etc.), a wireless transceiver for wireless connection to a wireless network and a rechargeable battery pack. By way of example but not limitation, module 261 may be located over the top of the lower rib cage or abdomen of the wearer (see FIG. 30A).

2. Fluid-Based Head Bladder 215

Looking now at FIGS. 31, 32, 32A-32F, 33-36 and 36A, fluid-based head bladder 215 generally comprises a non-elastic material, e.g., heat-sealed thermoplastic polyurethane (TPU) or a silicone "sandwich", which is lined with a puncture-proof material (e.g., nylon, Kevlar™, etc.) enclosing a fluid cavity 218 that may be selectively filled with a fluid at a volumetric pressure above atmospheric pressure. When the term "fluid" is used in the foregoing description of novel system 205, it is preferably meant to refer to a gas (e.g., air), however, the term "fluid" may also refer to a liquid (e.g., water), a combination of liquids, a combination of gases, a combination of liquids and gases, etc.

Fluid-based head bladder 215 is configured to fit over compressive hood 240 so as to make a close fit therewith. Fluid-based head bladder 215 is shaped so as to have an anterior opening 265 for leaving the wearer's face substantially uncovered. In one preferred form of the invention, fluid-based head bladder 215 further comprises a superior opening 270 (FIG. 34) passing through fluid-based head bladder 215 and disposed approximately at the crown of the skull when fluid-based head bladder is worn by the wearer. Superior opening 270 permits efficient heat transfer so as to prevent hyperthermia. Fluid-based head bladder 215 may, additionally, contain an accelerometer or other apparatus for measuring movement of the wearer's head, as will hereinafter be discussed in further detail.

Additionally, fluid-based head bladder 215 preferably comprises laterally-disposed, diametrically-opposed openings 275 (FIG. 35) aligned with the ears of the wearer (i.e., so as to permit sound to pass through fluid-based head bladder 215 such that it can be heard by the wearer). It will be appreciated that openings 265, 270 and 275 help to give a limiting form to fluid-based head bladder 215 (and hence, to cavity 218 of fluid-based head bladder 215), whereby to effect efficient movement of fluid from cavity 218 of fluid-based head bladder 215 into fluid-based neck bladder 225 during compression of fluid-based head bladder 215, as will hereinafter be discussed in further detail.

If desired, fluid-based head bladder 215 may comprise a plurality of internal barriers (not shown) configured to segregate fluid cavity 218 of fluid-based head bladder 215 into a plurality of fluidically-connected fluid cavities, wherein each fluid cavity fluidically connects to fluid-based neck bladder 225, as will hereinafter be discussed in further detail.

Fluid-based head bladder 215 also comprises a plurality of valves 280 (FIG. 29) configured to fluidically connect fluid cavity 218 of fluid-based head bladder 215 to complementary valves disposed on fluid-based neck bladder 225, whereby to permit fluid to flow between fluid-based head bladder 215 and fluid-based neck bladder 225, as will hereinafter be discussed in further detail. Valves 280 are preferably disposed about the circumference of the inferior aspect of fluid-based head bladder 215 (i.e., the inferior surface of the fluid-based head bladder 215 disposed in the region of the wearer's neck when fluid-based head bladder 215 is worn by the wearer). It should be appreciated that valves 280 may be symmetrically spaced and disposed about the circumference of the inferior aspect of fluid-based head bladder 215, or valves 280 may be asymmetrically spaced and disposed about the circumference of the inferior aspect of fluid-based head bladder 215.

3. Fluid-Based Vest 220

Still looking at FIGS. 31, 32, 32A-32F, 33-36 and 36A, fluid-based vest 220 generally comprises a non-elastic material, e.g., heat-sealed thermoplastic polyurethane (TPU) or a silicone "sandwich", which is lined with a puncture-proof material (e.g., nylon, Kevlar™, etc.). Fluid-based vest 220 preferably comprises a right-side fluid bladder 285, a left-side fluid bladder 290 and a rear fluid bladder 295.

Right-side fluid bladder 285 is preferably configured to generally cover the right chest, right upper abdomen and right shoulder of the wearer. Left-side fluid bladder 290 is configured to generally cover the left chest, left upper abdomen and left shoulder of the wearer. Rear fluid bladder 295 is configured to generally cover the back of the wearer. Right-side fluid bladder 285 comprises an internal fluid cavity 287 which may be selectively filled with a fluid (e.g., air, water, etc.) at a volumetric pressure above atmospheric pressure, as will hereinafter be discussed in further detail. Left-side fluid bladder 290 comprises an internal fluid cavity 293 which may be selectively filled with a fluid (e.g., air, water, etc.) at a volumetric pressure above atmospheric pressure, as will hereinafter be discussed in further detail. Rear fluid bladder 295 comprises an internal fluid cavity 297 which may be selectively filled with a fluid (e.g., air, water, etc.) at a volumetric pressure above atmospheric pressure, as will hereinafter be discussed in further detail.

In one preferred form of the present invention, right-side fluid bladder 285, left-side fluid bladder 290 and rear fluid bladder 295 comprise a plurality of through-holes 300 passing therethrough, with through-holes 300 being fluidically isolated from the fluid cavities 287, 293, 297 of right-side fluid bladder 285, left-side fluid bladder 290 and rear fluid bladder 295, respectively. Through-holes 300 are sized to receive fasteners, whereby to connect elements of protective outer vest 230 thereto, as will hereinafter be discussed in further detail. It will further be appreciated that the provision of through-holes 300 helps to form a limiting shape to the cavities of fluid bladders 285, 290, 295 (and hence, fluid cavities 287, 293, 297) of fluid-based vest 220. As a result, fluid bladders 285, 290, 295 (and hence, fluid-based vest 220) assume predetermined shapes, such that when fluid-based vest 220 is filled with a fluid (e.g., air), the fluid is evenly distributed throughout the interior of the fluid bladders 285, 290, 295. This allows the fluid bladders 285, 290, 295 to have a comparatively constant, small width dimension relative to their overall areas, whereby to avoid "bubbles"/projections, and whereby to facilitate efficient transfer of fluid from bladders 285, 290, 295 to fluid-based neck bladder 225 when bladders 285, 290, 295 are compressed against the body of a wearer, as will hereinafter be discussed in further detail.

Figure 42:
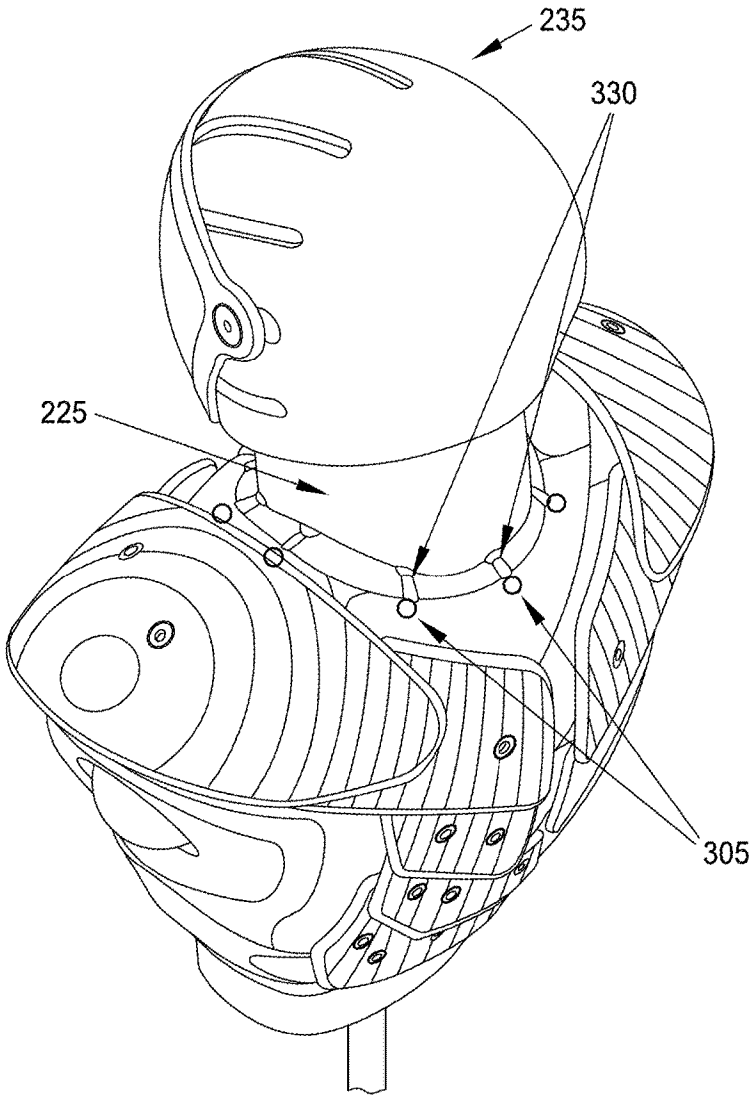
Figure 43:
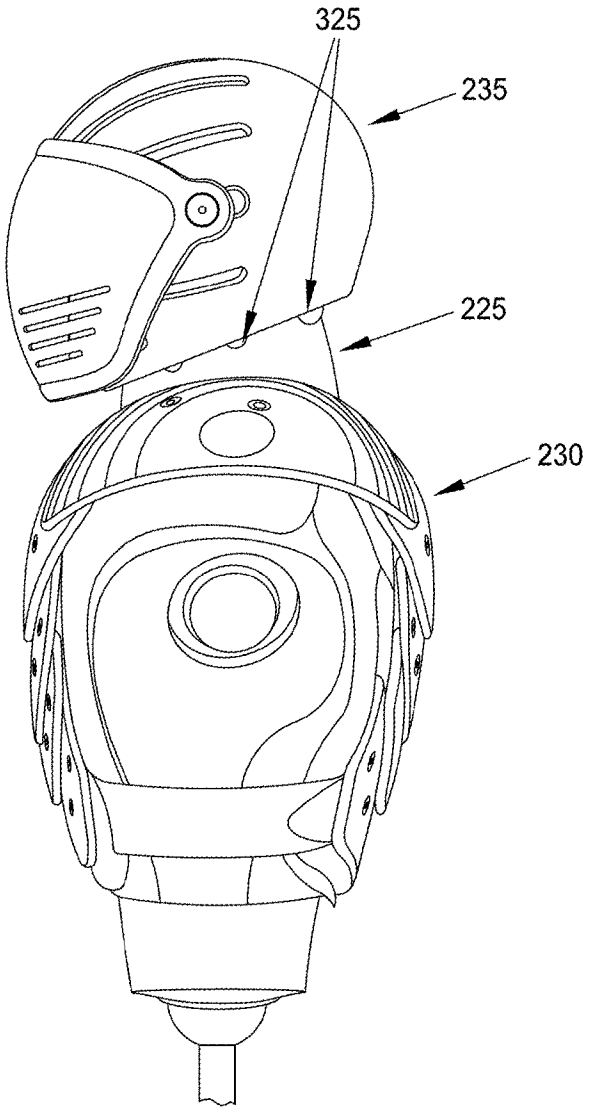
Figure 44:
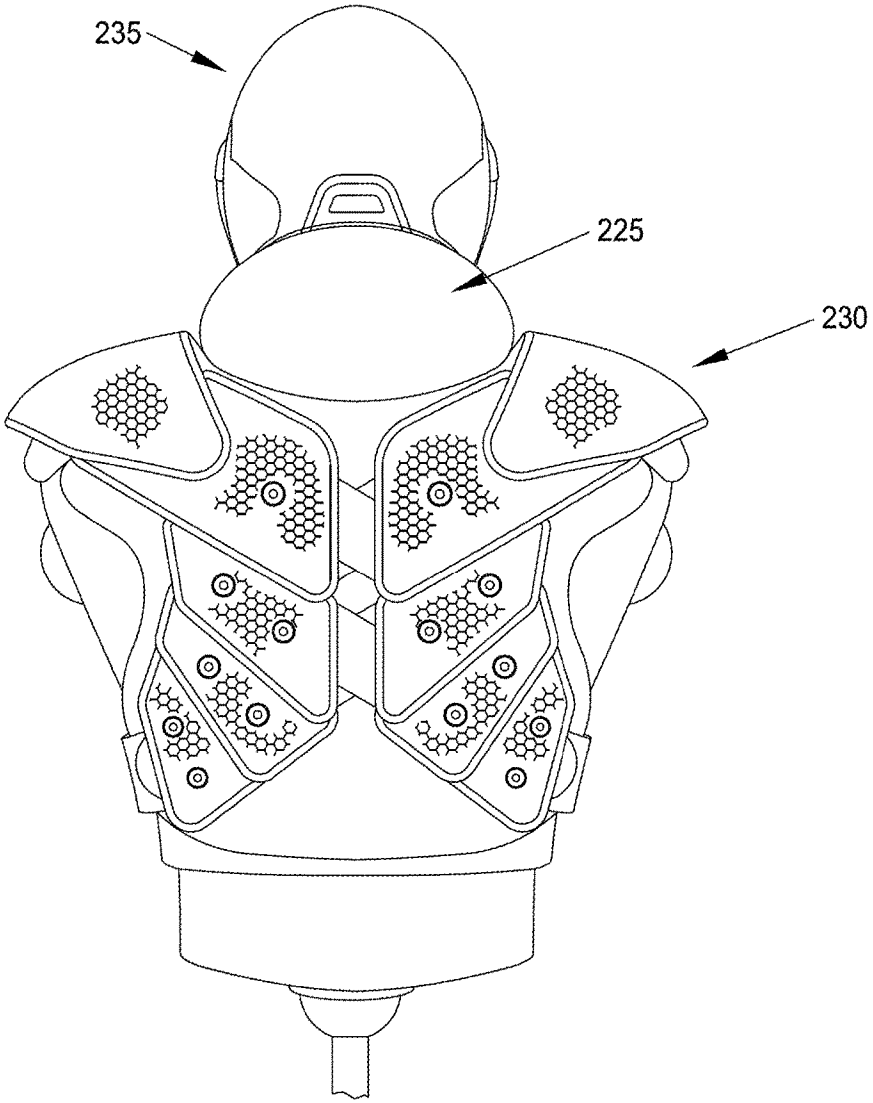
Figure 45:
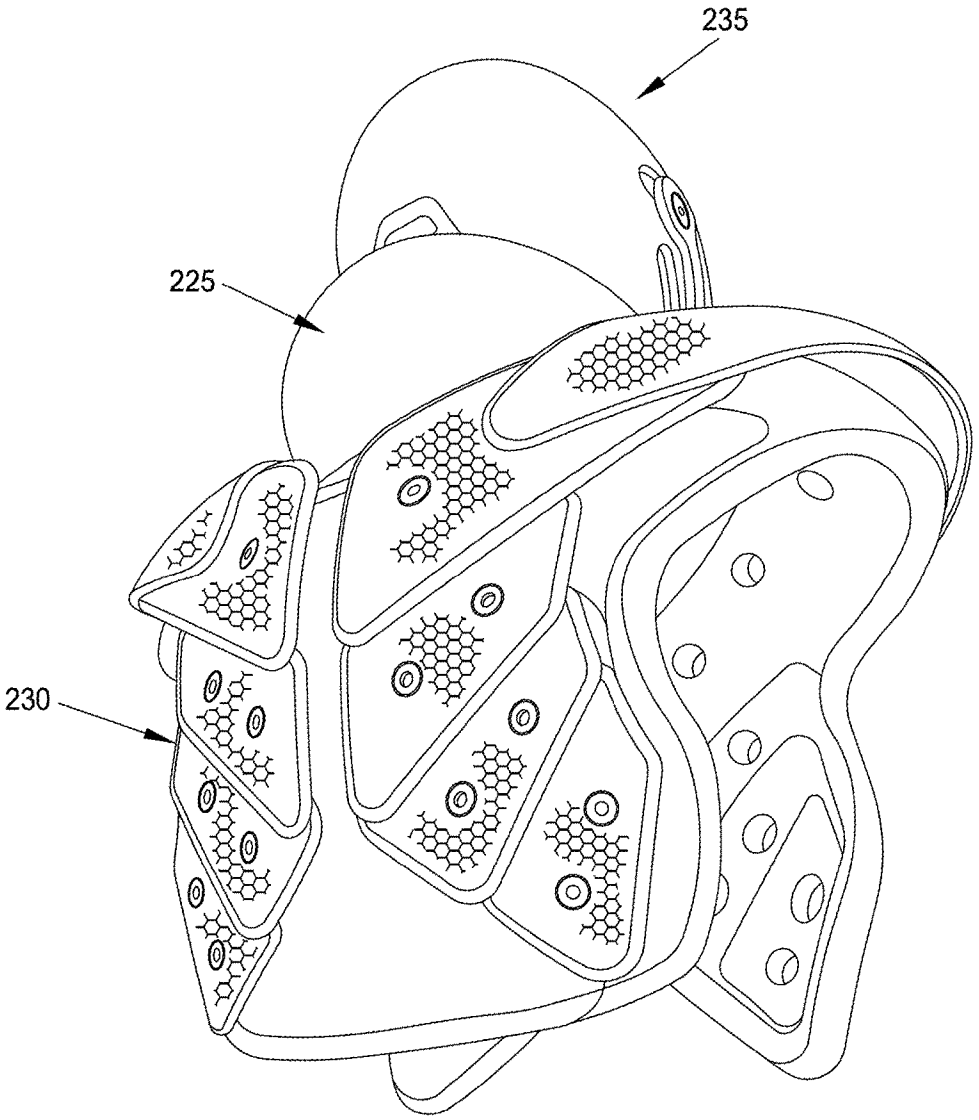
Figure 46:
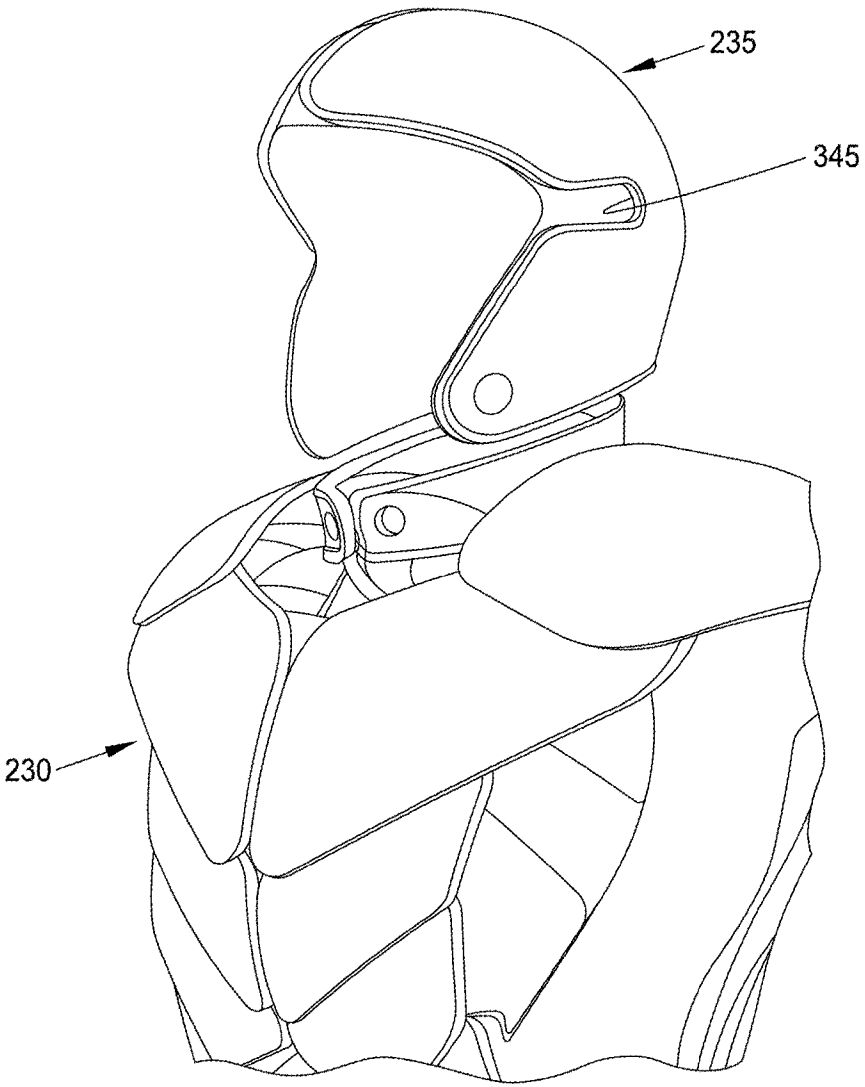
Figure 47:
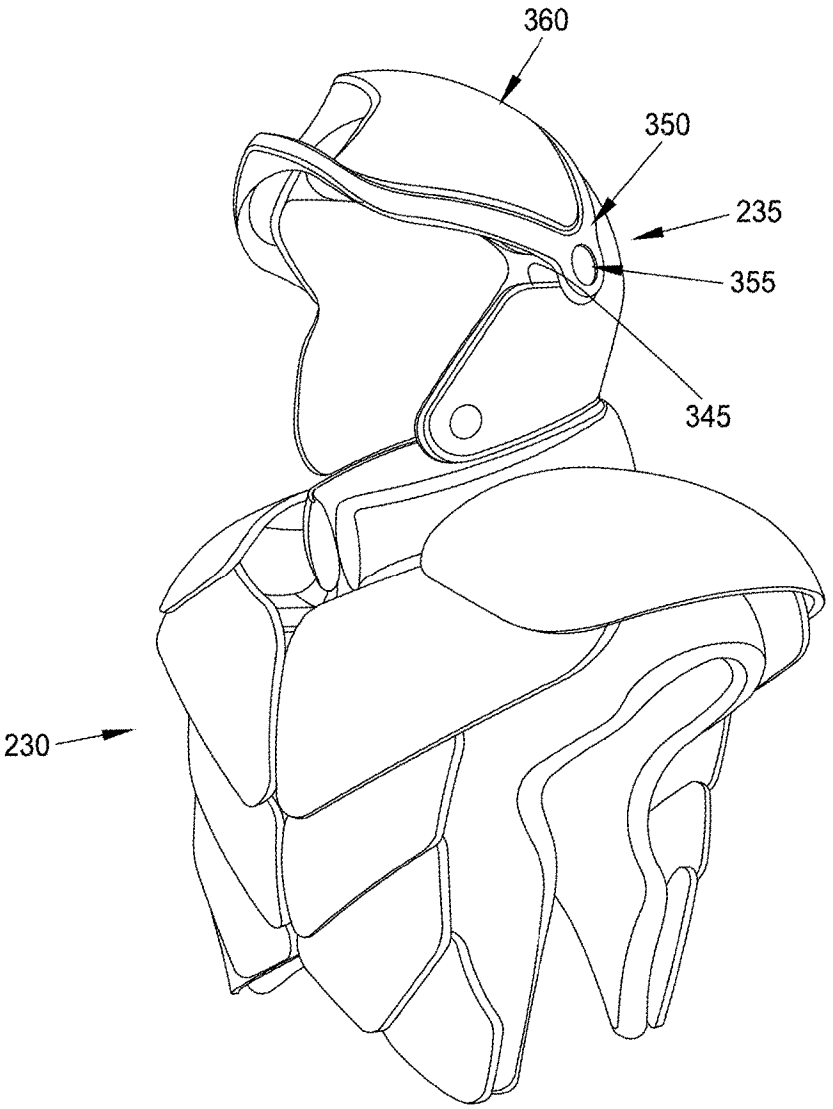
Figure 48:
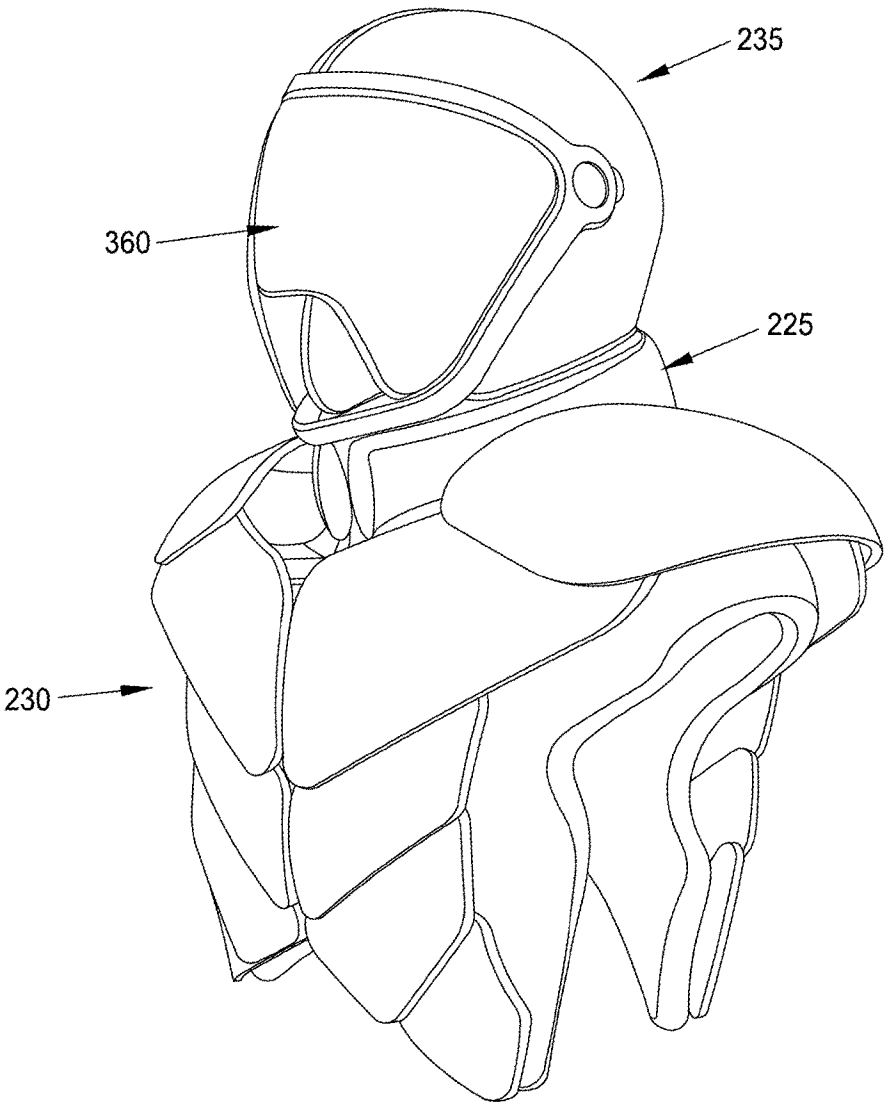
Figure 49:
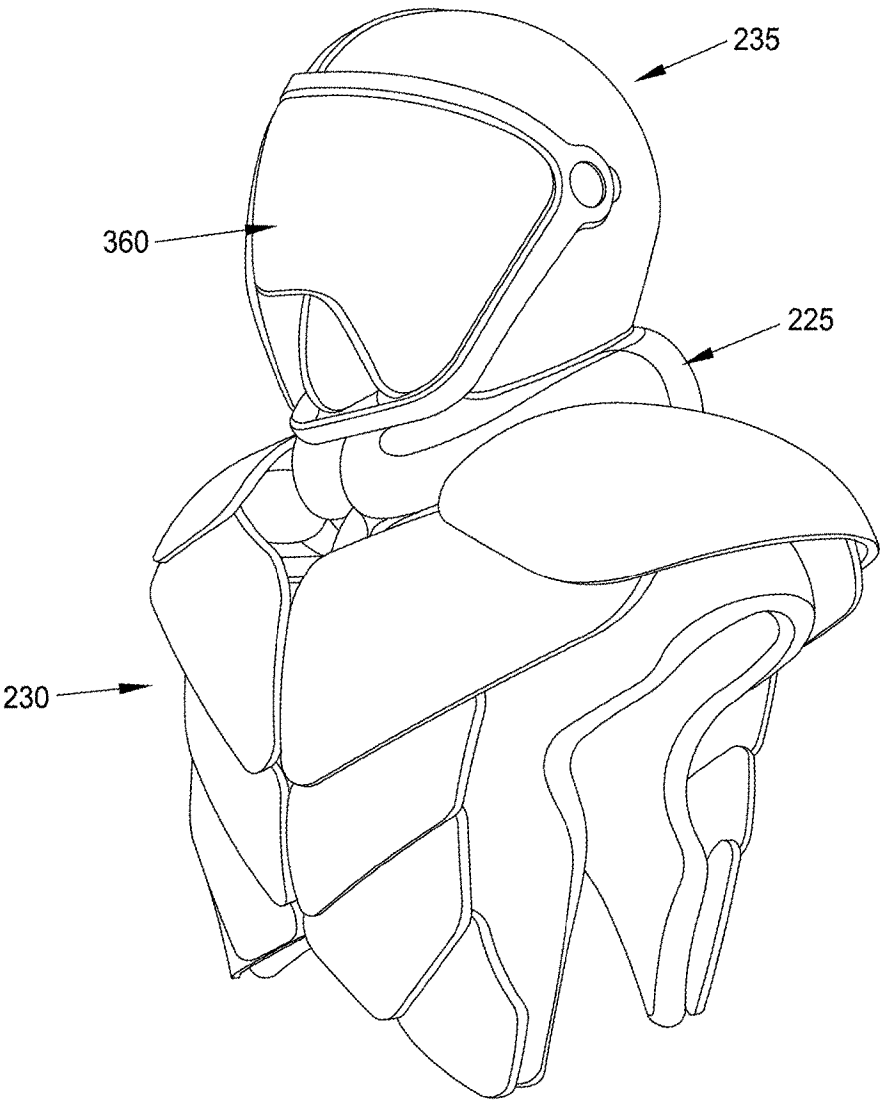

Each of right-side fluid bladder 285, left-side fluid bladder 290 and rear fluid bladder 295 comprises one or more valves 305 disposed about the superior surface of the fluid bladders in the region of the wearer's neck (FIG. 42). Valves 305 are configured to fluidically connect to counterpart valves 330 formed in the inferior aspect of fluid-based neck bladder 225 so as to permit fluid to flow between bladders 285, 290, 295 and fluid-based neck bladder 225, as will hereinafter be discussed in further detail.

If desired, one or more of bladders 285, 290, 295 may comprise an input/output valve 306 for rapidly infusing or removing fluid from novel system 205. In one preferred form the invention, one or both of bladders 285, 290 comprises an input/output valve 306 on the anterior, inferior aspect of one or both of bladders 285, 290, whereby to permit an external fluid source (not shown) to be fluidically connected to input/output valve 306 so as to deliver or remove fluid.

It will be appreciated that when novel system 205 is assembled, fluid-based head bladder 215, fluid-based neck bladder 225 and fluid-based vest 220 are all fluidically connected together, and hence fluid introduced into, or removed from, an input/output valve 306 of one or more of bladders 285, 290, 295 of fluid-based vest 220 may enter into, or be removed from, all of the fluid bladders of novel system 205 via a single connection to an external source.

Bladders 285, 290, 295 are preferably connected together via straps and/or webbing, whereby to facilitate the wearer donning fluid-based vest 220.

4. Protective Outer Vest Covering 230

Looking next at FIGS. 37, 38 and 38A-38F and 38T-38Z and 39-49, protective outer vest covering 230 generally comprises a plurality of rigid, lightweight (e.g., polycarbonate with hexagonal structural fill) plates 310.

Plates 310 are configured to be attached to fluid-based vest 220 by passing one or more fasteners 315 through through-holes 320 formed in plates 310 and then through through-holes 300 formed in bladders 285, 290, 295. To this end, one or both of through-holes 300, 320 may be threaded in order to receive a threaded fastener. Alternatively, a nut or other fastening device may be provided on the inner surface of fluid-based vest 220 aligned with each of through-holes 300 (or recessed therein) so as to receive fasteners 310. Alternatively and/or additionally, if desired, plates 310 may be attached to nylon straps to facilitate wearing of protective outer vest 230 using fasteners 315. Alternatively and/or additionally, if desired, fasteners 310 may be configured to connect to compressive base layer 210 in a manner that will be appreciated by one of ordinary skill in the art in view of the present disclosure.

Plates 310 and through-holes 300, 320 are preferably arranged such that plates 310 form an overlapping protective structure. As a result of this construction, when a force is directed upon the outer surface of one or more plates 310 in the direction of the wearer's body, the plates are collectively driven toward the body of the wearer, whereby to compress one or more of bladders 285, 290, 295 (and hence, fluid cavities 287, 293, 297) of fluid-based vest 220 between protective outer vest 230 and compressive base layer 210. This compressive action forces fluid contained in fluid cavities 287, 293, 297 out of fluid-based vest 220 via valves 305, and into fluid-based neck bladder 225, as will hereinafter be discussed in further detail.

5. Fluid-Based Neck Bladder 225

Looking now at FIGS. 27-29 and 38G-38S, fluid-based neck bladder 225 comprises a generally "horse-shoe" shaped hollow structure enclosing a fluid cavity 322 (FIG. 29). Fluid-based neck bladder 225 is preferably formed out an elastomeric material (e.g., natural rubber balloon latex), such that fluid-based neck bladder 225 can quickly change shape (e.g., inflate/deflate) and assume a much larger volume when fluid flows into the internal cavity of fluid-based neck bladder 225, as will hereinafter be discussed in further detail. Fluid-based neck bladder 225 preferably comprises an open gap 323 (FIG. 38) aligned with the wearer's throat area, whereby to permit the wearer to breathe normally even when fluid-based neck bladder 225 is in an inflated condition, as will hereinafter be discussed in further detail.

A plurality of valves 325 in fluid connection with fluid cavity 322 of fluid-based neck bladder 225 are arranged around the superior aspect of fluid-based neck bladder 225 for connecting to valves 280 of fluid-based head bladder 215, whereby to fluidically connect cavity 322 of fluid-based neck bladder 225 to cavity 218 of fluid-based head bladder 215. A plurality of valves 330 in fluid connection with fluid cavity 322 of fluid-based neck bladder 225 are arranged around the inferior aspect of fluid-based neck bladder 225 for connecting to valves 305 of bladders 285, 290, 295 of fluid-based vest 220, whereby to fluidically connect cavity 322 of fluid-based neck bladder 225 to cavities 287, 293 and 297 of fluid-based vest 220.

It should be appreciated that valves 325, 330 of fluid-based neck bladder 225 are configured to connect to valves 280, 305 by any suitable means which will be apparent to one of ordinary skill in the art in view of the present disclosure. If desired, connecting tubes 332 (FIG. 29) may be provided for establishing a fluidic connection between any two valves 325, 330 and/or 280, 305.

As a result of the foregoing construction, when a force is applied to either (or both) helmet 235 or protective outer vest covering 230, a force is applied to fluid-based head bladder 215 and/or fluid-based vest 220, respectively. As this occurs, fluid-based head bladder 215 is compressed between helmet 235 and the wearer's body and/or fluid-based vest 220 is compressed between protective outer vest covering 230 and the wearer's body, causing fluid contained within fluid cavity 218 of fluid-based head bladder 215 and/or fluid contained in fluid cavities 287, 293, 297 of fluid-based vest 230 to flow into fluid cavity 322 of fluid-based neck bladder 225, whereby to inflate (and hence, enlarge) fluid-based neck bladder 225.

It will be appreciated that fluid-based neck bladder 225 is preferably shaped so as to have a much larger volume fluid cavity in the posterior aspect of fluid-based neck bladder 225 when worn by a wearer. See, for example, FIGS. 33 and 35, which show the posterior aspect of fluid-based neck bladder 225 in a substantially uninflated condition, and FIGS. 44 and 45, which show the posterior aspect of fluid-based neck bladder 225 in an inflated condition. The provision of a fluid-based neck bladder 225 having an enlarged posterior aspect provides a significant benefit when the wearer is subject to a posteriorly-directed force to the anterior aspect of system 205 because the inflated fluid-based neck bladder 225 prevents the head from "snapping back", thereby preventing (or mitigating) neck or brain injury that might otherwise result from "whiplash". Similarly, the anterior and lateral aspects of fluid-based neck bladder 225 provide protection against forward and/or lateral movement of the head when inflated, thereby preventing or mitigating neck injury. Additionally, together the anterior, lateral and posterior aspects of the inflated fluid-based neck bladder 225 also protect against rotation of the neck and head and thereby prevent or mitigate neck or brain injury.

It will also be appreciated that inasmuch as fluid-based neck bladder 225 comprises a highly flexible elastomeric material, and inasmuch as a plurality of valves connect fluid cavities 218, 287, 293, 297 of each of bladders 215, 285, 290, 295, respectively, to fluid cavity 322 of fluid-based neck bladder 225, inflation of fluid-based neck bladder 225 occurs almost instantaneously when any one (or a plurality) of bladders 215, 285, 290, 295 are compressed (e.g., by an external force directed at the wearer, such as another player making physical contact with the wearer during sport).

Furthermore, once the external force directed at the wearer (e.g., the force resulting from another player making contact with the wearer) is ended or released, the elastomeric properties of the neck bladder will tend to automatically reduce the volume of cavity 322 of neck bladder 225 as fluid-based neck bladder 225 reverts to its uninflated condition, whereby to virtually instantaneously force the excess fluid in cavity 322 back through the valves 325, 330 to the bladders from which the fluid originated (e.g., one or more of bladders 215, 285, 290, 295), thereby allowing the neck bladder to return to its substantially deflated condition. Stated another way, once the external force directed upon novel system 205 has been removed, the entire system is instantaneously "re-set" to its baseline configuration in which fluid-based neck bladder 225 is in a substantially uninflated condition, and system 205 is ready to receive another external impact force to the wearer.

It should also be appreciated that the desired "baseline configuration" of system 205 is that fluid-based neck bladder 225 is in its substantially deflated condition, thereby allowing the wearer maximum range of motion in all planes about the neck (in order to best participate in their athletic activity). Once the pressure within cavity 322 of fluid-based neck bladder 225 is increased, fluid-based neck bladder 225 assumes its inflated condition, whereby to restrict range of motion about the neck of the wearer.

6. Helmet 235

Figure 50:
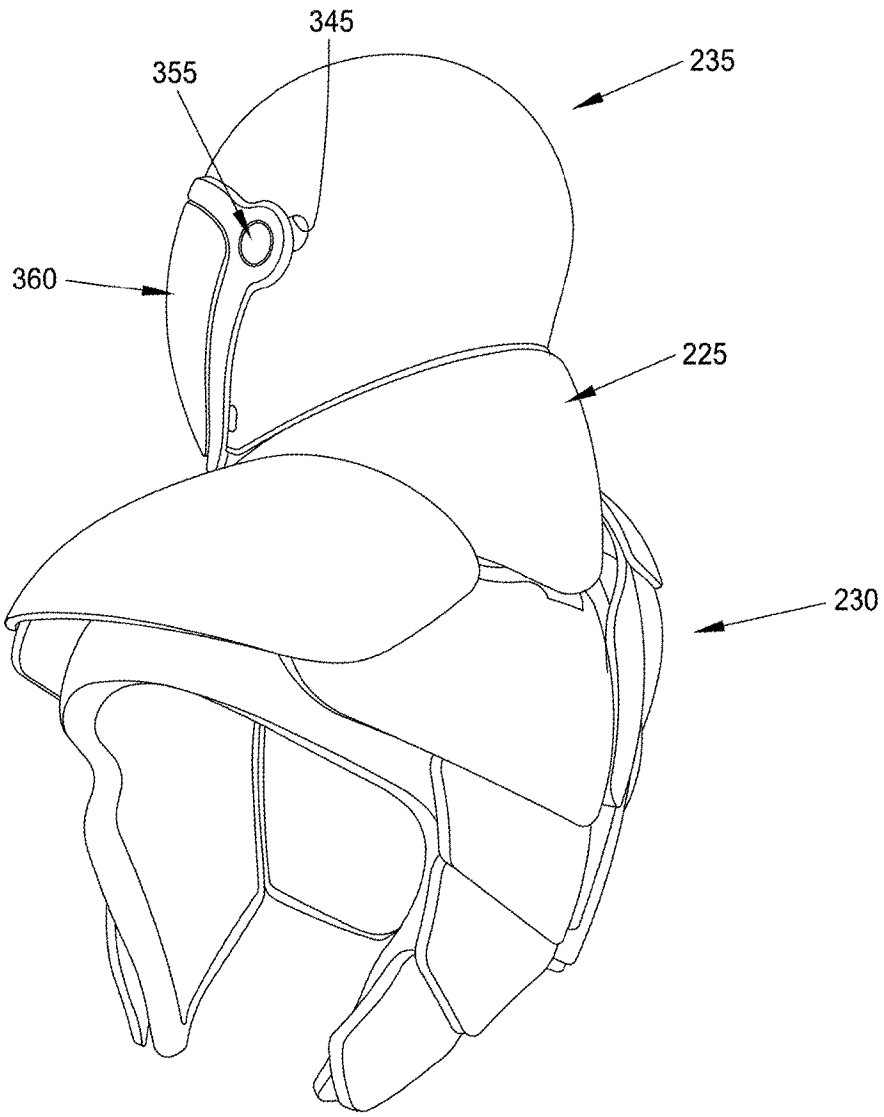
Figure 50B:
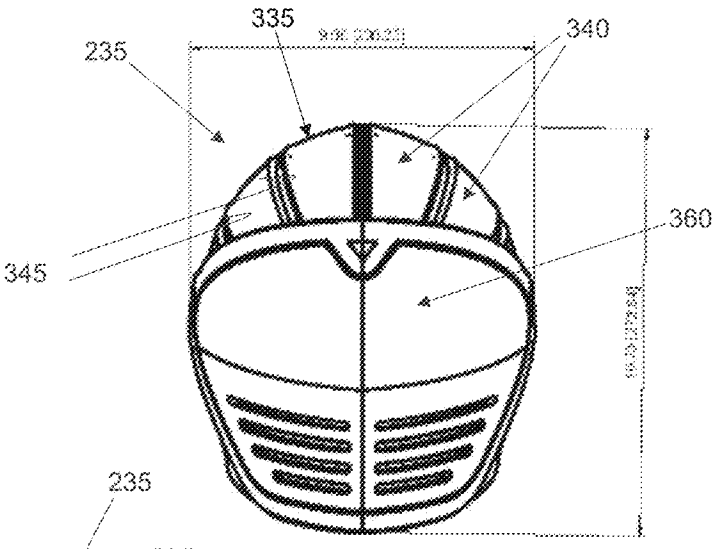
FIGS. 50A-50N are schematic views showing further details of the novel helmet of the novel system of FIGS. 27-29.
Figure 50C:
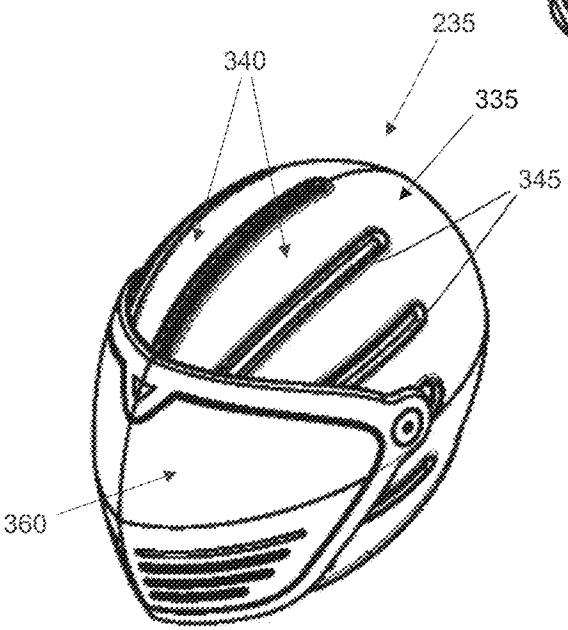
Figure 50A:
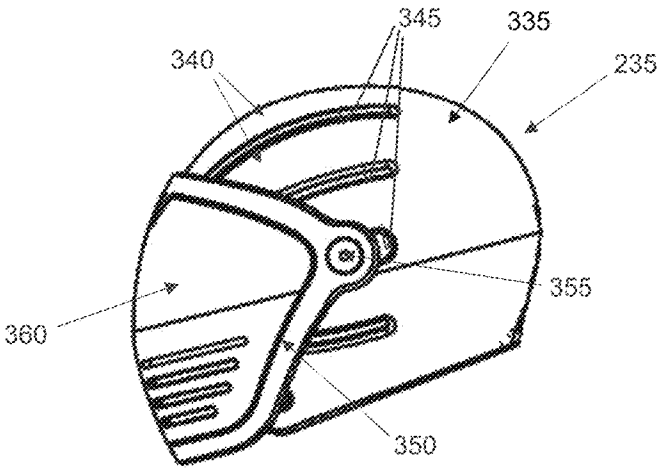
Figure 50E:
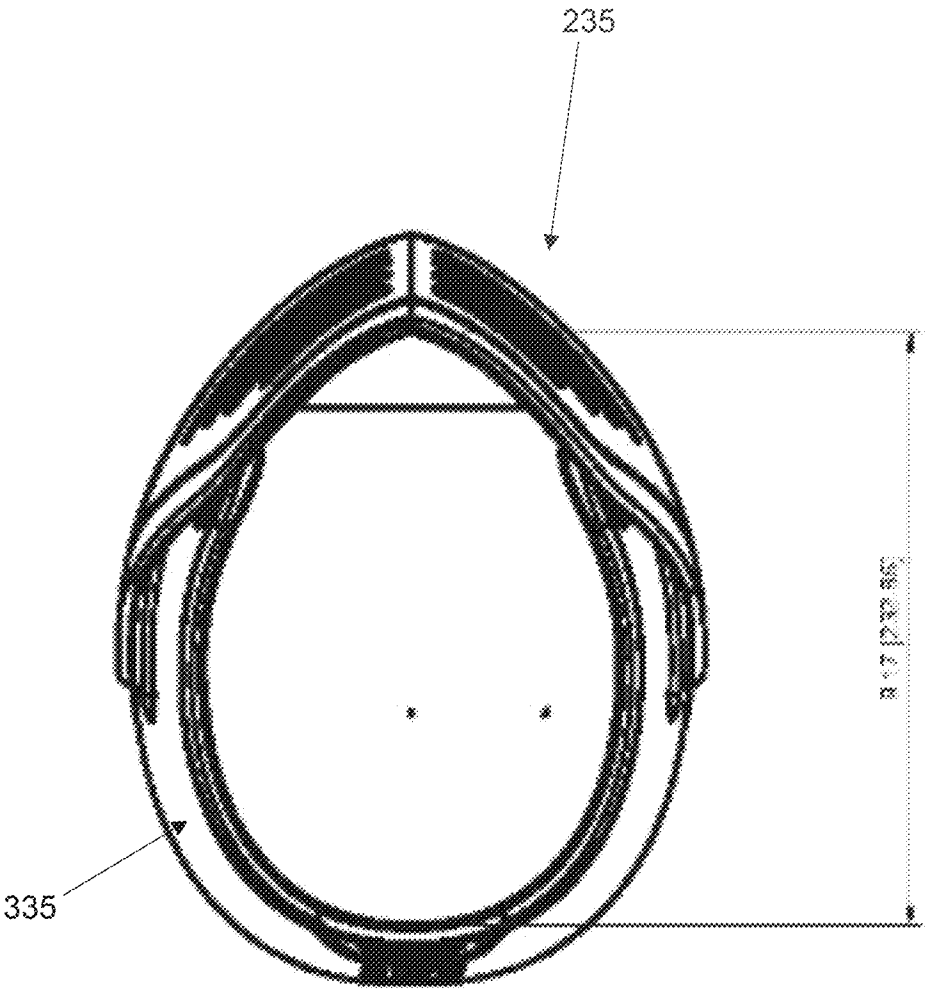
Figure 50D:
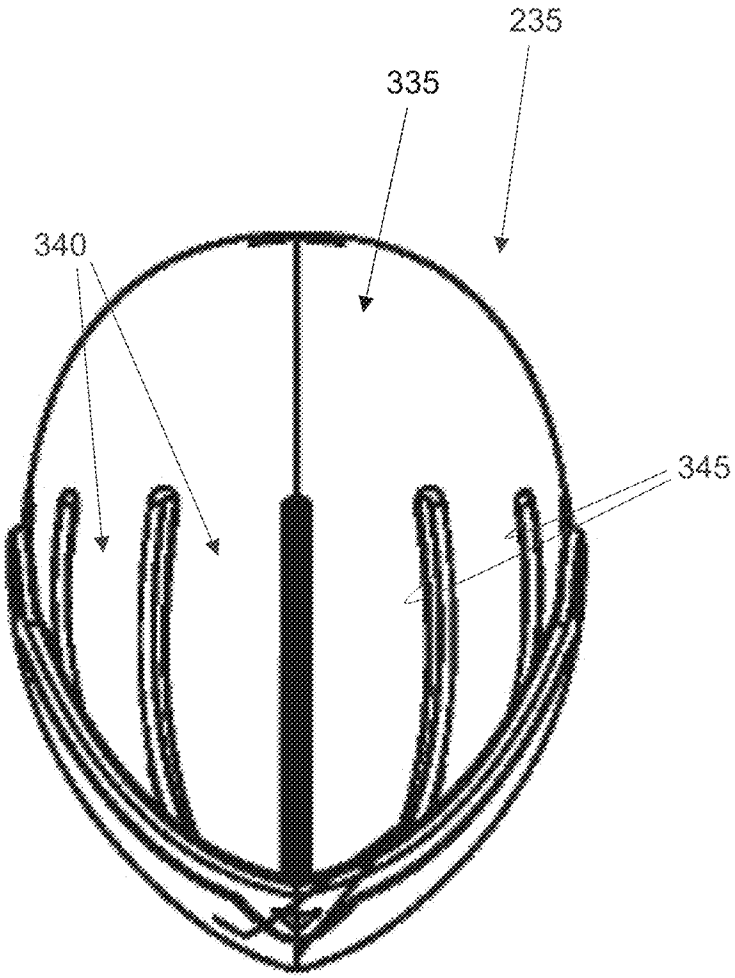
Figure 50G:
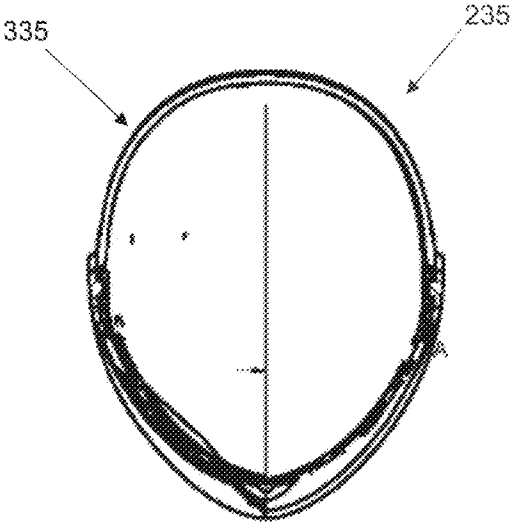
Figure 50F:
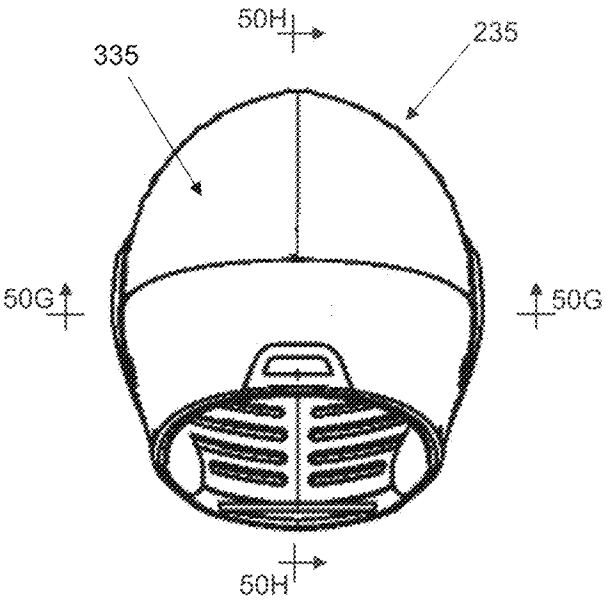
Figure 50H:
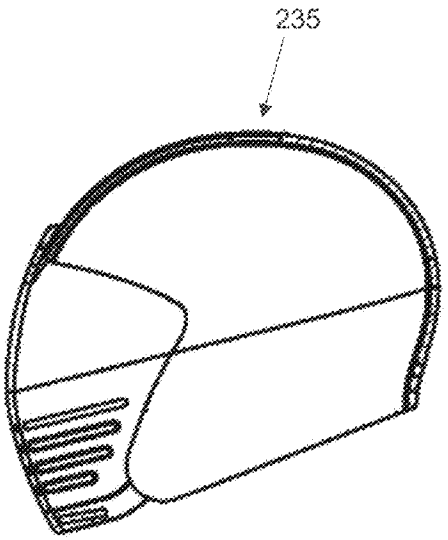
Figure 50J:
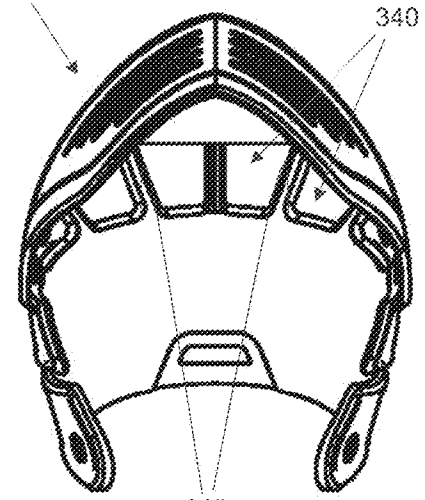
Figure 50K:
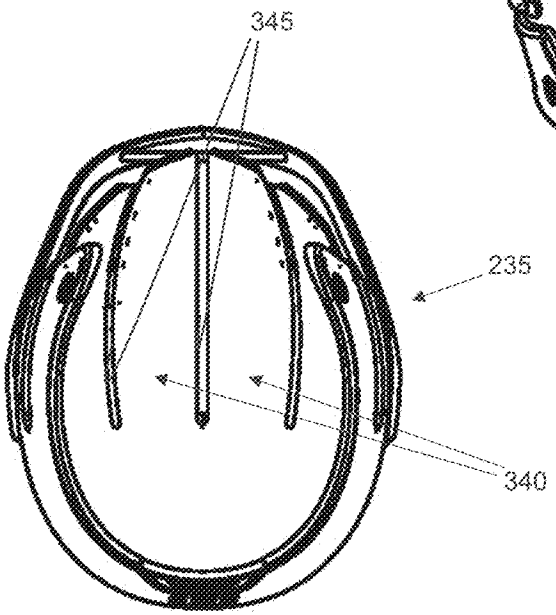
Figure 50I:
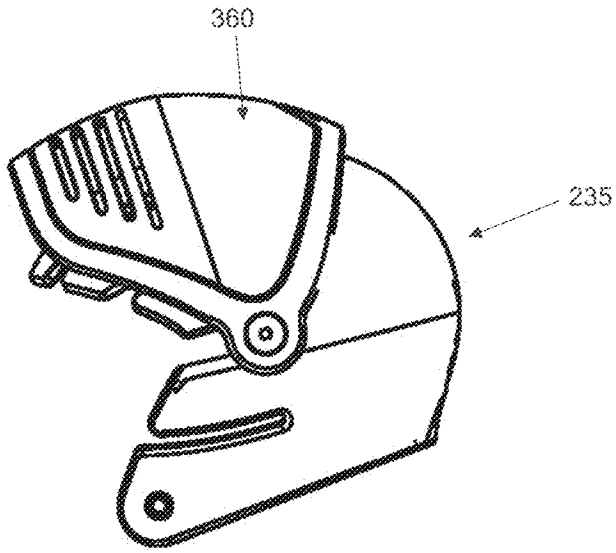
Figure 50L:
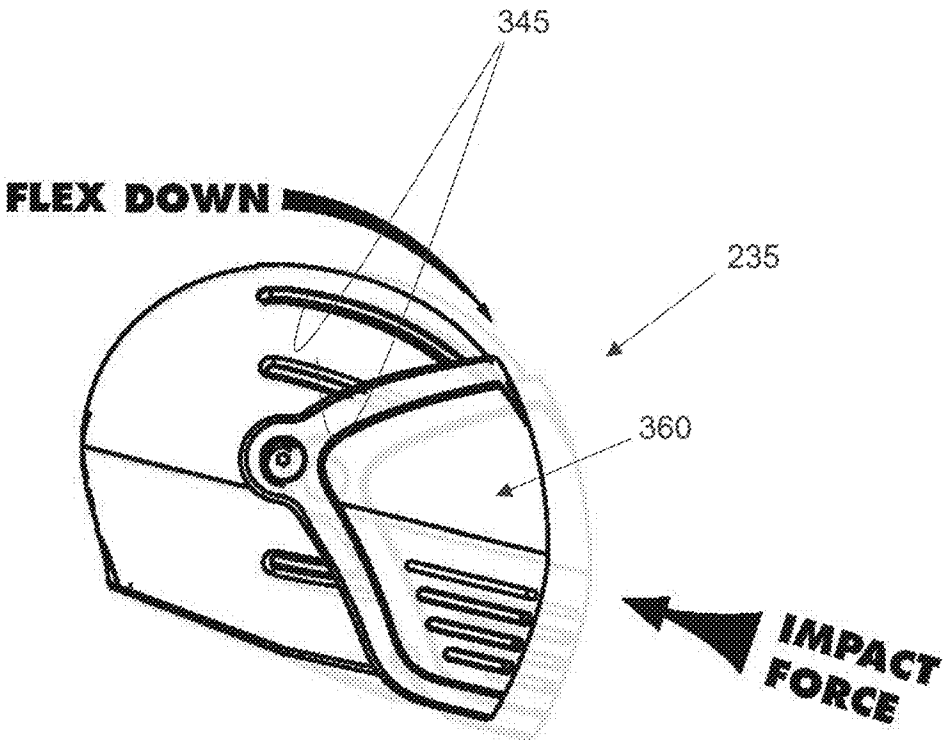
Figure 50L:
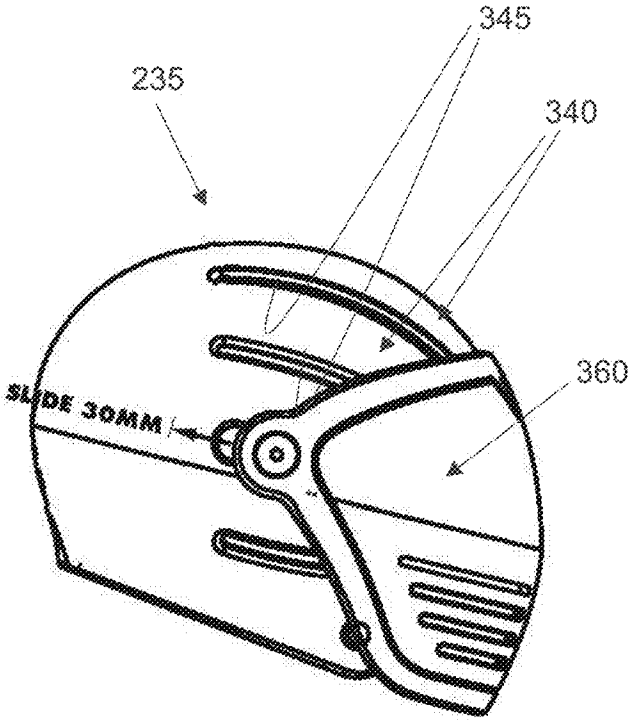
Figure 50M:
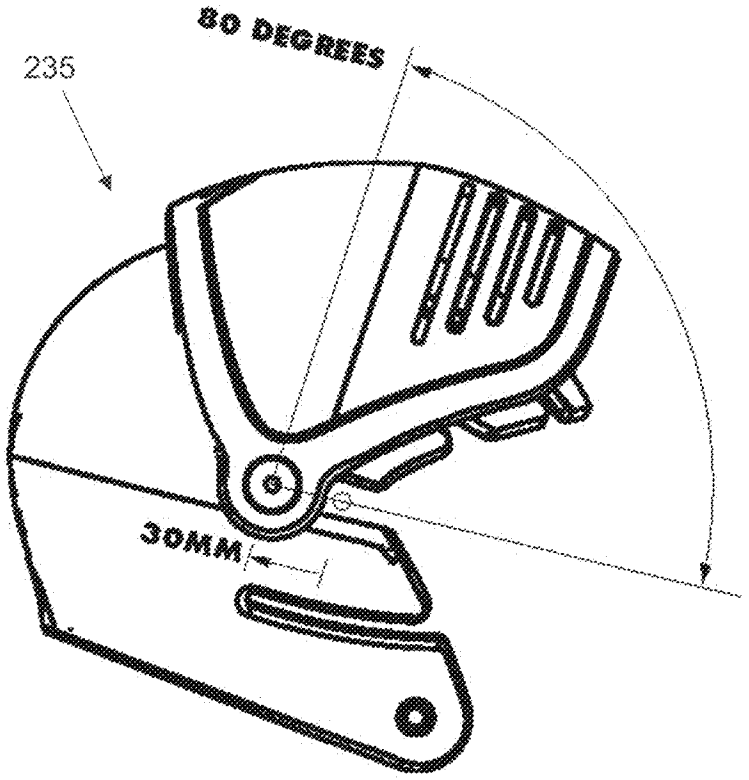
Figure 50N:
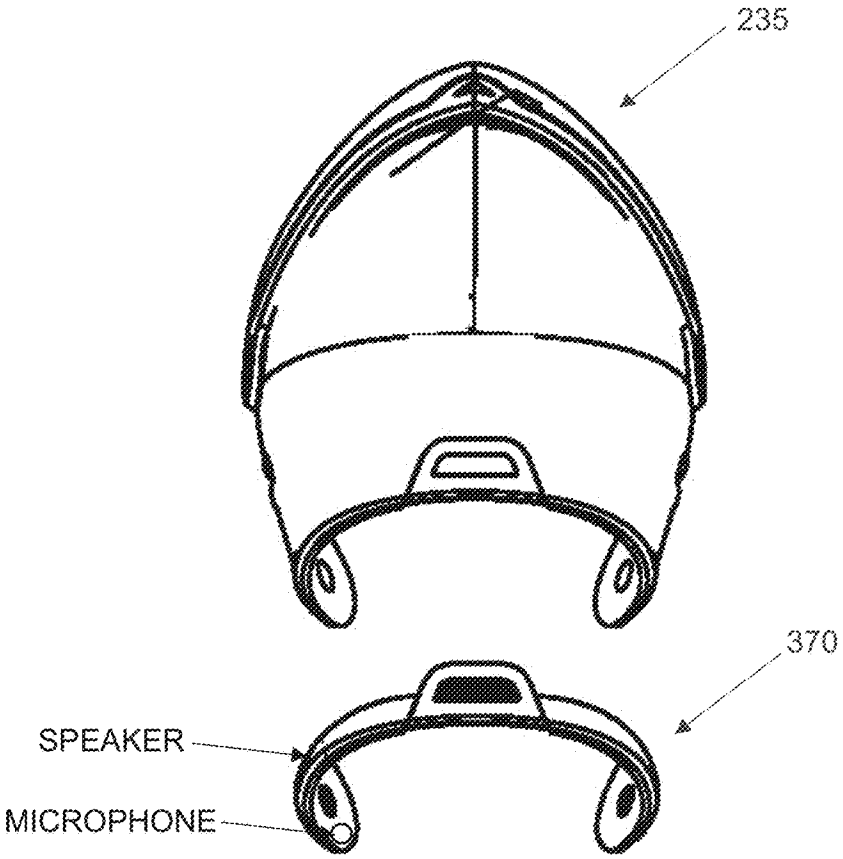

Looking now at FIGS. 29 and 50A-50N, novel helmet 235 generally comprises a flexible outer shell 335 (e.g., a shell made of injection molded polycarbonate with an optional puncture-proof open cell foam lining) comprising a plurality of slats 340 separated by grooves 345. A face shield frame 350 made of a rigid material (e.g., light weight forged titanium) comprising a sliding axel 355 is mounted to outer shell 335 by disposing sliding axel 355 inside a counterpart groove 345 formed by a separation of slats 340 such that sliding axel 355 (and hence, face shield frame 350) can slide posteriorly within groove 345 when subjected to a posteriorly-directed force. It will be appreciated that the width and length of grooves 345 establish the limits of flexing of slats 340.

If desired, a face shield 360 (e.g., an injection molded clear polycarbonate) may be mounted to face shield frame 350 so as to protect the wearer's face. Face shield 360 is preferably beveled (e.g., at the center of face shield 360), so as to direct forces away from the front of the head. If desired, face shield 360 may be perforated and/or may comprise an opening aligned with the mouth of the wearer, whereby to provide an opening for the wearer to breathe through, and whereby to prevent fogging of face shield 360 due to exhaled condensate. If desired, the entire face shield 360 (or, alternatively, certain areas of face shield 360) may be clear, or may be tinted or may be polarized or have other visual enhancing characteristics of the sort that will be apparent to those of ordinary skill in the art in view of the present disclosure.

In a preferred form of the present invention, face shield 360 and/or face shield frame 350 are configured to selectively pivot on sliding axles 355, whereby to permit the wearer to raise the face shield superiorly, if desired. Additionally, if desired, helmet 235 may comprise a chinstrap 365 (e.g., a single-strap chinstrap) for securing helmet 235 to the head of the wearer.

Importantly, grooves 345 comprise a geometry that is configured such that, when sliding axle 355 of face shield frame 350 moves posteriorly, slats 340 of shell 335 uniformly compress against the head of the wearer. As this compression occurs, fluid-based head bladder 225 (which is disposed between shell 335 of helmet 235 and compressive hood 240 of compressive base layer 210) is compressed, forcing fluid contained within cavity 218 of fluid-based head bladder 225 out of valves 280 and into cavity 322 of fluid-based neck bladder 225, whereby to inflate fluid-based neck bladder 225. Inasmuch as inflation of fluid-based neck bladder 225 occurs virtually instantaneously following compression of any of fluid bladders 215, 285, 290, 295, fluid-based neck bladder 225 is able to prevent the wearer's head from moving posteriorly and/or rotationally, thereby preventing injury.

7. Electronics for Monitoring Status of Novel System 205 and/or the Wearer of Novel System 205

Figure 52:
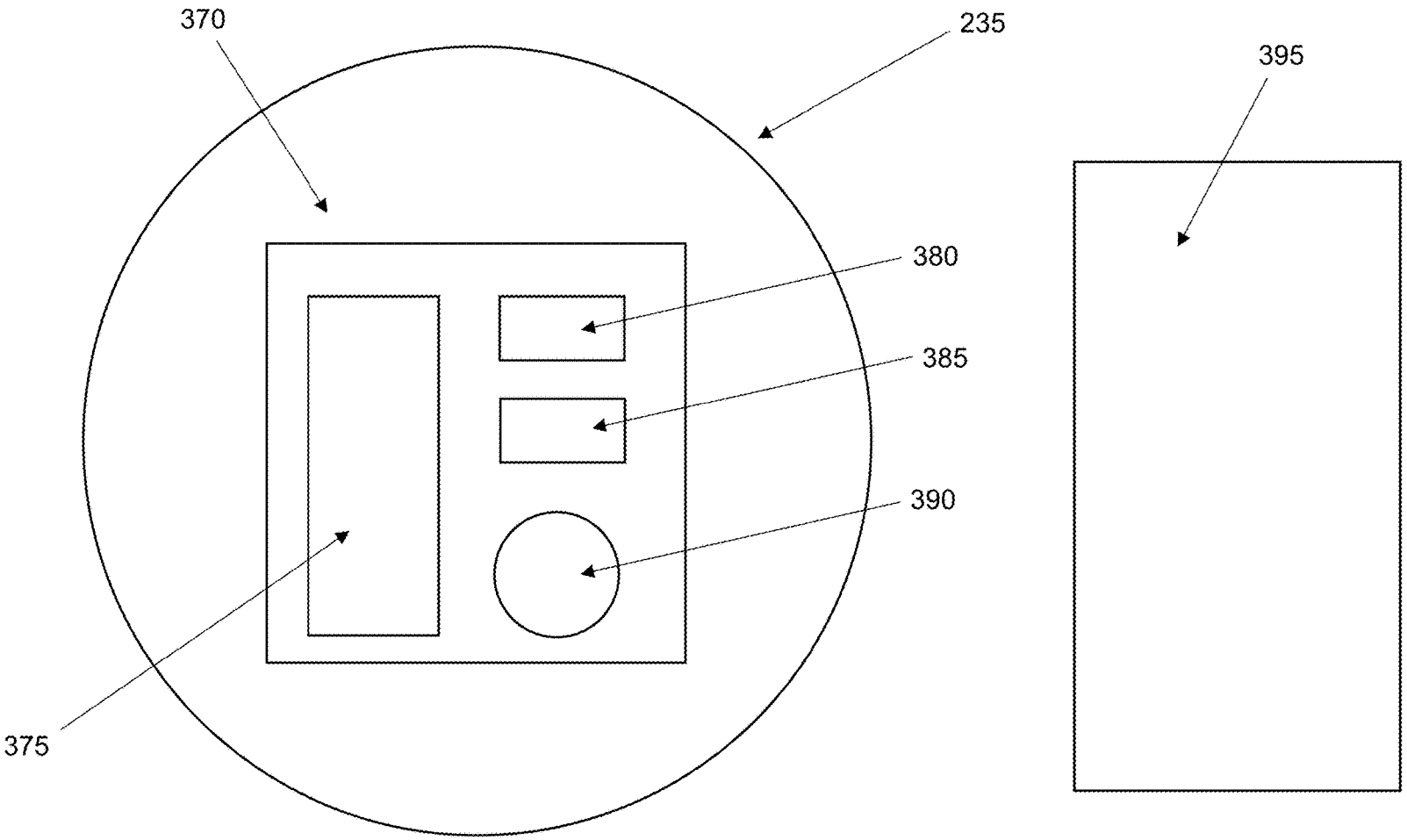
FIGS. 52-54 are schematic views showing further details of the novel electronics, communications and sensing apparatus of the novel system of FIGS. 27-29.

Looking now at FIGS. 29 and 52, if desired, novel system 205 may comprise electronics for monitoring the status of novel system 205 and/or the status of the person wearing novel system 205, as well as appropriate electronics for wirelessly transmitting data between novel system 205 and an external monitor (e.g., a handheld portable electronic device such as a mobile phone, a tablet, etc.).

By way of example but not limitation, if desired, helmet 235 may be provided with an electronics module 370 mounted to the posterior and/or inferior aspects of shell 335 of helmet 235 (FIG. 29). In one preferred form of the present invention, electronics module 370 comprises a battery pack 375 for powering the electronics contained in electronics module 370, an accelerometer 380, a transceiver module 385 (e.g., a Wi-Fi transceiver, a Bluetooth transceiver, cellular, etc.), and a visual indicator 390 (e.g., an LED light, string of LEDs, etc.). Battery pack 375 is preferably a rechargeable battery of the sort that will be apparent to one of ordinary skill in the art in view of the present disclosure. Electronics module 370 may be configured to be removable, and may be configured to connect to another device (e.g., via a USB port or other plug and play type technology) for the purposes of charging, downloading data, upgrading internal software, etc.

Accelerometer 380 of electronics module 370 is configured to monitor the forces experienced by helmet 235 (and hence, the forces experienced by the head of the wearer) and to wirelessly transmit that data to an external monitor 395 and/or to the internet (e.g., a central server or web-based server). Accelerometer 380 may comprise a multi-sensor and multi-axis accelerometer configured to measure acceleration, deceleration and rotation.

By way of further example but not limitation, external monitor 395 may comprise appropriate software (e.g., an "app") to interpret and display data received from transceiver module 385. In this way, one or more persons (e.g., a coach, a referee, medics, etc.) may monitor the forces experienced by helmet 235, and hence the forces experienced by the wearer of helmet 235, whereby to permit intervention in the event that a wearer has suffered a force (e.g., an impact) above a predetermined threshold, and/or a sum of forces above a predetermined threshold.

Figure 54:
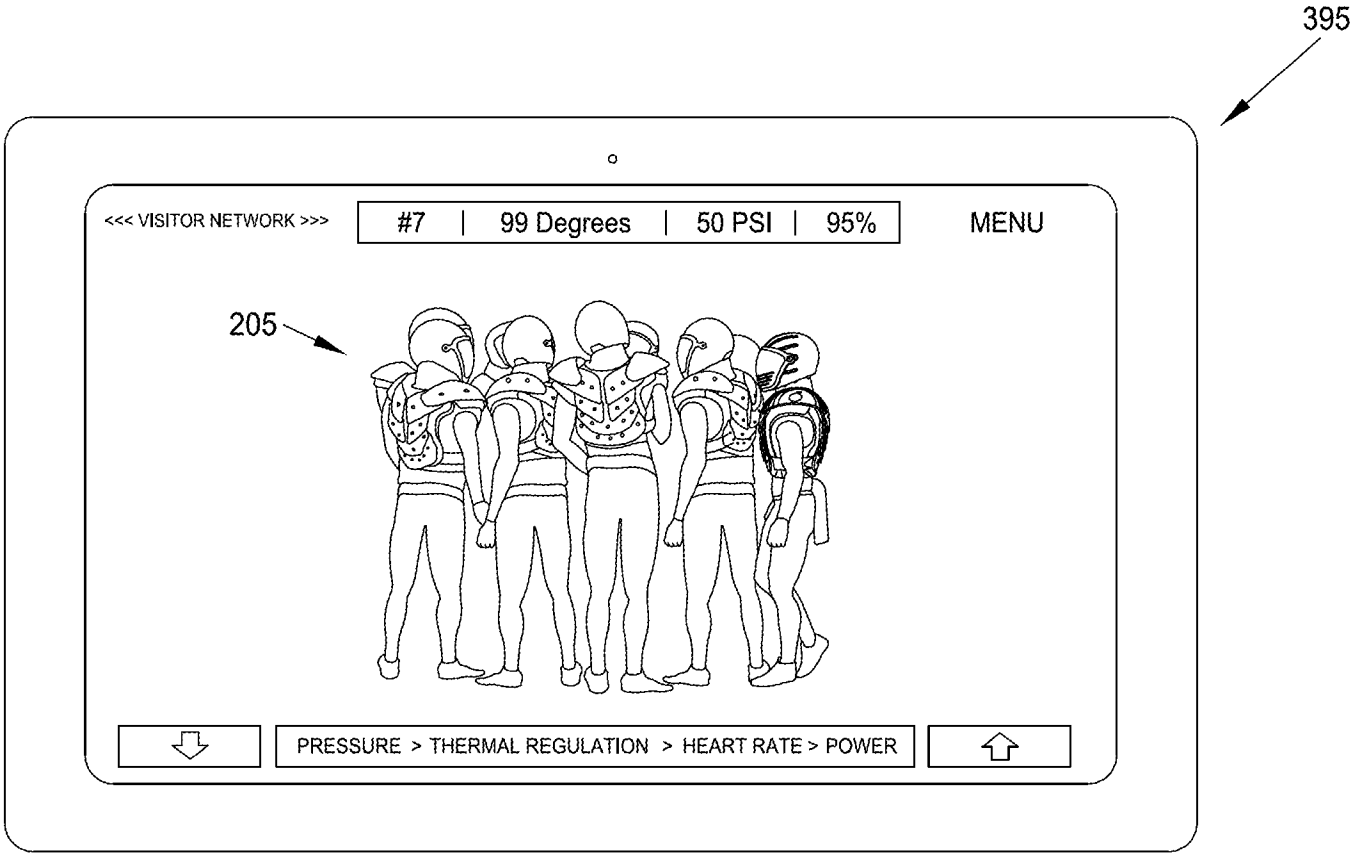

If desired, the software application running on external monitor 395 may be configured to monitor multiple electronic devices carried on an individual wearer (e.g., the aforementioned electronics module 370 mounted to helmet 235, electronics carried on the torso of the wearer, the aforementioned wireless module 261 mounted to compressive base layer 210, or on a wristband, etc.), and also may be able to monitor multiple wearers simultaneously (e.g., an entire team of players engaged in sport, wherein each player is wearing novel system 205). See FIG. 54. This data can be monitored in real time, and can also be stored permanently on the external monitor (e.g., a mobile phone, a tablet, etc.) and/or on a web-based server (such as a cloud-based remote server). External monitor 395 may be configured to provide instant visual and/or audible notifications to alert for specific customizable and individual thresholds for various pressure, temperature or other physiologic data for each wearer (or group of wearers).

Figure 56:
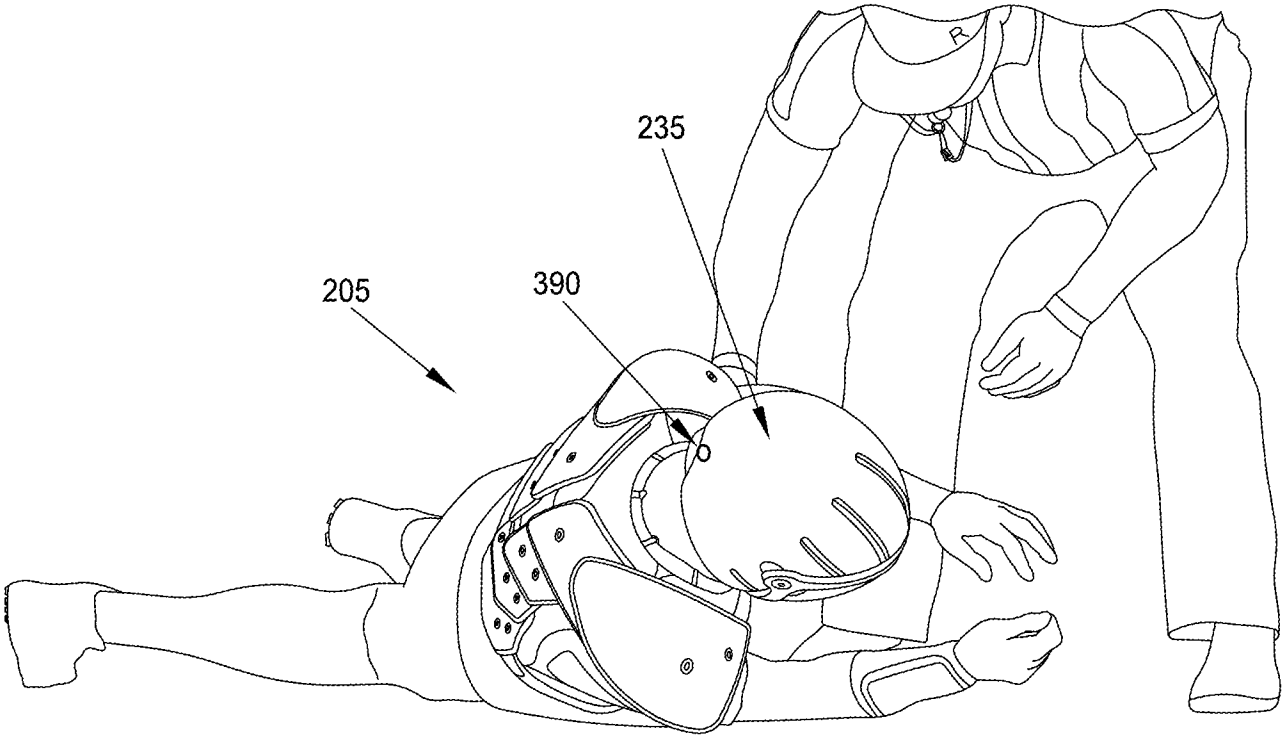
FIG. 56 is a schematic view showing how the novel electronics, communications and sensing apparatus of FIGS. 52-54 may be used to draw attention to a wearer that may need medical attention.

And, it should also be appreciated that, if desired, visual indicator 390 may be configured to automatically light up when the accelerometer detects a force exceeding a predetermined threshold. By way of example but not limitation, visual indicator 390 may comprise a single (highly-visible) LED light on the front and/or back of the helmet (see FIG. 56), a strip of LED lights extending about helmet 235 (or any other type of visual indicator that will be apparent to one of ordinary skill in the art) which illuminate when the helmet (and hence, the wearer) experiences a significant force that might cause trauma. In the context of contact sports such as American football, this illumination of visual indicator 390 permits others (e.g., coaches, referees, medics, etc.) to take notice of when a wearer (i.e., a player) has experienced a force that exceeds a predetermined threshold so that appropriate medical intervention may be provided.

If desired, electronics module 370 may comprise a speaker and microphone, whereby to permit the wearer (e.g., a quarterback in a game of American football) to communicate wirelessly with another individual on the sideline (e.g., a coach) or possibly another player in the game.

Furthermore, if desired, for an athlete engaged in a solitary activity (e.g., a motorcyclist or a skier), electronics module 370 may comprise a speaker and microphone which may be paired (e.g., via Bluetooth or other wireless connection) to the wearer's cell phone (or other mobile device). Electronics module 370 may be configured to automatically call emergency responders if a certain level of impact to the wearer is detected.

Additionally and/or alternatively, electronics module 370 may comprise one or more sensors (not shown) configured to monitor one or more physiological conditions of the wearer (e.g., body temperature, pulse, etc.) and/or one or more conditions of novel system 205 (e.g., fluid pressure and/or temperature within one or more of fluid-based head bladder 215, fluid-based vest 220, fluid-based neck bladder 225).

Additionally (or alternatively), if desired, a secondary (or alternative) electronics module 405 may be mounted to protective outer vest 230. By way of example but not limitation, and still looking at FIG. 29, if desired, secondary electronics module 405 may be mounted to an inferior aspect of protective outer vest 230, preferably in close relation to one or more input/output valves 306 of right-side fluid bladder 285 and/or left-side fluid bladder 290.

Figure 53:
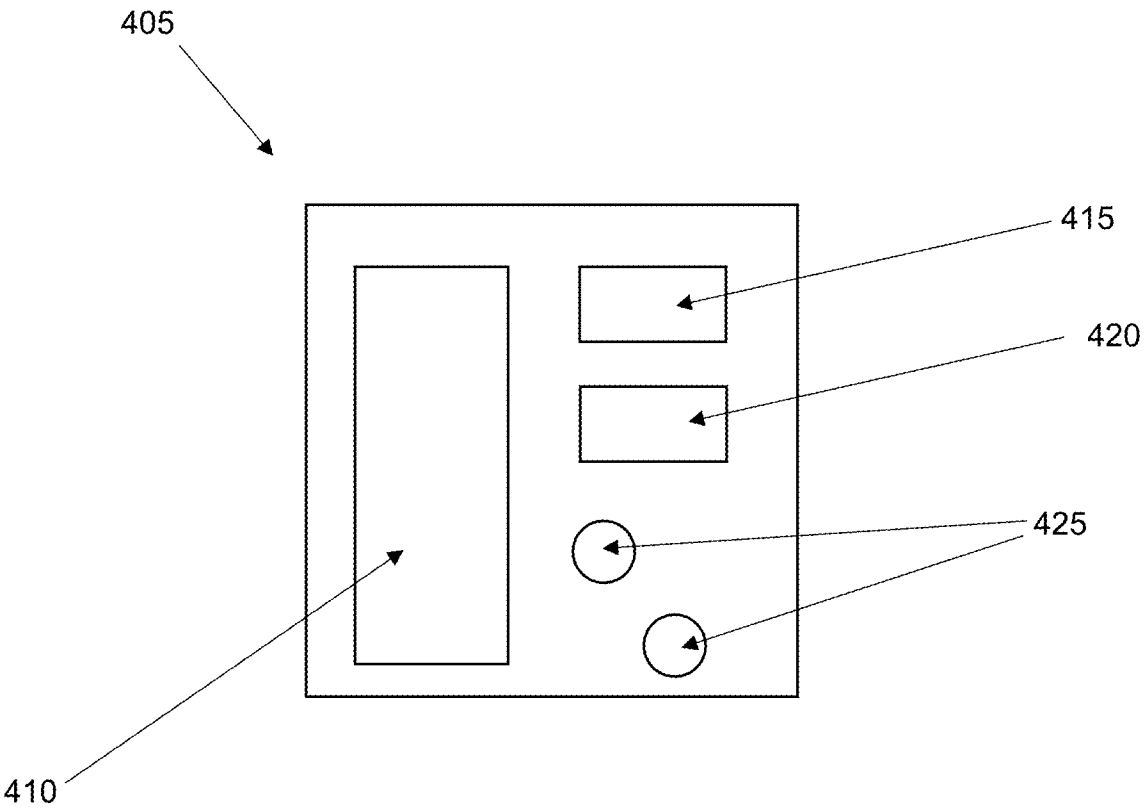

In one preferred form of the invention, and looking now at FIG. 53, secondary electronics module 405 comprises a rechargeable battery pack 410 for powering the electronics contained in electronics module 405, an accelerometer 415, a transceiver module 420 and one or more sensors 425. By way of example but not limitation, one or more sensors 425 may be configured to monitor the internal fluid pressure and/or temperature of one or both of right-side bladder 285 and left-side bladder 290, and to transmit data concerning the same to an external monitor (e.g., a mobile phone, a tablet, etc.).

In a preferred form of the present invention, all of the electronics modules (e.g., electronics module 370, electronics module 261, secondary electronics module 405, etc.) are configured to be easily removed and/or replaced for maintenance, repair or charging.

And, it should also be appreciated that, if desired, all sensors carried by system 205 may be wirelessly "paired together" for wireless transmission from the helmet (e.g., via the aforementioned electronics module 370) to external monitor 395, whereby to provide remote monitoring of all of the sensors contained in system 205.

It has been recognized that in certain medical contexts, such as a traumatic brain injury caused by concussion, it may be desirable to quickly lower the body temperature of the person suffering the injury in order to minimize damage from the injury. To this end, novel system 205 is configured to permit the inflow of fluid (e.g., air, water, etc.) having a very low temperature from an external source into the bladders 215, 285, 290, 295, 225 of system 205 via input/output valve(s) 306. This permits medical personnel to immediately lower the body temperature of a person wearing system 205, and mitigate further injury. By way of example but not limitation, where a player wearing system 205 while playing American football has suffered an impact likely to cause a traumatic brain injury, medical personnel can administer cold fluid into system 205 while the injured player is still on the field, eliminating the time that would normally be required to remove the equipment and find a suitable way to lower body temperature, thereby leading to a superior medical outcome.

Figure 55:
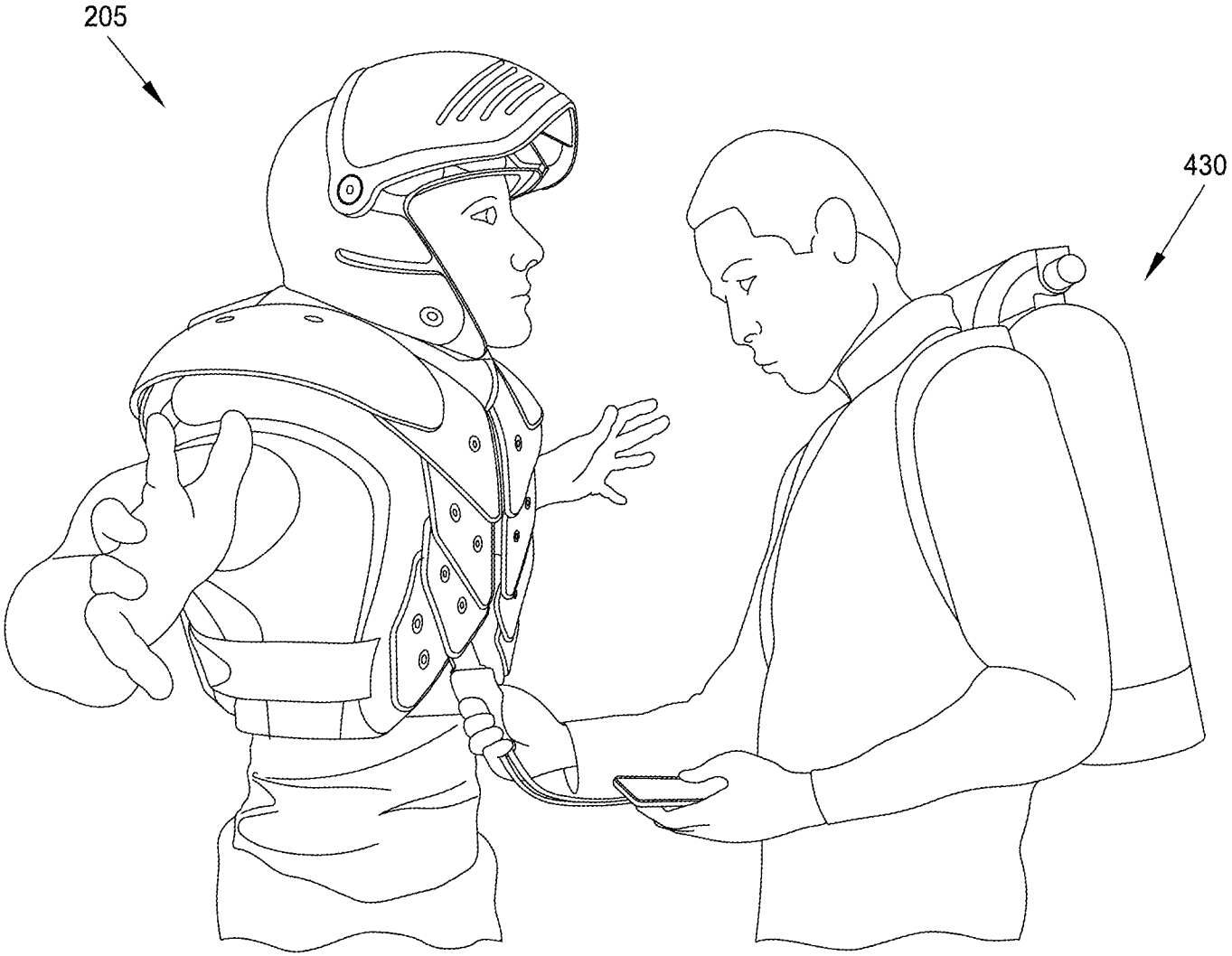
FIG. 55 is a schematic view showing how a fluid may be introduced into the novel system of FIGS. 27-29 from a fluid source.
Figure 57:
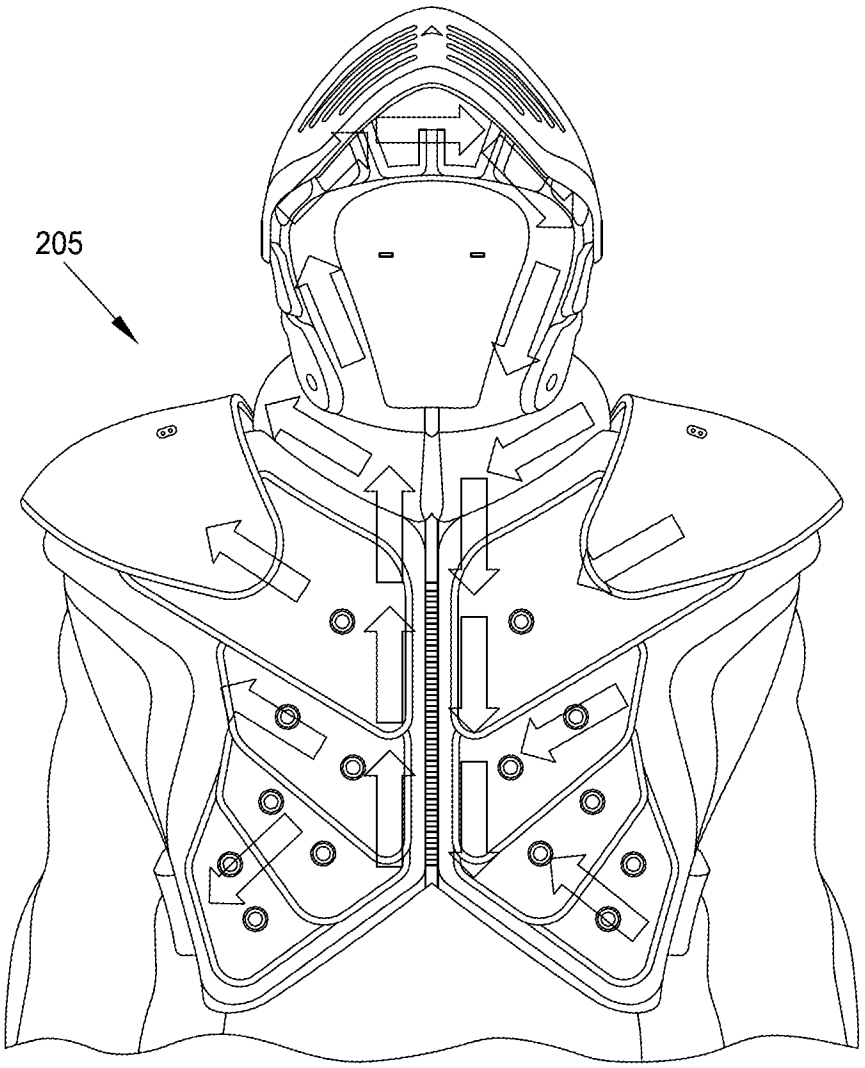
FIGS. 57 and 58 are schematic views showing how the novel system of FIGS. 27-29 may be intentionally inflated so as to immobilize the wearer and facilitate transport and treatment of the wearer.
Figure 58:
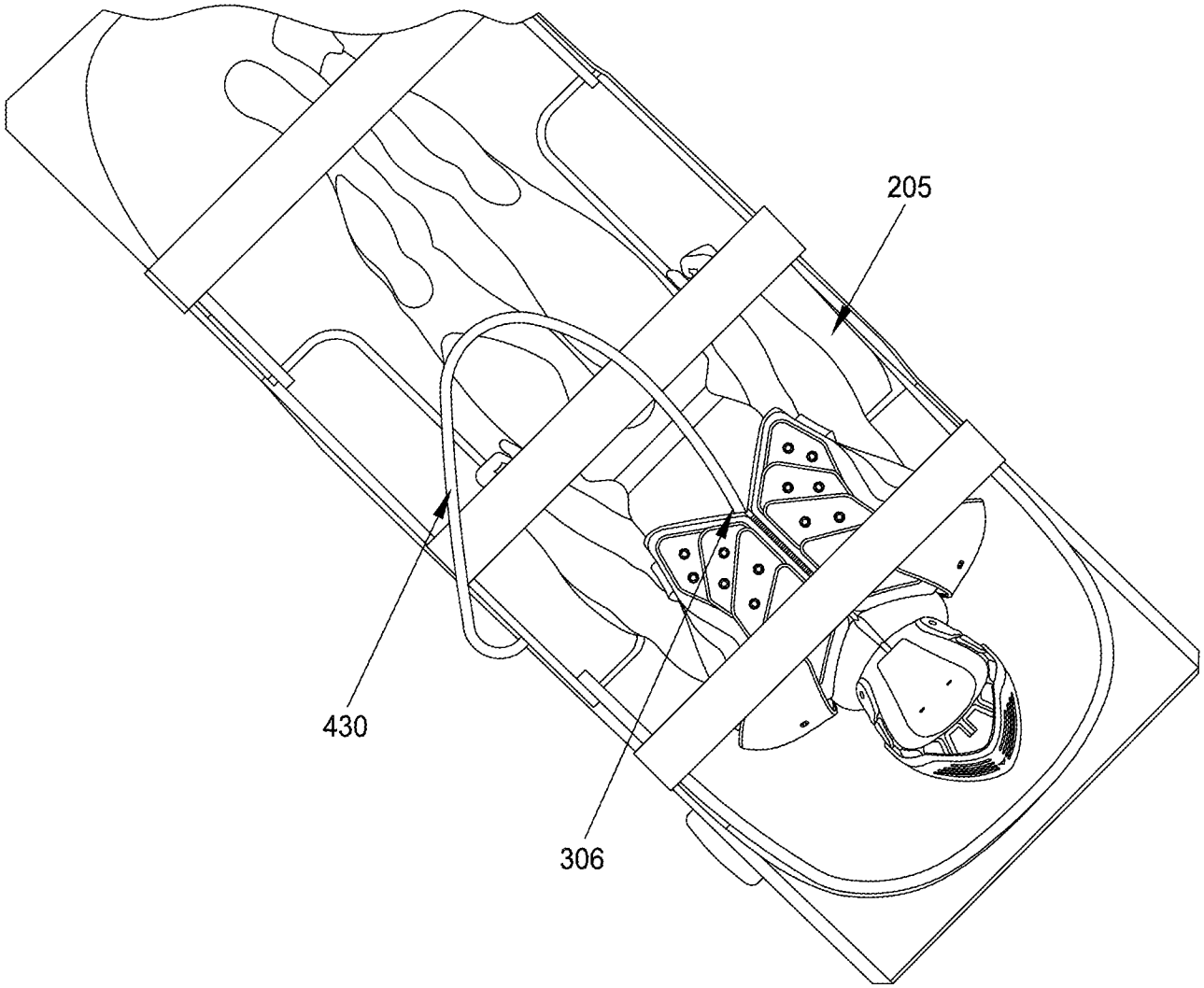

It should also be appreciated that, if desired, novel system 205 may be used to immediately immobilize the neck of a wearer (e.g., in the case of injury or suspected injury) by quickly inflating all of the bladders 215, 225, 285, 290, 295 to their maximum pressure/inflation. See, for example, FIGS. 57 and 58. By way of example but not limitation, in certain medical contexts, such as when a player is down on the field and needs to be evaluated or transported without further injuring a suspected neck or spinal injury, the neck and spine needs to be immobilized and protected. A sideline external air compressor device 430 (FIG. 55) can be brought on the field and used to rapidly inflate system 205 to maximum inflation and pressure such that fluid-based neck bladder 225 is completely inflated, whereby to protect the neck and spine of the wearer before the wearer is transported to receive medical care (e.g., before the wearer is transported off the field of play). See FIG. 58.

8. Use of Novel System 205

Figure 51:
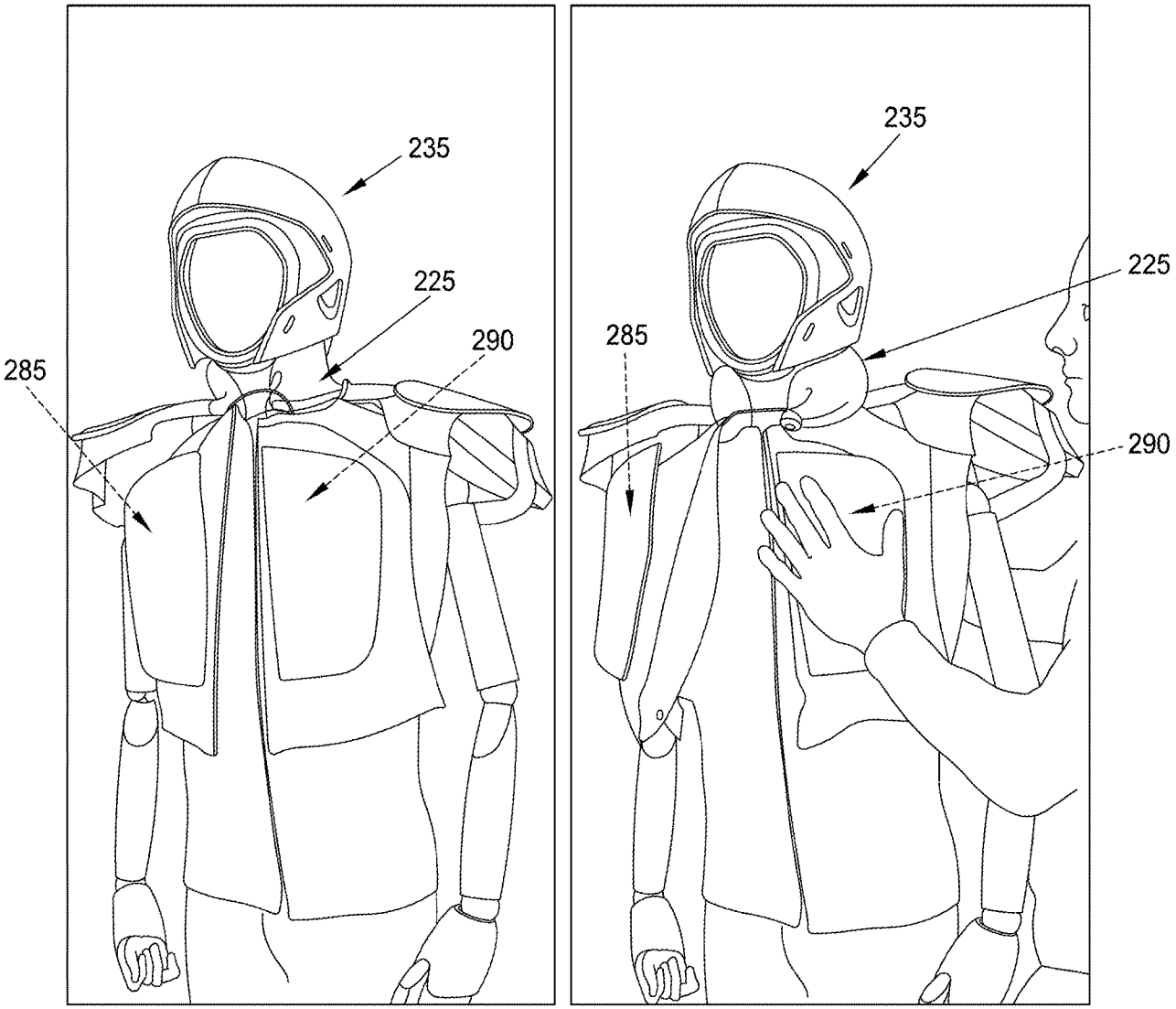
FIGS. 51, 51A and 51B are schematic views showing use of the novel system of FIGS. 27-29.
Figure 51A:
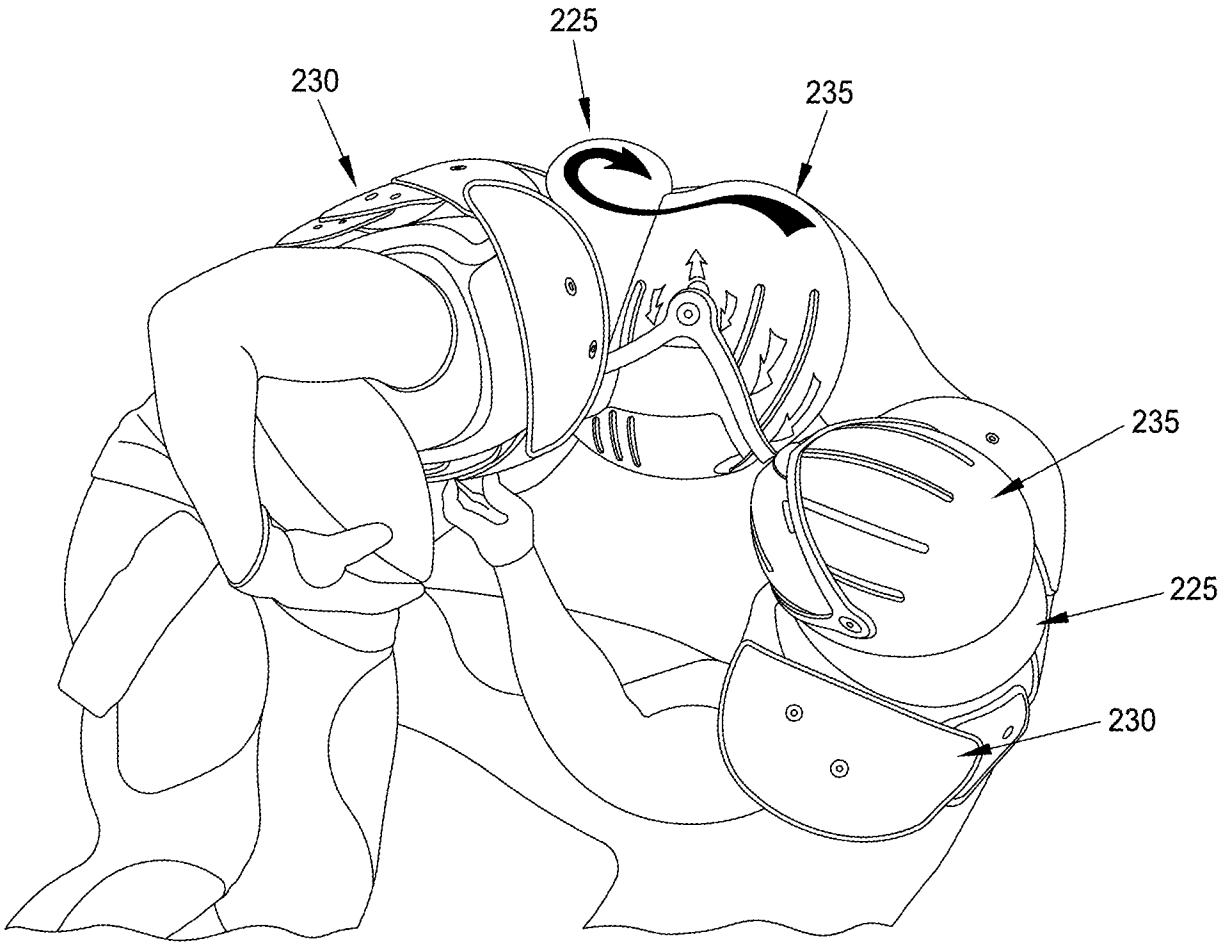
Figure 51B:
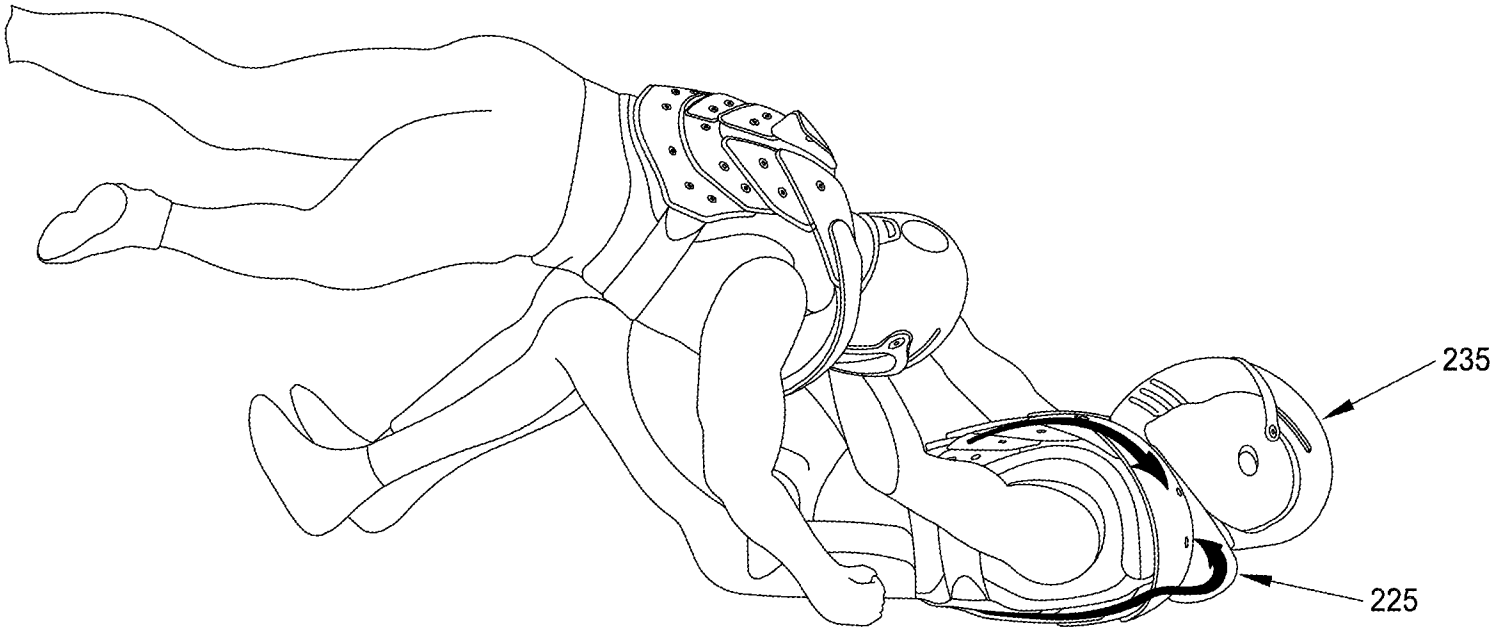

In use, and looking now at FIGS. 51, 51A and 51B, a wearer dons novel system 205 by: (1) donning compressive base layer 210, (2) donning fluid-based head bladder 215 and fluid-based vest 220, (3) donning fluid-based neck bladder 225, (4) donning protective outer vest 230, and (5) donning helmet 235.

Once the wearer has donned novel system 205, an appropriate amount of fluid (e.g., air, water, etc.) is added to the fluid cavities 218, 287, 293, 297 of fluid-based head bladder 215 and fluid-based vest 220, respectively, such that the fluid in the bladders 215, 220 is at a volumetric pressure above atmospheric pressure. By way of example but not limitation, fluid may be introduced into bladders 215, 220 via introduction into input/output valve(s) 306 from an external source (not shown). Alternatively, if desired, fluid may be introduced into novel system 205 prior to the wearer donning system 205. Alternatively, if desired, fluid may be introduced into the novel system 205 just prior to, or just after, the wearer donning helmet 235.

With system 205 fully donned, fluid-based neck bladder 225 is in a substantially uninflated condition, with fluid within fluid-based head bladder 215 and fluid-based vest 220 being at a pressure higher than atmospheric pressure. Since fluid-based head bladder 215 and fluid-based vest 220 are sandwiched between compressive base layer 210, and (i) helmet 235 and (ii) protective outer vest 230, respectively, when a compressive force is directed against either (or both) helmet 235 or protective outer vest 230, the "sandwiched" fluid bladders are compressed, and fluid flows into fluid-based neck bladder 225 such that fluid-based neck bladder 225 is then in a substantially inflated condition.

More particularly, as the compressive force (e.g., the force of impact from another player contacting helmet 235 and/or protective outer vest 230 during contact sports such as American football) compresses one or more of the fluid cavities 218, 287, 293, 297 of fluid-based head bladder 215 and/or fluid-based vest 220, the pressure of the fluid within cavities 218, 287, 293, and/or 297 increases as the volume is reduced by virtue of deformation of the bladders(s). Since cavity 218 of fluid-based head bladder 215 is fluidically connected to cavity 322 of fluid-based neck bladder 225 via the fluidic connection of valves 215 of fluid-based head bladder 225 with valves 325 of fluid-based neck bladder 225, when the fluid pressure of fluid within cavity 218 tends to rise, the fluid flows through valves 280, 325 into cavity 322 of fluid-based neck bladder 225, causing fluid-based neck bladder 225 to "inflate" and assume a larger volume. Similarly, since cavities 287, 293, 297 of fluid-based vest 220 are fluidically connected to cavity 322 of fluid-based neck bladder 225 via the fluidic connection of valves 305 of fluid-based vest 220 with valves 330 of fluid-based neck bladder 225, when the fluid pressure of fluid within at least one of cavities 287, 293, 297 rises, the fluid flows through valves 305, 330 into cavity 322 of fluid-based neck bladder 225, causing fluid-based neck bladder 225 to "inflate" and assume a larger volume.

When fluid-based neck bladder 225 is in an "inflated" condition (i.e., because fluid has filled cavity 322 of bladder 225), bladder 225 protects the wearer's neck and head by reducing the degree to which the wearer's neck and head can "snap back" (or move anteriorly, laterally, posteriorly or rotationally) when subjected to forces such as might occur during contact sports such as American football (see, for example, FIGS. 51A and 51B).

When the forces directed at the wearer are removed, the elastomeric properties of fluid-based neck bladder 225 cause fluid-based neck bladder 225 to constrict, reducing the volume of cavity 322 and thereby forcing the fluid to flow back out of bladder 225 through the valves 325, 330 and into fluid-based head bladder 215 and/or bladders 285, 290, 295 of fluid-based vest 220. Thus, the system is automatically "re-set" back to its baseline configuration (i.e., with fluid-based neck bladder 225 in a substantially uninflated condition) such that system 205 is prepared for the next impact.

Modifications of the Preferred Embodiments

It should be understood that many additional changes in the details, materials, steps and arrangements of parts, which have been herein described and illustrated in order to explain the nature of the present invention, may be made by those skilled in the art while still remaining within the principles and scope of the invention.

What is claimed is:

1. A protective system comprising:

a protective suit configured to be worn by a wearer, the protective suit comprising:

a head portion comprising a fluid-filled head portion chamber;

a neck portion releasably secured to the head portion and comprising a neck portion chamber, wherein the fluid-filled head portion chamber is in fluid communication with the neck portion chamber; and a torso portion releasably secured to the neck portion and comprising a fluid-filled torso portion chamber, wherein the fluid-filled torso portion chamber is in fluid communication with the neck portion chamber; and wherein the head portion is configured to be disposed on a head of the wearer, the neck portion is configured to be disposed in an arcuate manner around a neck of the wearer, and the torso portion is configured to be disposed on a torso of the wearer, such that when a force of an impact is received on the head portion, fluid from the fluid-filled head portion chamber is transferred into the neck portion chamber to support the neck of the wearer against translational and rotational forces imparted to the wearer, and when a force of an impact is received on the torso portion, fluid from the fluid-filled torso portion chamber is transferred to the neck portion chamber to support the neck of the wearer against translational and rotational forces imparted to the wearer.

2. The protective system of claim 1 wherein after the force of the impact to the individual has been removed, the fluid in the neck portion chamber flows back into the fluid-filled head portion chamber and the fluid-filled torso portion chamber.

3. The protective system of claim 1 wherein the fluid comprises a liquid.

4. The protective system of claim 1 wherein the fluid comprises a gas.

5. The protective system of claim 1 wherein the fluid-filled torso portion chamber comprises a left-side fluid bladder portion, a right-side fluid bladder portion and a rear fluid bladder portion.

6. The protective system of claim 1 wherein at least one of the torso portion and the head portion comprises an input/output valve for injecting or removing fluid from the protective suit in order to adjust the body temperature of the wearer.

7. The protective system of claim 6 further comprising an air compressor for injecting air into the protective suit.

8. The protective system of claim 1 wherein at least one of the torso portion and the head portion comprises an input/output valve for injecting or removing fluid from the protective suit in order to adjust the pressure within the head portion, the neck portion or the torso portion.

9. The protective system of claim 1 wherein the system further comprises a compressive base layer for disposition under the protective suit.

10. The protective system of claim 9 wherein the compressive base layer comprises a head portion, a torso portion and a leg portion.

11. The protective system of claim 9 wherein the compressive base layer comprises at least one sensor configured to measure at least one physiological condition of the user.

12. The protective system of claim 11 wherein the sensor comprises a wireless transmitter for transmitting data relating to the at least one physiological condition to a mobile device.

13. The protective system of claim 1 wherein the system further comprises an outer vest for disposition over the torso portion of the protective suit.

14. The protective system of claim 13 wherein the outer vest comprises a plurality of rigid, overlapping plates.

15. The protective system of claim 14 wherein the torso portion of the protective suit comprises a plurality of holes, and further wherein the outer vest is connected to the torso portion by passing at least one fastener through at least one of the plurality of holes.

16. The system of claim 14 wherein compression of the plurality of rigid overlapping plates upon impact to the outer vest maximizes displacement of fluid from the fluid-filled torso portion chamber to the neck portion chamber.

17. The protective system of claim 13 wherein the outer vest comprises an electronics module comprising at least one of:

an accelerometer for detecting a force of an impact,
a sensor for obtaining physiological data from the wearer,
a sensor for measuring the fluid within the protective suit,
a wireless transceiver for transmitting data to a mobile device,
an indicator light, and
a rechargeable battery for powering the electronics module.

18. The protective system of claim 17 wherein the electronics module comprises the indicator light, and wherein the indicator light lights up when a force of an impact on the wearer exceeds a predetermined threshold.

19. The protective system of claim 18 wherein the predetermined threshold is adjusted based on at least one from the group consisting of wearer height, wearer weight, and wearer concussive history.

20. The protective system of claim 17 wherein the electronics module is removable from the outer vest.

21. The protective system of claim 1 wherein the system further comprises a helmet for disposition over the head portion of the protective suit.

22. The protective system of claim 21 wherein the helmet comprises a flexible outer shell comprising a plurality of slats separated by grooves.

23. The protective system of claim 22 wherein when a force of an impact is received to the helmet, the slats compress the fluid-filled head portion chamber to move the fluid from the fluid-filled head portion chamber to the neck portion chamber.

24. The protective system of claim 22 wherein the helmet comprises a face shield, wherein when a force of an impact is received to the face shield, the face shield moves posteriorly within the grooves of the helmet to compress the plurality of slats of the helmet, whereby to compress the fluid-filled head portion chamber.

25. The protective system of claim 21 wherein the helmet comprises a face shield.

26. The protective system of claim 21 wherein the helmet comprises an electronics module comprising at least one of:

an accelerometer for detecting a force of an impact,
a sensor for obtaining physiological data from the wearer,
a sensor for measuring the fluid within the protective suit,
a wireless transceiver for transmitting data to a mobile device,
an indicator light, and
a rechargeable battery for powering the electronics module.

27. The protective system of claim 26 wherein the electronics module comprises the indicator light, and wherein the indicator light lights up when a force of an impact on the wearer exceeds a predetermined threshold.

28. The protective system of claim 27 wherein the predetermined threshold is adjusted based on at least one from the group consisting of wearer height, wearer weight, and wearer concussive history.

29. The protective system of claim 26 wherein the electronics module is removable from the helmet.

30. The system of claim 1 further comprising means for injecting cold fluid into the protective suit to cool the individual, whereby to reduce the effects of injury to the individual.

31. The system of claim 1 further comprising means for injecting warm fluid into the protective suit to warm the individual, whereby to reduce the effects of injury to the individual.

32. The system of claim 1 further comprising means for injecting pressurized fluid into the protective suit to cause the neck portion chamber to inflate, whereby to immobilize the neck of the individual.

33. A method for protecting an individual, the method comprising:

positioning a protective system on the individual, the protective system comprising:
a head portion comprising a fluid-filled head portion chamber;
a neck portion releasably secured to the head portion and comprising a neck portion chamber, wherein the fluid-filled head portion chamber is in fluid communication with the neck portion chamber; and
a torso portion releasably secured to the neck portion and comprising a fluid-filled torso portion chamber, wherein the fluid-filled torso portion chamber is in fluid communication with the neck portion chamber; and
wherein the head portion is disposed on a head of the individual, the neck portion is disposed in an arcuate manner around a neck of the individual, and the torso portion is disposed on a torso of the individual, such that when a force of an impact is received on the head portion, fluid from the fluid-filled head portion chamber is transferred into the neck portion chamber to support the neck of the individual against translational and rotational forces imparted to the individual, and when a force of an impact is received on the torso portion, fluid from the fluid-filled torso portion chamber is transferred to the neck portion chamber to support the neck of the individual against translational and rotational forces imparted to the individual; and
injecting fluid into at least one of the fluid-filled head portion chamber and the fluid-filled torso portion chamber.

34. The method of claim 33 wherein the system further comprises at least one of an outer vest for disposition over the torso portion of the protective suit and a helmet for disposition over the head portion of the protective suit.

35. The method of claim 34 wherein the outer vest comprises a plurality of rigid overlapping plates, and further wherein the helmet comprises a flexible outer shell comprising a plurality of slats separated by grooves.

36. The method of claim 34 wherein at least one of the outer vest and the helmet comprises an electronics module comprising at least one of:

an accelerometer for detecting a force of an impact,
a sensor for obtaining physiological data from the wearer,
a sensor for measuring the fluid within the protective suit,
a wireless transceiver for transmitting data to a mobile device,
an indicator light, and
a rechargeable battery for powering the electronics module.

37. The method of claim 34 wherein the system further comprises the helmet, and wherein the helmet comprises a flexible outer shell comprising a plurality of slats separated by grooves, and further wherein when a force of an impact is received to the helmet, the slats compress the fluid-filled head portion chamber to move the fluid from the fluid-filled head portion chamber to the neck portion chamber.

38. The method of claim 37 wherein the helmet comprises a face shield, wherein when a force of an impact is received to the face shield, the face shield moves posteriorly within the grooves of the helmet to compress the plurality of slats of the helmet, whereby to compress the fluid-filled head portion chamber.

39. The method of claim 33 wherein after the force of the impact to the individual has been removed, the fluid in the neck portion chamber flows back into the fluid-filled head portion chamber and the fluid-filled torso portion chamber.

* * * * *